US011813215B2

(12) United States Patent
Ajioka

(10) Patent No.: US 11,813,215 B2
(45) Date of Patent: Nov. 14, 2023

(54) NURSING-CARE DEVICE

(71) Applicant: WELLCARE BED CO., LTD., Tokyo (JP)

(72) Inventor: Junji Ajioka, Nagano (JP)

(73) Assignee: WELLCARE BED CO., LTD., Tokyo (JP)

( * ) Notice: Subject to any disclaimer, the term of this patent is extended or adjusted under 35 U.S.C. 154(b) by 0 days.

(21) Appl. No.: 17/436,075

(22) PCT Filed: Mar. 9, 2020

(86) PCT No.: PCT/JP2020/010132
§ 371 (c)(1),
(2) Date: Sep. 3, 2021

(87) PCT Pub. No.: WO2020/184527
PCT Pub. Date: Sep. 17, 2020

(65) Prior Publication Data

US 2022/0168164 A1 Jun. 2, 2022

(30) Foreign Application Priority Data

Mar. 8, 2019 (JP) ..... 2019-043227
Jun. 6, 2019 (JP) ..... 2019-106597

(51) Int. Cl.
*A61G 7/10* (2006.01)

(52) U.S. Cl.
CPC ..... *A61G 7/1036* (2013.01); *A61G 7/1015* (2013.01); *A61G 7/1019* (2013.01);
(Continued)

(58) Field of Classification Search
CPC .. A61G 7/1036; A61G 7/1015; A61G 7/1019; A61G 7/1034; A61G 7/1042;
(Continued)

(56) References Cited

U.S. PATENT DOCUMENTS 4,843,665 A * 7/1989 Cockel ..... A61G 7/0005 5/81.1 R
5,235,712 A * 8/1993 Smith ..... A61G 7/1003 4/585

(Continued)

FOREIGN PATENT DOCUMENTS

JP 2000189473 A 7/2000
JP 200338584 A 2/2003

(Continued)

OTHER PUBLICATIONS

Office Action in MY application No. PI2021005183, dated Oct. 31, 2022, 2pp.

(Continued)

*Primary Examiner* — Myles A Throop
(74) *Attorney, Agent, or Firm* — HAUPTMAN HAM, LLP

(57) ABSTRACT

Provided is a nursing-care device capable of easily moving a care-requiring person from the nursing-care device to medical/nursing-care equipment arranged at the side of a bed. One embodiment of the present invention includes a bed body having a floor portion at an upper surface, one and the other support bases supporting both ends of the bed body, support rods extending upward of the floor portion, and a lifting/lowering unit configured to lift/lower the bed body and the support rods. A lifting member is attached to the support rods. The support rods are lowered in a case where the bed body is lifted by the lifting/lowering unit, and are lifted in a case where the bed body is lowered. In a case where the support rods are lowered, the lowermost portion of the lifting member is moved to below the floor portion of the bed body.

8 Claims, 44 Drawing Sheets

(52) U.S. Cl.
CPC ..... *A61G 7/1034* (2013.01); *A61G 7/1042* (2013.01); *A61G 7/1051* (2013.01); *A61G 7/1065* (2013.01); *A61G 2200/32* (2013.01)

(58) Field of Classification Search
CPC ..... A61G 7/1051; A61G 7/1065; A61G 2200/32; A61G 7/1046; A61G 7/1057; A61H 33/00
See application file for complete search history.

(56) References Cited

U.S. PATENT DOCUMENTS

| | | | | | |
|---|---|---|---|---|---|
| 5,333,334 | A * | 8/1994 | Kassai | A61G 7/1034 5/85.1 |
| 5,539,941 | A * | 7/1996 | Fuller | A61G 7/1055 5/85.1 |
| 2014/0310875 | A1 * | 10/2014 | Iida | A61G 10/005 5/606 |

FOREIGN PATENT DOCUMENTS

| | | | | | |
|---|---|---|---|---|---|
| JP | 2007117522 | A | | 5/2007 | |
| JP | 2010172630 | A | | 8/2010 | |
| JP | 201461035 | A | | 4/2014 | |
| JP | 201464883 | A | | 4/2014 | |
| JP | 3205662 | U | | 8/2016 | |
| JP | 2021505067 | A | * | 2/2021 | H04S 1/007 |
| WO | WO-2020184527 | A1 | * | 9/2020 | A61G 7/1015 |

OTHER PUBLICATIONS

Notice of Allowance in JP application No. 2021-505067, dated Mar. 22, 2022, 5pp.
Office Action in JP application No. 2021-505067, dated Nov. 9, 2021, 7pp.

* cited by examiner

FIG. 3A
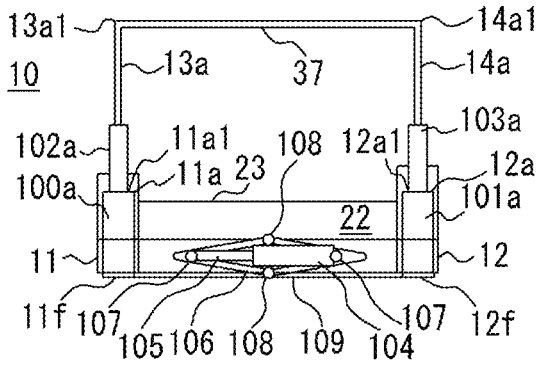
FIG. 3B
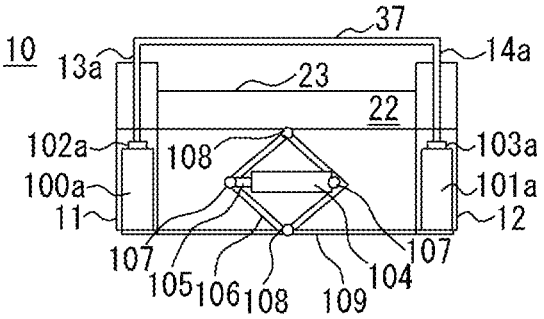
FIG. 3C
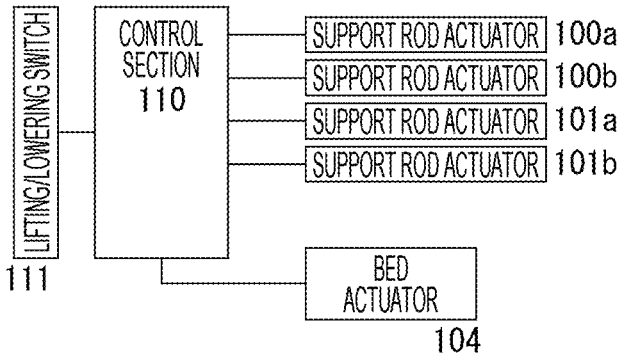
FIG. 3D
| TARGET | ELEMENT | OPERATION | |
|---|---|---|---|
| CONTROL SECTION TIMING CHART | LIFTING/LOWERING SWITCH (111) | LOWER BED | LIFT BED |
| | BED ACTUATOR (104) | EXTENDED | CONTRACTED |
| | SUPPORT ROD ACTUATOR (100a, 100b) (101a, 101b) | EXTENDED | CONTRACTED |
| NURSING-CARE BED OPERATION RESULT | BED BODY (22) | LOWERED | LIFTED |
| | SUPPORT ROD (13a, 13b, 14a, 14b) | LIFTED | LOWERED |

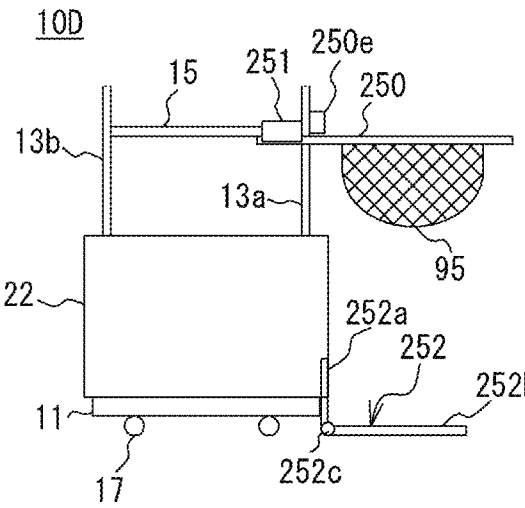
FIG. 14A
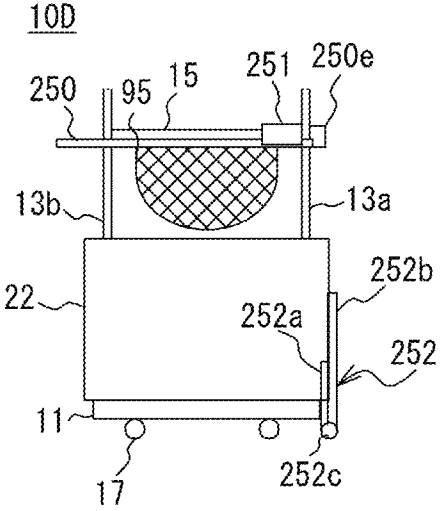
FIG. 14B
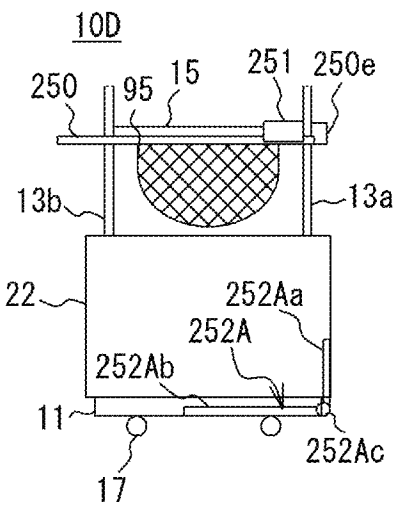
FIG. 14E
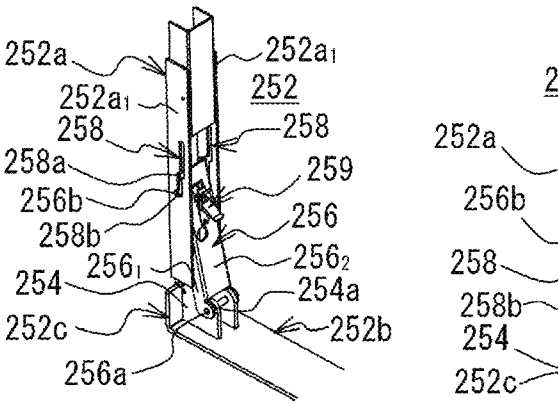
FIG. 14D
FIG. 14C
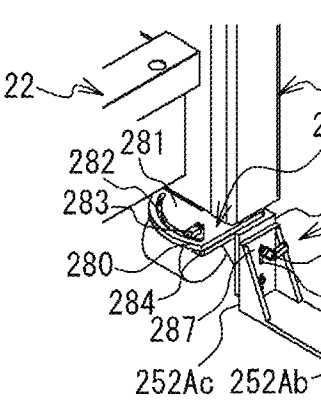
FIG. 14F
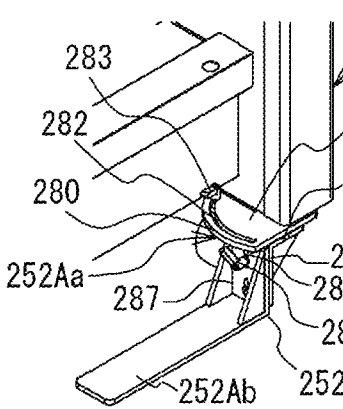
FIG. 14G FIG. 16A
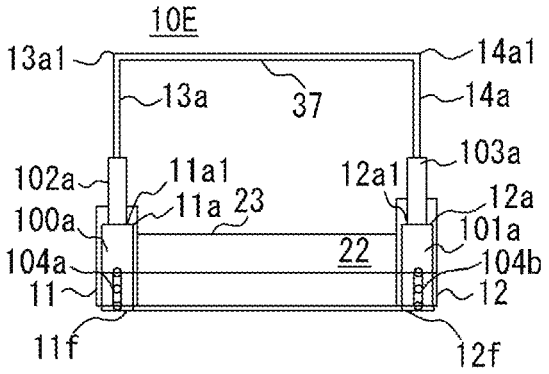
FIG. 16B
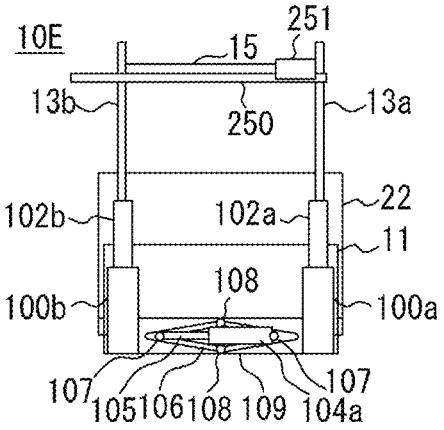
FIG. 16C
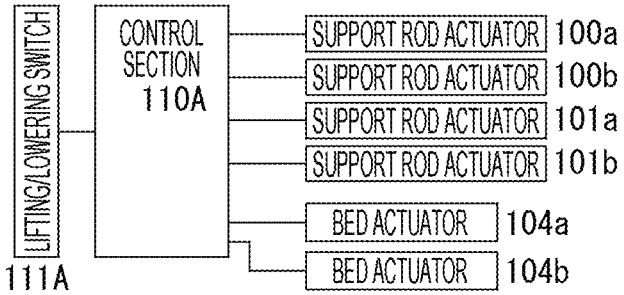
FIG. 16D
| TARGET | ELEMENT | OPERATION | |
|---|---|---|---|
| CONTROL SECTION TIMING CHART | LIFTING/LOWERING SWITCH (111A) | LOWER BED | LIFT BED |
| | BED ACTUATOR (104a, 104b) | EXTENDED | CONTRACTED |
| | SUPPORT ROD ACTUATOR (100a, 100b) (101a, 101b) | EXTENDED | CONTRACTED |
| NURSING-CARE BED OPERATION RESULT | BED BODY (22) | LOWERED | LIFTED |
| | SUPPORT ROD (13a, 13b, 14a, 14b) | LIFTED | LOWERED |
FIG. 16E
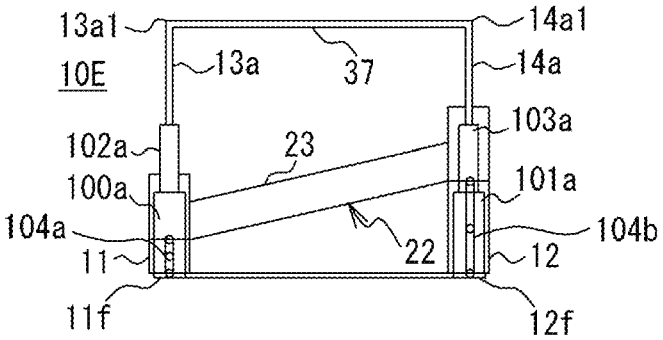

NURSING-CARE DEVICE

RELATED APPLICATIONS

The present application is a National Phase of International Application No. PCT/JP2020/010132, filed Mar. 9, 2020, which claims priority to Japanese Application Nos. 2019-043227, filed Mar. 8, 2019, and 2019-106597, filed Jun. 6, 2019.

TECHNICAL FIELD

The present invention relates to a nursing-care device, and specifically relates to a nursing-care device capable of easily moving a care-requiring person from the nursing-care device to another type of medical/nursing-care equipment arranged at the side of a bed, such as a wheelchair, a stretcher, or a simple bathtub.

BACKGROUND ART

For example, a robot-equipped nursing-care device is disclosed in Patent Literature 1 below as a nursing-care device capable of easily moving a care-requiring person from the nursing-care device such as a nursing-care bed to another type of medical/nursing-care equipment arranged at the side of the bed, such as a wheelchair.

The robot-equipped nursing-care device disclosed in Patent Literature 1 below is a nursing-care bed having a bed body and one or the other support bases supporting both ends of the bed body in a longitudinal direction thereof. The bed body has a rectangular floor portion having such predetermined area and thickness that the care-requiring person can lie on the bed body. At each of one and the other support bases, a support rod protruding from the bed body and a lifting/lowering unit configured to lift/lower the support rod and the bed body are provided. An attachment portion to which a suspension member is detachably attached is provided above the support rod. A distance between the floor portion and the attachment portion is decreased when the bed body is lifted, and is increased when the bed body is lowered. The suspension member is slidable in a direction apart from the bed body, and has a pair of belt bodies forming a lifting member for lifting the care-requiring person. The pair of belt bodies is attached along the longitudinal direction between the attachment portion on one support base side and the attachment portion on the other support base side. The care-requiring person is lifted from the floor portion by the lifting/lowering unit, and thereafter, the suspension member is slid in a lateral direction. In this manner, the care-requiring person can be slid to the location of another type of medical/nursing-care equipment positioned at the side of the bed body. Further, the care-requiring person can be lowered by the lifting/lowering unit to move to another type of medical/nursing-care equipment.

Patent Literature 2 discloses an invention for supporting transfer of a care-requiring person on a bed to, e.g., a wheelchair by a nursing-care robot. The invention of the Patent Literature 2 includes the step of placing a sheet, which includes holding target portions to be held by robot arms at both end portions of the sheet, on the bed, the step of causing the care-requiring person to lie on the sheet, the step of determining the positions of the robot and the robot arms with respect to the care-requiring person, the step of holding the holding target portions by the arms after the robot has advanced to the bed, the step of lifting the arms by a predetermined amount, and the step of retracting the robot from the bed with the arms being lifted by the predetermined amount.

Patent Literature 3 discloses an invention relating to a nursing-care lift hanging tool used when a sick person or a disabled person is lifted or lowered by a nursing-care lift and is moved. The invention of Patent Literature 3 below relates to a belt-type nursing-care lift hanging tool including a leg belt and a trunk belt both including, at both end portions thereof, hooking portions hookable on a nursing-care lift hanger. The above-described leg belt is configured such that a leg support portion is provided at a center portion and a trunk belt insertion hole into which each end side of the trunk belt can be inserted is provided between the leg support portion and each of the hooking portions provided at both end portions on both of the right and left sides of the leg support portion. After both end portions of the trunk belt have been inserted into these insertion holes, the hooking portions at both ends are hooked on the nursing-care lift hanger.

CITATION LIST

Patent Literature

PATENT LITERATURE 1: Japanese Utility Model No. 3205662
PATENT LITERATURE 2: JP-A-2014-061035
PATENT LITERATURE 3: JP-A-2003-038584

SUMMARY OF INVENTION

Problems to be Solved by Invention

Patent Literature 1 above discloses the technique of moving the care-requiring person from the nursing-care bed to the wheelchair, but for movement to, e.g., the wheelchair only by movement of the bed body and the lifting member, it might be difficult to reliably move the care-requiring person to, e.g., the wheelchair as long as movement of the bed body and the lifting member cannot be accurately performed. Note that in a case where it is difficult to move the care-requiring person only by movement of the bed body and the lifting member, such movement is performed using, e.g., extension/contraction of the lifting member or the belt body.

Patent Literatures 2 and 3 above disclose the technique of moving the care-requiring person from the nursing-care bed to the wheelchair. However, these techniques do not solve the feeling of insecurity about, e.g., dropping of the care-requiring person, and require an effort to operate, e.g., the nursing-care robot by a caregiver. Moreover, there is also a problem that a maintenance cost is high.

As a result of various types of study for solving the problems of the prior art as described above by the inventor, an object is to provide a nursing-care device having a mechanism capable of more easily moving a care-requiring person to another type of medical/nursing-care equipment arranged at the side of a bed, such as a wheelchair, a stretcher, or a simple bathtub, by movement of a bed body and each support rod and reducing a burden on a caregiver such as a nursing-care helper, specifically a burden upon transfer.

Solutions to Problems

In order to solve the above problems, a nursing-care device of the first aspect according to the present invention is provided, the device including: a bed body having, at an upper surface thereof, a rectangular floor portion with such predetermined area and thickness that a care-requiring person is able to lie on the bed body; a support base on which the bed body is supported; a support rod extending upward of the floor portion of the bed body; and a lifting/lowering unit configured to lift/lower the bed body and the support rod, wherein a lifting member configured to lift the care-requiring person is attached to the support rod, the support rod is lowered in a case where the bed body is lifted by the lifting/lowering unit, and is lifted in a case where the bed body is lowered by the lifting/lowering unit, and in a case where the support rod is lowered, at least a position of a lowermost portion of the lifting member attached to the support rod is moved to a predetermined position.

Furthermore, the nursing-care device of the second aspect is provided in the nursing-care device of the first aspect, wherein in a case where the support rod is lowered, at least the lowermost portion of the lifting member attached to the support rod is moved to below an upper surface of the floor portion of the bed body.

Furthermore, the nursing-care device of the third aspect is provided in the nursing-care device of the first or second aspect, wherein a suspension member is attached to the support rod such that the lifting member is slidable in a direction apart from the bed body, and the lifting member is able to be lifted/lowered according to lifting/lowering of the support rod after being moved to a predetermined position apart from the bed body by the suspension member.

Furthermore, the nursing-care device of the fourth aspect is provided in the nursing-care device of the third aspect, wherein a beam member is provided at the support rod, and the suspension member is attached to the beam member.

Furthermore, the nursing-care device of the fifth aspect is provided in the nursing-care device of any one of aspects 1 to 4, wherein a rod-shaped body is provided along a longitudinal direction of the bed body at an end portion of the support rod on a side opposite to the bed body.

Furthermore, the nursing-care device of the sixth aspect is provided in the nursing-care device of any one of aspects 1 to 5, wherein the lifting member is attached with the lifting member being supported at least at four points.

Furthermore, the nursing-care device of the seventh aspect is provided in the nursing-care device of any one of aspects 1 to 6, wherein an opening is formed at the floor portion, and a water tank is provided at the bed body.

Furthermore, the nursing-care device of the eighth aspect is provided in the nursing-care device of any one of aspects 1 to 7, wherein the support base is separatable from the bed body, and the support base and the bed body are able to be coupled to each other through a coupling mechanism.

Effects of Invention

According to the nursing-care device of the first aspect, at least the position of the lowermost portion of the lifting member can be moved to the predetermined position, and therefore, e.g., bathing by another medical/nursing-care device at a position lower than the floor portion, e.g., the water tank provided at the bed body, is facilitated and a nursing care is easily provided.

According to the nursing-care device of the second aspect, the lifting member can be lowered to below the upper surface of the floor portion of the bed body, and therefore, e.g., bathing by another medical/nursing-care device at the position lower than the floor portion, e.g., the water tank provided at the bed body, is facilitated and the nursing care is easily provided.

According to the nursing-care device of the third aspect, the lifting member can be move to the position apart from the bed body by the suspension member, and can be lowered to below the floor portion of the bed body. Thus, movement to another medical/nursing-care device at the position lower than the floor portion, such as the wheelchair, is facilitated and the nursing care is easily provided.

According to the nursing-care device of the fourth aspect, the beam member is provided at the support rod, and the suspension member is provided through the beam member. Thus, the suspension member is more easily attachable, and movement can be more stabilized.

According to the nursing-care device of the fifth aspect, the rod-shaped body is provided at the upper portion of the bed body, and therefore, a utilization method such as hanging of the lifting member or attachment of a moisture-proof cold-proof cover can be taken.

According to the nursing-care device of the sixth aspect, the lifting member is hung at four points such as four corners of the rectangular lifting member, and therefore, the care-requiring person can be more stably lifted.

According to the nursing-care device of the seventh aspect, the water tank is provided at the bed body, and therefore, the nursing-care device can be used as a bathtub.

According to the nursing-care device of the eighth aspect, the support base can be provided separately from the bed body, and therefore, a lifting/lowering mechanism can be provided at an existing bed.

BRIEF DESCRIPTION OF DRAWINGS

FIGS. 3A and 3B are views showing the sectional structure of the nursing-care bed of the first embodiment using a lifting/lowering unit, FIG. 3C is a block diagram, and FIG. 3D is a chart showing operation conditions etc.

FIGS. 14A to 14G are views showing the form of use of an overturn prevention mechanism and a slide cover.

FIGS. 16A and 16B are views showing the sectional structure of the nursing-care bed using another lifting/lowering unit, FIG. 16C is a block diagram, FIG. 16D is a chart showing operation conditions etc., and FIG. 16E is a view showing one example of use.

DESCRIPTION OF EMBODIMENTS

Hereinafter, a nursing-care device according to embodiments of the present invention will be described with reference to the drawings. Note that the embodiments described below are examples of the nursing-care device for embodying the technical idea of the present invention and are not intended to specify these examples as the present invention. The present invention can be equally applied to other embodiments included in the scope of the claims.

First Embodiment

Figure 1:
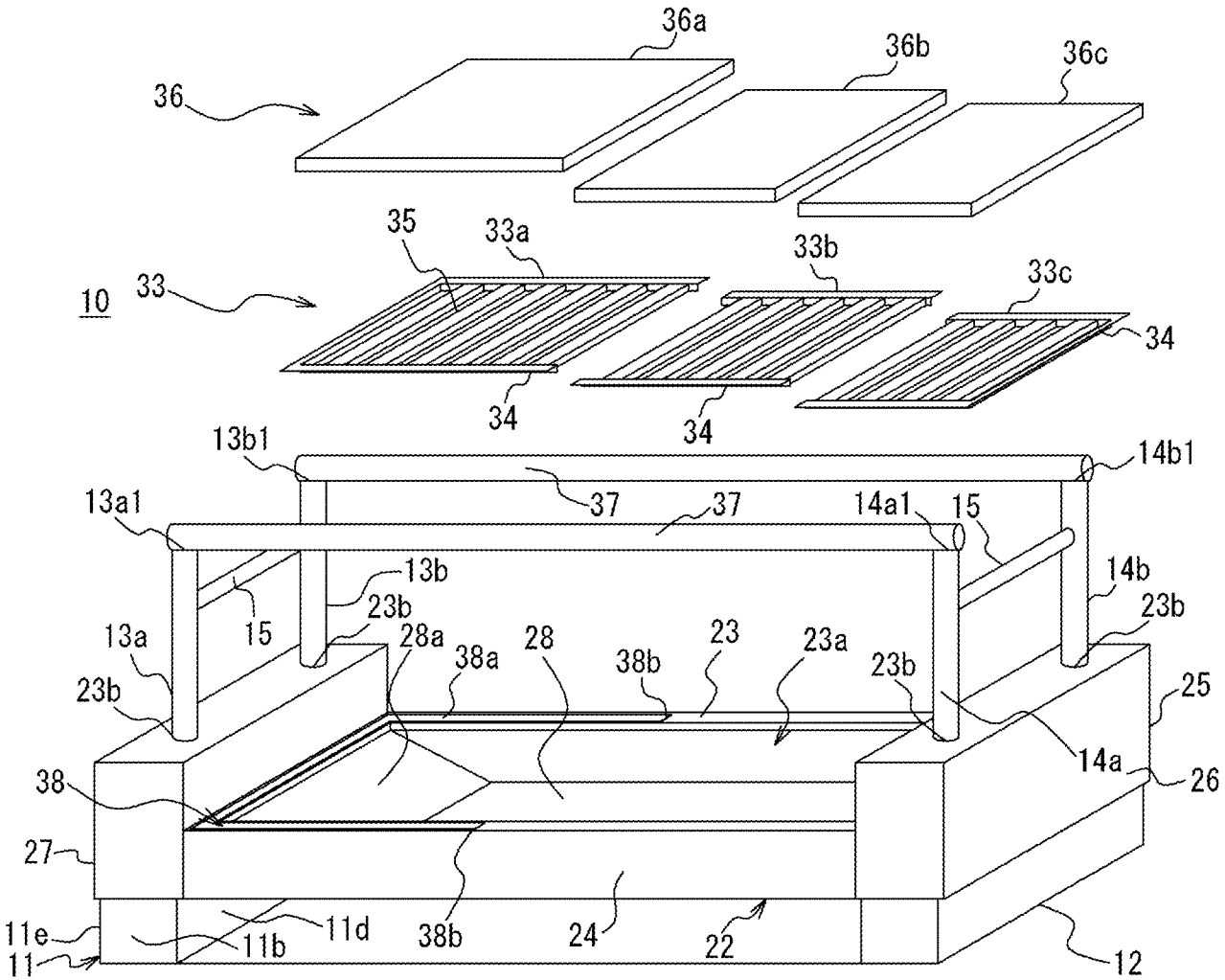
FIG. 1 is an exploded perspective view of a nursing-care bed according to a first embodiment.

A nursing-care bed 10 as a nursing-care device of a first embodiment will be described with reference to FIGS. 1 to 3. As shown in FIGS. 1 and 2, the nursing-care bed 10 of the first embodiment includes a bed body 22 on which a care-requiring person lies, and is configured such that at least one support base, e.g., a pair of support bases 11, 12 in the first embodiment, supporting the bed body 22 is arranged at both end portions of the bed body 22 in a longitudinal direction thereof. Moreover, the bed body 22 of the first embodiment is provided with a water tank 28, and further includes a grid-shaped frame 33 and a mat 36 to cover the water tank 28.

As shown in FIGS. 1 to 3, a bed actuator 104 as a bed-side lifting/lowering unit forming a lifting/lowering unit 16 configured to lift/lower the bed body 22 and a pantograph 106 to be operated by the bed actuator 104 are provided at the bed body 22 of the first embodiment, and details of these components will be described later. Note that the bed actuator 104 forming the lifting/lowering unit 16 includes a well-known electric actuator, but, e.g., a jack or winch mechanism can be used as long as the bed body 22 can be lifted/lowered. The jack or winch mechanism may be of an electric or manual type, and lifting/lower by a caregiver can be facilitated in the case of the electric type and manufacturing at a low cost can be achieved in the case of the manual type. The electric type and the manual type may be combined so that lifting/lowering can be manually performed when lifting/lowering cannot be electrically performed during blackout, for example. Note that the actuator and the jack or winch mechanism are well-known, and therefore, detailed description thereof will be omitted. Hereinafter, each configuration will be described.

Next, the pair of support bases 11, 12 will be described. Note that the pair of support bases 11, 12 is arranged at both ends of the bed body in the longitudinal direction thereof, and the support bases have a common configuration. Thus, one support base 11 (hereinafter merely referred to as a "support base") will be described as a representative.

As shown in FIGS. 1 to 3, the support base 11 has the substantially same length as that of the bed body 22 in a width direction perpendicular to the longitudinal direction, and is formed as a rectangular parallelepiped having a space where support rod actuators 100*a*, 100*b* (100*b* is not shown in the figure) as support-rod-side lifting/lowering units forming the lifting/lowering unit 16 configured to lift/lower support rods 13*a*, 13*b* are housed, as shown in FIG. 3. At a rectangular upper surface 11*a* of the rectangular parallelepiped, a pair of upper surface through-holes 11*a*1 is formed such that operation portions 102*a*, 102*b* (102*b* is not shown in the figure) to be actuated by the support rod actuators 100*a*, 100*b* coupled to the support rods 13*a*, 13*b* penetrate the upper surface through-holes 11*a*1 to move up and down (note that an operation portion 102*b* side is not shown in the figure). Note that in the first embodiment, the lifting/lowering unit 16 includes the bed-side lifting/lowering unit and the support-rod-side lifting/lowering units.

Side portions are formed at the periphery of the rectangular upper surface 11*a*, and a bottom surface 11*f* is provided on the lower side of each side portion facing the upper surface 11*a*. The bottom surface 11*f* is a portion to be placed on a floor surface in a room. Thus, some leg portions (casters) 17 (see FIG. 11) may be provided at portions of the bottom surface contacting the floor surface. With the leg portions, scratches on the floor surface can be reduced. With use of the movable casters, the nursing-care bed 10 can be easily moved.

The pair of support rods 13*a*, 13*b* each coupled to the operation portions 102*a*, 102*b* of the support rod actuators 100*a*, 100*b* provided in the support base 11 is, for example, formed as columns, and at upper portions of the pair of support rods in the opposing direction thereof, a beam member 15 is bridged between the pair of support rods 13*a*, 13*b* in parallel with the width direction of the bed body. Moreover, attachment portions 13*a*1, 13*b*1 to which rod-shaped bodies 37 are each attached are provided at upper ends of the pair of support rods 13*a*, 13*b*. Each of these rod-shaped bodies 37 is provided along the longitudinal direction of the bed body between an upper end portion of the support rod 13*a*, 13*b* of the support base 11 on one side and an upper end portion of a support rod 14*a*, 14*b* of the support base 12 on the other side. Note that the rod-shaped body 37 is not necessarily in a linear shape, but may be in a curved shape. The configuration of the rod-shaped body 37 will be described later in detail. Moreover, details of the support rod actuator provided inside the support base 11 and forming the lifting/lowering unit 16 will be also described later.

Note that this support rod can be attached/detached according to the form of use of the nursing-care bed 10. Further, antibacterial treatment is preferably performed for the support bases 11, 12, the support rods 13*a*, 13*b*, 14*a*, 14*b*, etc. By the antibacterial treatment, the support bases, the support rods, etc. can be held clean, and infection to the care-requiring person and smell from the support bases, the support rods, etc. can be reduced.

Next, the bed body 22 will be described with reference to FIGS. 1 to 3. The bed body 22 has a floor portion 23 formed in a rectangular shape with such predetermined area and thickness that the person can lie on the bed and having an upper surface on which the person can lie. An opening 23*a* is provided at a center portion of the floor portion 23. Further, floor portion through-holes 23*b* through which the support rods 13*a*, 13*b*, 14*a*, 14*b* provided on the above-described pair of support bases 11, 12 penetrate are, at the floor portion 23, provided corresponding to the support rods 13*a*, 13*b*, 14*a*, 14*b*. The grid-shaped frame 33 and the mat 36 are detachably provided at the opening 23*a* formed at the floor portion 23. Note that in the first embodiment, each end portion of the bed body 22 in the longitudinal direction thereof is in a protruding shape and each board portion including a head board and a foot board is formed at such an end portion. The floor portion through-holes 23*b* through which the support rods 13*a*, 13*b*, 14*a*, 14*b* penetrate are provided at these board portions.

Figure 23A:
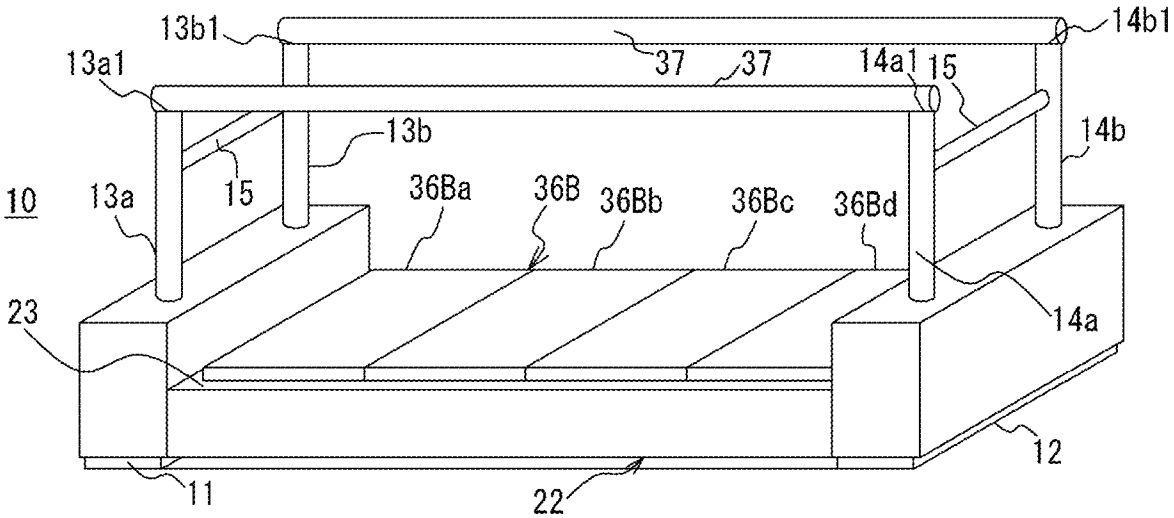
FIG. 23 shows a nursing-care device of a tenth variation, FIG. 23A being a perspective view, FIG. 23B being a side view, and FIG. 23C being a side view in a state in which a reclining mechanism is used.
Figure 23C:
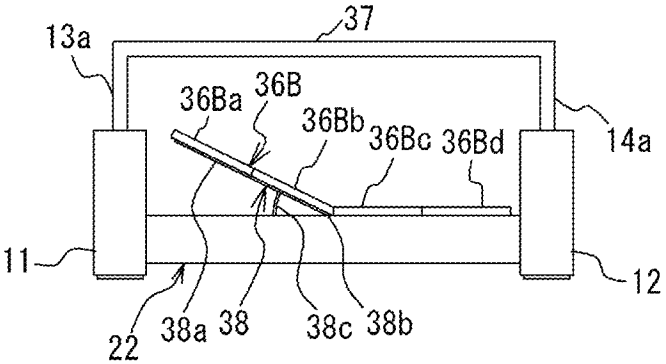

As shown in FIG. 1, a reclining mechanism 38 is provided at the periphery of the opening 23*a* of the floor portion 23 on a head board side. The reclining mechanism 38 has a frame 38*a* arranged in a substantially backwards C-shape, shaft portions 38*b* rotatably supporting end portions on the opposite side of the head board side, and shaft members 38*c* (see FIG. 23C) connected to a power portion (not shown in the figure) to press the frame 38*a*. It is configured such that when the shaft members 38*c* are moved by the power portion, the frame moves up and down in an arc about the shaft portions 38*b* at the end portions of the frame. In the reclining mechanism 38, part of the frame 33, e.g., a frame 33*a* in the first embodiment, placed on the reclining mechanism 38 and part of the mat 36, e.g., a mat 36*a* in the first embodiment, are moved up and down according to up-down movement of the frame 38*a* of the reclining mechanism 38.

On the sides of the rectangular floor portion 23, drooping side portions 24, 25, 26, 27 are provided to surround the floor portion 23, and are provided to cover the support bases 11, 12 on one and the other sides. The drooping lengths of the side portions 24 to 27 are such lengths that the entirety to the substantially half of each support base are covered when the bed body 22 is lowered and an upper portion of each support base is covered when the bed body 22 is lifted. Specifically, the side portions 24 to 27 have an advantageous effect that a favorable appearance of the nursing-care bed 10 is provided, and each of the support bases 11, 12 and the water tank 28 are covered with the side portions 24 to 27. Various decorations not interfering with the care-requiring person and the caregiver may be added, and may have an aesthetic shape. Note that the antibacterial treatment is preferably performed for the bed body 22. By the antibacterial treatment, the bed body can be held clean, and infection to the care-requiring person and smell from the bed body can be reduced.

Note that the bed body 22 and the support bases 11, 12 are configured as separate bodies, and therefore, repairment or replacement can be performed for each component of the bed body 22 and the support bases 11, 12 and manufacturing and repairment costs are reduced without the need for repairing or replacing the entirety of the nursing-care bed. Moreover, the pair of support bases 11, 12 having the same configuration is used, and therefore, the manufacturing cost can be reduced.

As shown in FIG. 1, the water tank 28 is provided at the floor portion 23, so that the water tank 28 can be used as a simple bathtub with the lifting/lowering unit. Further, the frame 33 on which the mat 36 is placed is detachable from the water tank 28 or the floor portion 23, so that the nursing-care bed 10 can be also used as a nursing-care bed provided with a simple bathtub.

Figure 2A:
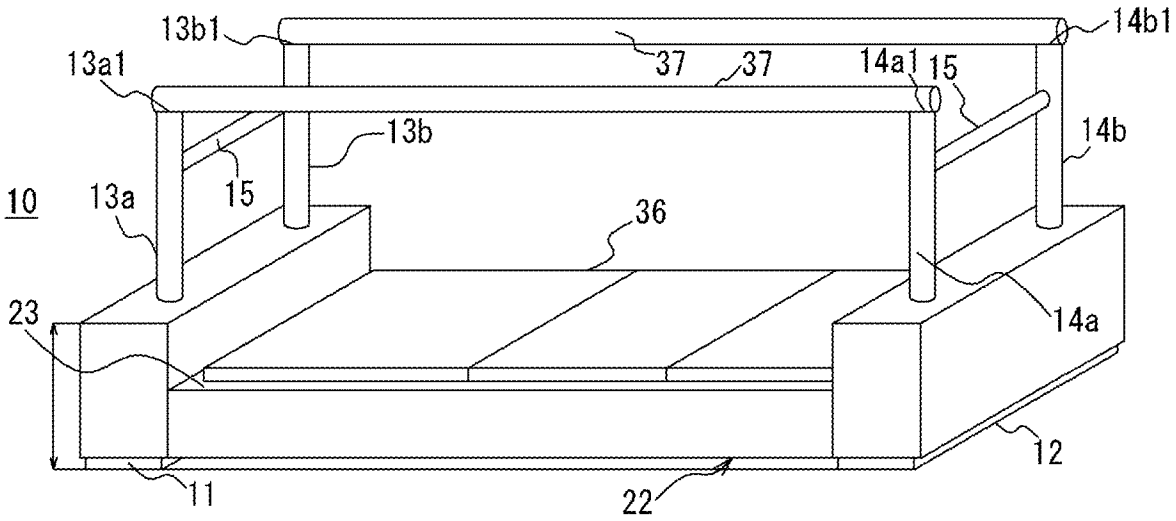
FIG. 2A is a perspective view showing the form of use of the nursing-care bed according to the first embodiment.
Figure 2B:
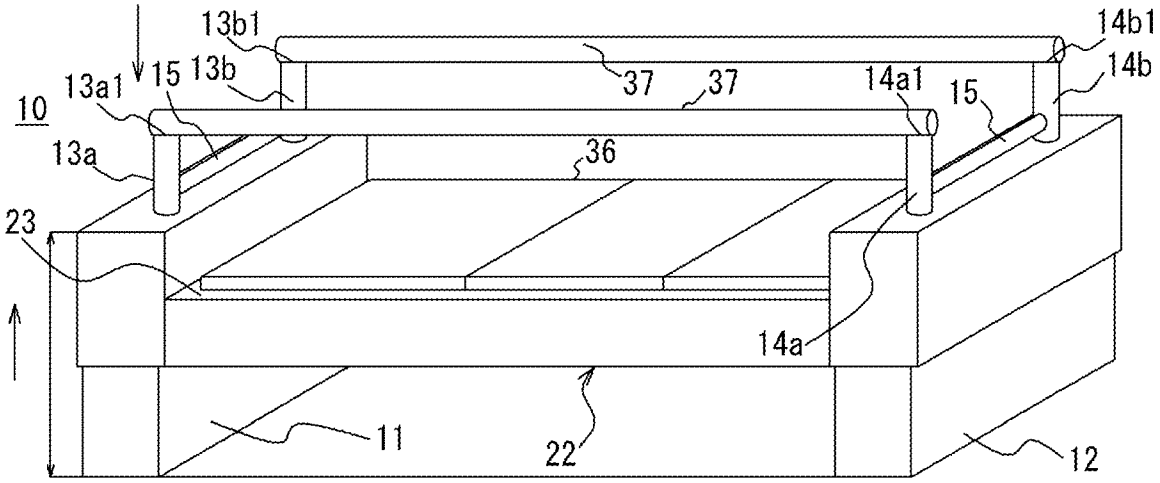
FIG. 2B is a perspective view showing another form of use.

Next, the form of use of the nursing-care bed of the first embodiment will be described. The nursing-care bed 10 of the first embodiment shown in FIG. 2 is in a state when the care-requiring person lies on the bed. That is, in the bed body 22 provided on each of the support bases 11, 12, the entirety of the opening 23*a* of the floor portion 23 is covered with the frame 33 and the mat 36. In this state, as shown in FIGS. 2A and 2B, the lifting/lowering unit 16 can be operated to change the height of the bed body 22 to such a height that the caregiver can easily provide a care to the care-requiring person. For example, the height of the bed body 22 may be lowered as shown in FIG. 2A when the care-requiring person lies on the bed or when the care-requiring person moves between the nursing-care bed and another type of medical/nursing-care equipment arranged at the side of the bed, such as a wheelchair, a stretcher, or a simple bathtub. When the care-requiring person lies on the bed, a fall prevention fence (not shown in the figure) may be provided at the bed body. Note that the form of use of each of the support rod actuators 100*a*, 100*b*, 101*a*, 101*b* provided as the lifting/lowering unit 16 inside the pair of support bases 11, 12 will be described later.

As shown in FIG. 1, the mat 36 provided on the bed body 22 is divided, and therefore, replacement with mats having different materials or textures is allowed in units of divided mats according to a care-requiring person's preference. For example, mats having different restitution coefficients, mats exhibiting favorable air permeability, mats exhibiting waterproof properties, and mats corresponding to disease sites can be selected. Moreover, the mat 36 is divided, so that washing/drying can be facilitated. With this configuration, favorable influence can be provided not only to the comfortability of the care-requiring person on the bed but also to the easiness of a nursing care provided by the caregiver. Note that the antibacterial treatment is preferably performed for the mat 36. By the antibacterial treatment, the mat can be held clean, and infection to the care-requiring person and smell from the mat can be reduced.

Lifting/lowering of the bed body 22 of the nursing-care bed 10 and lifting/lowering of each of the support rods 13*a*, 13*b*, 14*a*, 14*b* by the lifting/lowering unit 16 of the first embodiment will be described with reference to FIGS. 3A to 3D. Note that FIGS. 3A and 3B only show a support rod 13*a*, 14*a* side because description will be made in a state viewed from the 13*a*, 14*a* side. However, a similar configuration is also provided on an opposing 13*b*, 14*b* side. In the nursing-care bed 10 of the first embodiment, the support rod 13*a*, 14*a* and the support rod actuator 100*a*, 101*a* are provided at each of the support bases 11, 12 in a pair. A tip end of the operation portion 102*a*, 103*a* of the support rod actuator 100*a*, 101*a* is joined to the support rod 13*a*, 14*a*, and therefore, the support rod 13*a*, 14*a* can be lifted/lowered by extension/contraction of the operation portion 102*a*, 103*a*.

Note that the support rod actuators 100*b*, 101*b* corresponding to the support rod actuators 100*a*, 101*a* are provided on the not-shown support rod 13*b*, 14*b* side. A tip end of the operation portion 102*b*, 103*b* of the support rod actuator 100*b*, 101*b* is joined to the support rod 13*b*, 14*b*, and therefore, the support rod 13*b*, 14*b* can be lifted/lowered by extension/contraction of the operation portion 102*b*, 103*b*. Thus, in the first embodiment, four support rod actuators are used.

The bed actuator 104 is provided at a lower portion of the bed body 22, and a tip end of an operation portion 105 of the bed actuator 104 and a bottom surface of the bed actuator 104 are joined to both ends 107 of the pantograph 106 in the horizontal direction. Ends 108 of the pantograph 106 in the vertical direction are joined to the bed body 22 and a floor plate 109 joined to the support bases 11, 12 or the support rod actuators 100*a*, 101*a*. By extension/contraction of the operation portion 105, the pantograph 106 can be extended/contracted to lift/lower the bed body 22. Note that the lifting/lowering unit 16 of the first embodiment includes at least the support rod actuators and the bed actuator.

As shown in FIG. 3C, the support rod actuators 100*a*, 100*b*, 101*a*, 101*b* and the bed actuator 104 are electrically connected to a control section 110 through a cable or wirelessly, and a lifting/lowering switch 111 is electrically connected to the control section 110 through a cable or wirelessly. The control section 110 converts a command from the lifting/lowering switch 111 into operation of the support rod actuators 100*a*, 100*b*, 101*a*, 101*b* and the bed actuator 104.

Operation conditions as in a timing chart shown in FIG. 3D are set to the control section 110 by, e.g., an electric circuit or software, so that control can be made such that the support rods 13*a*, 13*b*, 14*a*, 14*b* are lowered when the bed body 22 is lifted and are lifted when the bed body 22 is lowered.

Regarding these operation conditions, the support rod actuators 100*a*, 101*a* and the bed actuator 104 are not necessarily fully synchronized with each other, and the lifting/lowering switch 111 may be placed at each of the support rod actuators 100*a*, 100*b*, 101*a*, 101*b* and the bed actuator 104 to separately operate these actuators.

With this configuration, the support rods 13*a*, 13*b*, 14*a*, and 14*b* are lowered when the bed body 22 is lifted. Conversely, the support rods 13*a*, 13*b*, 14*a*, and 14*b* are lifted when the bed body 22 is lowered. Note that the lifting/lowering unit 16 may have a configuration other than the combination of the actuator and the winch. Moreover, the lifting/lowering unit 16 is not limited to the electric configuration as in the first embodiment, and a mechanical configuration such as a link mechanism may be used. Note that the structures of the actuator and the winch are well-known, and therefore, detailed description thereof will be omitted.

The bed body 22 can be lifted/lower in parallel by the bed actuator 104 of the lifting/lowering unit 16. Moreover, the support rods 13*a*, 13*b*, 14*a*, 14*b* can be also lifted/lowered in parallel by the support rod actuators 100*a*, 100*b*, 101*a*, 101*b*. Thus, the rod-shaped bodies 37 attached to the upper ends of the support rods can be also lifted/lowered in parallel. Thus, the care-requiring person on a hammock as a later-described lifting member attached to the rod-shaped bodies 37 for lifting the care-requiring person can be also stably safely lifted/lowered.

In a case where the bed body 22 is lifted and each of the support rods 13*a*, 13*b*, 14*a*, 14*b* is lowered by the lifting/lowering unit 16 of the first embodiment, at least the lowermost portion of the hammock is moved to below the floor portion 23 (e.g., a surface on which the care-requiring person can lie, also referred to as below the mat) at an upper surface of the bed body 22 in a later-described hammock hanging state. In this state, in a case where the care-requiring person is on the hammock, e.g., the buttocks of the care-requiring person at the lowermost portion of the hammock are lowered to below the floor portion 23 of the bed body 22. Note that part or the entirety of the hammock may be moved to below the floor portion 23 of the bed body 22.

Figure 4A:
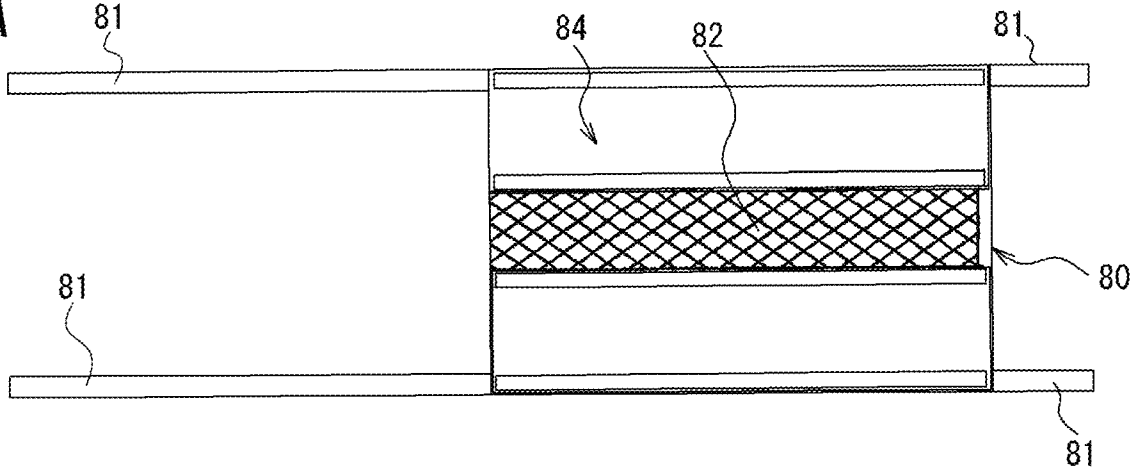
FIG. 4A is a plan view showing one example of a hammock.

Next, one example of the hammock 80 of the first embodiment as the lifting member for lifting the care-requiring person will be described with reference to FIGS. 4A and 4B. Note that FIG. 4A is a plan view showing one example of the hammock, and FIG. 4B is a schematic side view showing the state of use of the hammock shown in FIG. 4A.

The hammock 80 of the first embodiment can be, for lifting the care-requiring person, formed with a length exceeding the height of the care-requiring person, for example. Moreover, a material with such resistance that the care-requiring person can be lifted, such as a woven nylon or glass fiber material, can be used. As shown in FIG. 4A, belt bodies 81 longer than the length of the hammock 80 are provided at both end portions of the hammock 80 along a longitudinal direction thereof. Moreover, a net 82 on which a care-requiring person P lies and slide members 84 are provided with a length which is the substantially half of the length of the hammock 80. For example, as shown in FIG. 4*b*, the belt bodies 81 are fixed to the beam members 15 (see FIGS. 1 and 2, not shown in FIG. 4B) attached between the support rods 13*a*, 13*b*, 14*a* and 14*b* of the support bases 11, 12 (13*b*, 14*b* are not shown in the figure).

With this configuration, each of the support rods 13*a*, 13*b*, 14*a*, 14*b* etc. is, in the case of lifting the hammock 80, lifted by lowering of the bed body 22, and accordingly, the beam members 15 attached to the support rods 13*a*, 13*b*, 14*a*, 14*b* are also lifted. In this manner, the hammock 80 can be lifted.

Figure 4B:
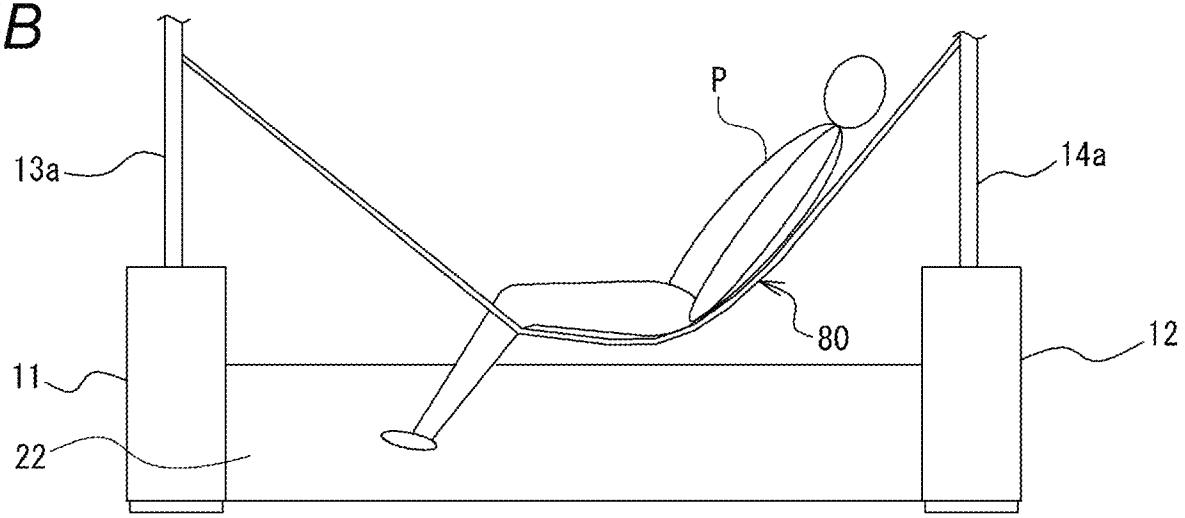
FIG. 4B is a schematic side view showing the state of use of the hammock shown in FIG. 4A.

Thus, the care-requiring person P can be lifted in a seated state as shown in FIG. 4B, and the feeling of insecurity of the care-requiring person P can be reduced as compared to the case of lifting the care-requiring person P in a lying state. Moreover, the hammock 80 of the first embodiment is supported at four points, and therefore, the care-requiring person can be lifted in a more stable state.

Similar steps are also taken for lowering the hammock 80. That is, the beam members 15 attached to the support rods 13*a*, 13*b*, 14*a*, 14*b* are lowered in association with lifting of the bed body 22, and accordingly, the belt bodies 81 attached through the beam members 15 are lowered. Thus, the hammock 80 can be lowered. Moreover, the hammock 80 of the first embodiment is supported at the four points, so that the care-requiring person can be stably lowered.

Thus, the care-requiring person can be easily lifted from the mat by means of the lifting member and the lifting/lowering unit of the nursing-care bed of the first embodiment. The mat, a sheet on the mat, etc. can be easily replaced, and therefore, the bed can be held clean. Moreover, the casters etc. are attached to the floor surfaces of the support bases 11, 12, so that the bed can be easily moved.

As the support rod, a single long member may be provided, or a member dividable in two may be provided. For example, a portion exposed from the bed body and a portion to be driven inside the support base may be detachably provided, and the portion exposed from the bed body may be attached/detached as necessary. With this configuration, the portion exposed from the bed body can be detached in the case of a form in which no support rod is used, and therefore, the caregiver can easily provide a care. Moreover, the support rod can be attached later, and therefore, other functions can be easily added.

[First Variation of Hammock]

Note that in the case of providing the belt bodies 81 at the hammock 80, there are probabilities that end portions of the belt bodies 81 are swing around in, e.g., the process of attaching/detaching the hammock 80 and contact and hurt the care-requiring person or the caregiver and that the belt bodies 81 are damaged due to contact with an object etc. because the belt bodies 81 are long. Moreover, the end portions of the belt bodies 81 need to be reliably attached to the bed body 22, and for obtaining strength, are made of, e.g., metal. This leads to the noticeable probability of an injury and damage. For this reason, the belt bodies provided at the hammock are preferably shortened as much as possible.

Figure 5B:
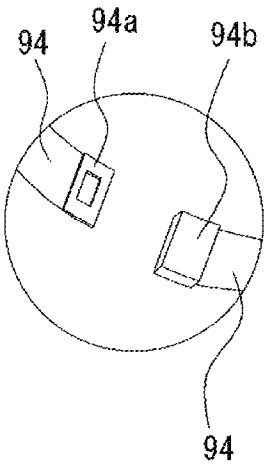
FIG. 5B is an enlarged view of a VB portion of FIG. 4A.
Figure 5A:
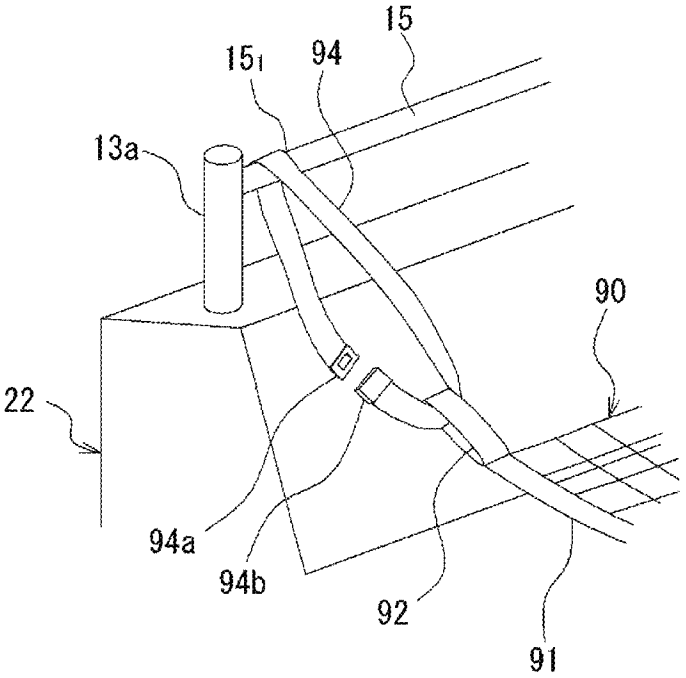
FIG. 5A is a perspective view showing the state of fixing of a belt body of another hammock.

In a hammock 90 shown in FIG. 5A, a belt body 91 as a lifting belt body provided at the hammock 90 is shortened, no metal joint portion is provided at an end portion of the belt body 91, and the end portion of the belt body 91 is formed in a round annular shape to form an annular portion 92. Moreover, an attachment belt body 94 formed as a member separated from the hammock 90 is provided. The attachment belt body 94 is, at one and the other ends thereof, provided with detachable metal connection portions 94*a*, 94*b* for joining these ends to each other, and upon use, these connection portions 94*a*, 94*b* are connected to each other to form a loop shape.

The attachment belt body 94 is wound around an attachment portion $\mathbf{15}_1$ of the beam member 15 to form an annular ring. Note that a structure for adjusting the length of the belt body 94 to be used can be provided at the attachment belt body 94. Such adjustment may be performed using the connection portions 94*a*, 94*b*, or, e.g., a buckle may be provided at the attachment belt body 94.

Note that these connection portions 94*a*, 94*b* are made of, e.g., metal. With this configuration, the belt body 91 provided at the hammock 90 can be shortened, and no metal member is provided at the belt body 91. Thus, safety can be enhanced. The connection portions 94*a*, 94*b* are detachable with one touch, and therefore, can be easily attached/detached. Note that as the connection portions 94*a*, 94*b*, commercially-available products can be used.

The case of using the hammock as the lifting member has been described above, but the present invention is not limited to such a case and the sheet on the mat can be also used as the lifting member. In this case, a structure is employed, in which belt bodies such as those used for the above-described hammock are provided at both end portions of the sheet in a longitudinal direction thereof and are connectable to, e.g., the support rods or the bed body. These configurations are common to the belt bodies used for the above-described hammock. With this configuration, the sheet used by the care-requiring person can be used for lifting, and therefore, the process of providing under the hammock the care-requiring person as described above can be omitted. Note that the sheet needs to have a material and a structure which can support the weight of the care-requiring person upon lifting.

[Safety Device]

Figure 6:
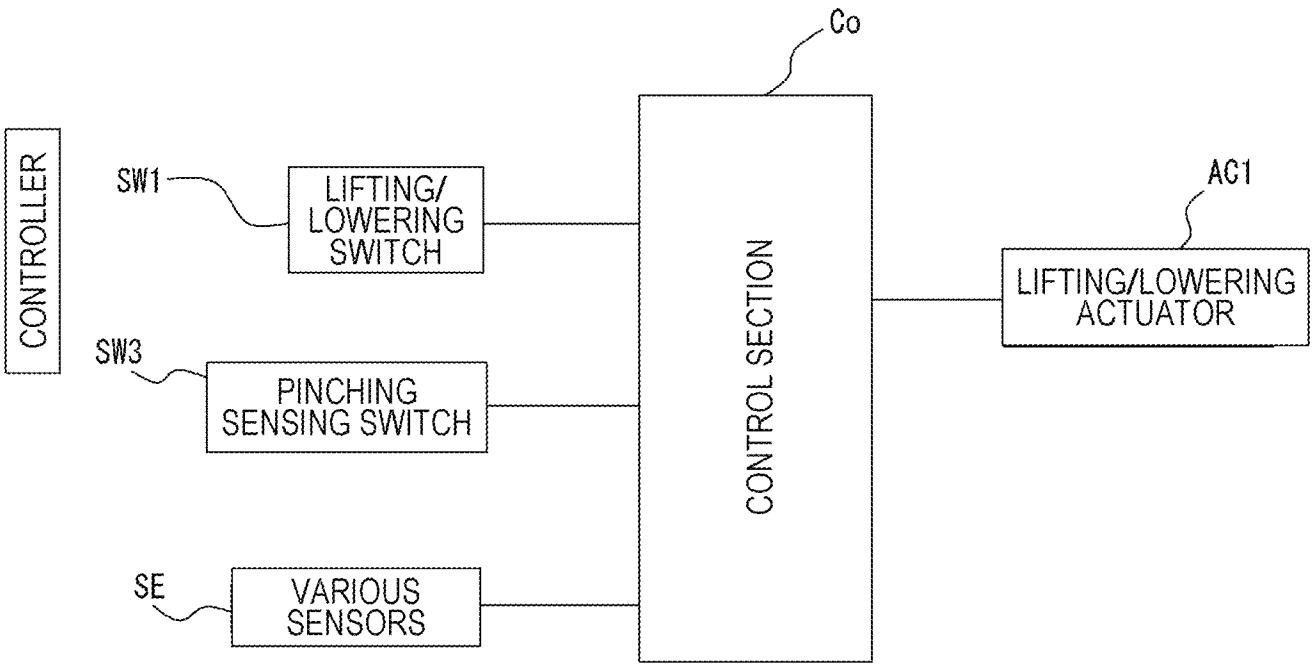
FIG. 6 is a block diagram of a safety device.

In the nursing-care bed 10 of the first embodiment, the actuators are used to lift/lower the bed body 22 and perform other types of operation. Thus, these actuators need to be controlled to safely use the nursing-care bed. For this reason, a control section configured to control operation of these actuators is provided at the nursing-care bed. Hereinafter, a safety device of the nursing-care bed will be described with reference to a block diagram of FIG. 6.

Each actuator included in the nursing-care bed is basically operated in such a manner that the caregiver presses various switches, e.g., a lifting/lowering switch SW1, of a controller at hand. Note that in FIG. 6, lifting/lowering actuators (e.g., the bed actuator 104 and the support rod actuators 100*a*, 100*b*, 101*a*, 101*b* shown in FIG. 3) are shown as AC1. In this case, operation of each actuator AC1 is, by the control section Co, controlled to be performed only while the various switch of the controller is being pressed, and is controlled to be promptly stopped when the switch is no longer pressed. That is, operation is not automatically performed, and is not inertially performed either.

For enhancing the safety in lifting/lowering of the bed body, a mechanism configured to hold the state of lifting/lowering of the bed body when a power source is turned off due to blackout or a plug being pulled out of an outlet is employed. As this holding mechanism, a gear brake mechanism such as a worm gear or a mechanism such as a hydraulic or pneumatic cylinder can be provided. With this configuration, the state of lifting/lowering of the bed body can be held even when actuation of the actuators is stopped, and therefore, sudden operation of the bed body can be reduced even when a power supply from the power source is stopped. Thus, the safety can be enhanced. Note that these mechanisms may be incorporated into the actuator as the lifting/lowering unit in the support base and a transmission mechanism connected to such an actuator, or may be attached as other mechanisms.

Further, the actuators AC1 cooperate with various sensors SE provided at the nursing-care bed. In this case, a sensor, a switch, etc. configured to sense the presence or absence of the frame can be provided at a lower portion of the frame or the floor portion of the bed body.

Similarly, when pinching is sensed upon lowering of the bed body, the actuators AC1 can be stopped. In this case, various sensors SE and various switches SW3 similar to those described above are provided on the lower side of side surfaces of the bed body, so that pinching can be sensed.

Further, in the case of a configuration in which long support rods are utilized or lifting/lowering of the bed body by the lifting/lowering unit is not in conjunction with the support rods, an aseismic member, e.g., an extendable rod-shaped member which can be fixed with a predetermined length, is provided among the long support rods, the rod-shaped bodies, and a ceiling so that earthquake countermeasures such as prevention of swing upon a disaster such as an earthquake can be taken.

[Second Variation of Hammock]

Figure 7A:
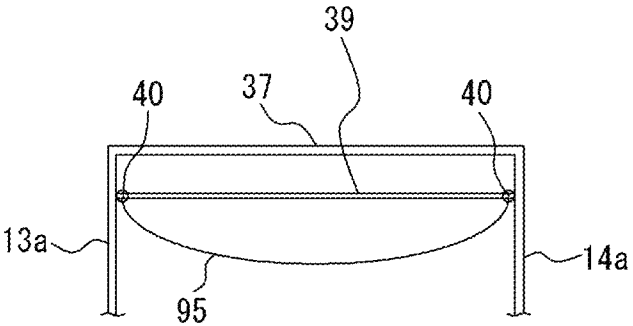
FIG. 7 is a view showing a second variation of the hammock, FIGS. 7A and 7B being views showing the form of use of a lifting member rail and FIGS. 7C and 7D being views showing the form of use of a lifting member attachment portion.
Figure 7B:
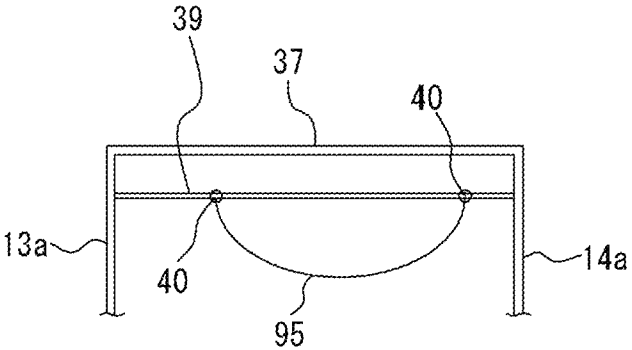

Note that as the method for hanging the hammock as a hanging member, lifting member rails 39 are attached to between the support rod 13*a* and the support rod 14*a* and between the support rod 13*b* and the support rod 14*b* as shown in FIG. 7A, in addition to the method described in the first embodiment. With this configuration, the lifting member rails 39 can be hung through movable portions 40. With use of the lifting member rails 39 as described above, the hanging shape and angle of a hammock 95 can be changed by movement of end surfaces of the hammock 95 as shown in FIG. 7B.

Figure 7C:
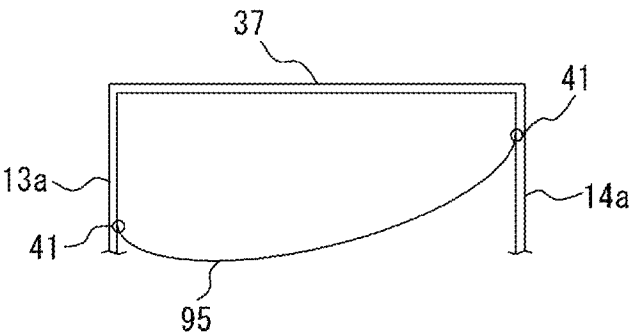

Further, regarding the hanging position of the hammock 95, the height of a lifting member attachment portion 41 can be made different between the support rod 13*a*, 13*b* and the support rod 14*a*, 14*b* as shown in FIG. 7C.

Figure 7D:
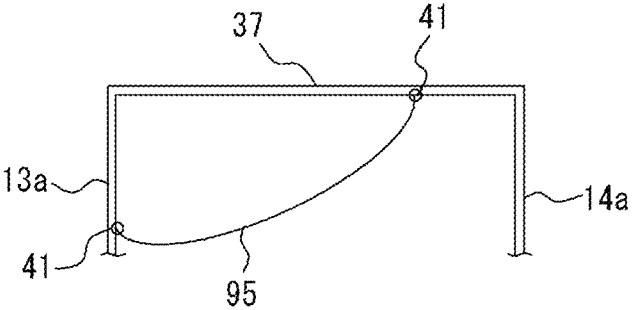

Regarding the hanging position of the hammock 95, the lifting member attachment portion 41 can be also provided at the rod-shaped body 37 as shown in FIG. 7D. Note that FIG. 7 shows the case of using the hammock 95, but a similar configuration can be also used for other hammocks.

Note that the nursing-care bed is placed in a room at, e.g., a home or a nursing-care facility, and for this reason, it is difficult to carry the large-size nursing-care bed as it is into the room. Thus, it is configured such that the components of the nursing-care bed can be easily assembled in the room.

Many functions according to not only a general state of use as a bed but also the above-described nursing-care situation of the care-requiring person can be added to the nursing-care bed of the first embodiment, and change or addition can be easily made to each configuration.

Moreover, in the first embodiment, the case where the hammock 90 is attached to the beam members 15 through the belt bodies 94 has been described, but the present invention is not limited to such a case and the belt bodies included in the hammock may be directly attached to the beam members.

[Third Variation of Hammock]

Figure 8A:
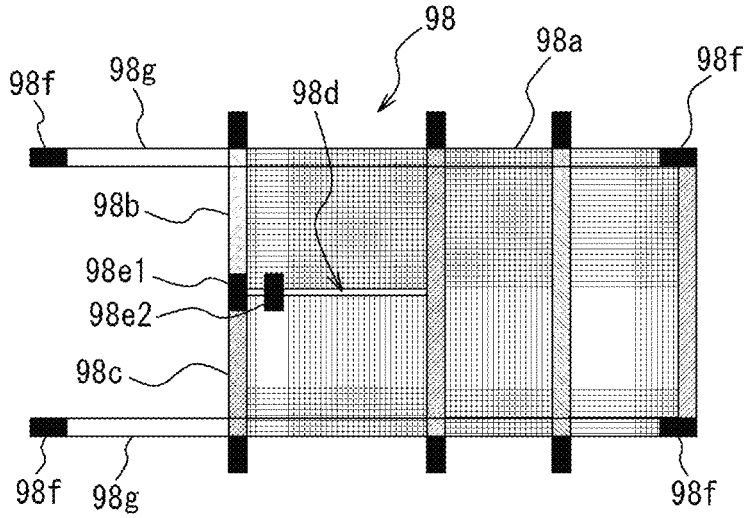
FIGS. 8A and 8B are plan views showing a third variation of the hammock.

In addition to the hammock 80 described in the first embodiment, a hammock 98 as shown in FIG. 8A can be also used. The hammock 98 shown in FIG. 8A is, for example, configured such that movement from the wheelchair to the bed body 22 is facilitated.

The hammock 98 has, for example, a net-shaped planar portion 98*a* having a predetermined area and a slit 98*d* formed at a center portion thereof, and has two net-shaped divided planar portions 98*b*, 98*c* having predetermined areas. In this case, regarding the form of use of the hammock 98, the planar portion 98*a* is a portion on which an area of the care-requiring person from the back to the head is to be placed, and the divided planar portions 98*b*, 98*c* are arranged such that an area of the care-requiring person from the buttocks to the thighs is placed on the divided planar portions 98*b*, 98*c*.

At the slit 98*d* at portions of the divided planar portions 98*b*, 98*c* on the opposite side of the planar portion 98*a*, at least one buckle, e.g., two buckles 98*e*1, 98*e*2 in the hammock 98, is provided. Each of the buckles 98*e*1, 98*e*2 is detachable by predetermined operation. It is configured such that the divided planar portions 98*b*, 98*c* are detachable from each other by each of the buckles 98*e*1, 98*e*2.

Moreover, ring portions 98*f* are provided at four corners of the hammock 98, and for example, the hammock 98 is attached to, e.g., the beam members 15 of the nursing-care bed 10 by means of separated belt bodies. Note that extending belt portions 98*g* are provided on a divided planar portion 98*b*, 98*c* side at the hammock 98.

Figure 8B:
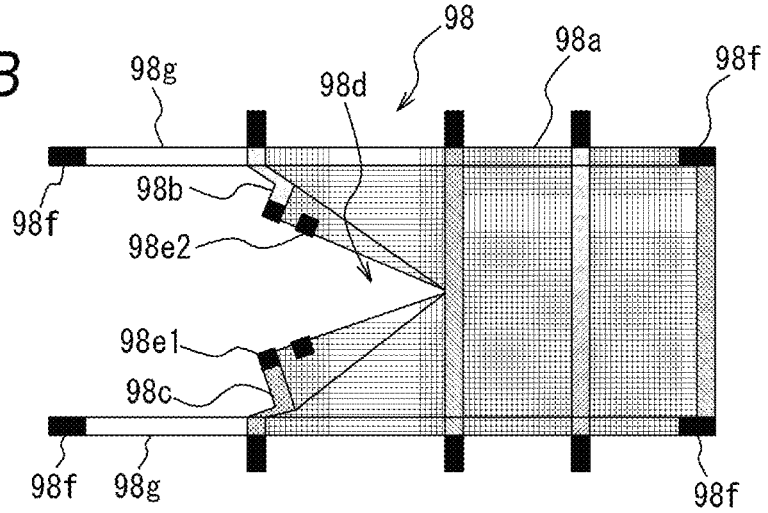

Upon use of the hammock 98, suspension members 250 are first moved in a lateral direction from a bed body 22 side and are arranged at the position of the wheelchair as described above. Thereafter, as shown in FIG. 8B, each of the buckles 98*e*1, 98*e*2 of the hammock 98 is detached to open the divided planar portion 98*b* and the divided planar portion 98*c*, and the planar portion 98*a* is inserted into between the back of the care-requiring person on the wheelchair and a backrest of the wheelchair.

Next, each of the buckles 98*e*1, 98*e*2 of the divided planar portions 98*b*, 98*c* is attached and fixed (see FIG. 8A). Then, the hammock 98 is lifted by movement of the bed body 22 and each of the support rods 13*a*, 13*b*, 14*a*, 14*b* as described above, and in this manner, the care-requiring person can be lifted from the wheelchair.

At this point, the buckles 98*e*1, 98*e*2 of the divided planar portions 98*b*, 98*c* are attached, and therefore, the thighs of the care-requiring person are covered, for example. Thus, the care-requiring person can be reliably lifted. Moreover, upon lifting, the divided planar portions 98*b*, 98*c* also cover the buttocks of the care-requiring person, and therefore, the care-requiring person can be lifted in a more stable state. Then, as described above, after the suspension members 250 have been moved to above the bed body 22, the lowering is performed onto the bed body 22. In this manner, movement of the care-requiring person from the wheelchair to the bed body 22 ends.

Note that in the hammock 98, the divided planar portions 98*b*, 98*c* are, at the slit 98*d*, connected to each other by the two buckles 98*e*1, 98*e*2 and these two buckles 98*e*1, 98*e*2 are detachable to open/close the divided planar portions 98*b*, 98*c*. However, the present invention is not limited to such a configuration, and a portion at the slit 98*d* may be connected with, e.g., a zipper and may be opened/closed with, e.g., the zipper or a velcro tape (a registered trademark).

Figure 8C:
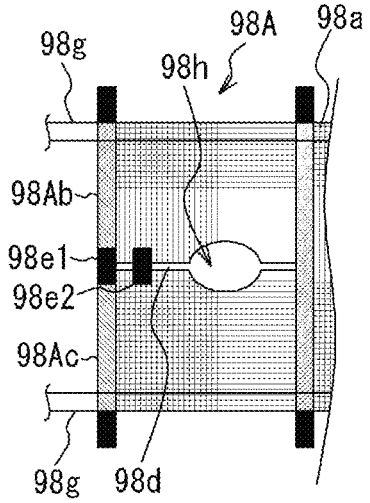
FIGS. 8C to 8E are plan views showing still another variation.

As in a hammock 98A shown in FIG. 8C, a hole 98*h* may be provided at a portion on which the buttocks of the care-requiring person are to be supported. With this configuration, excretion of the care-requiring person on the hammock 98A can be easily handled. Note that in FIG. 8C, the hole 98*h* is formed together with the slit 98*d*. The case of providing the hole 98*h* as in the hammock 98A is not limited to the case of division into divided planar portions 98Ab, 98Ac. The hole 98*h* may be provided at a portion as a single planar portion with no slit 98*d*, i.e., without division into the divided planar portions 98*b*, 98*c*.

Figure 8D:
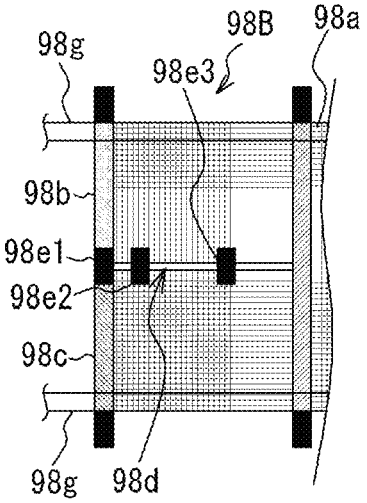

As in a hammock 98B shown in FIG. 8D, a buckle 98*e*3 may be newly provided at the slit 98*d*. With this configuration, the buckle 98*e*3 is connected after the care-requiring person has been lifted as in the above-described third variation, and in this manner, the care-requiring person can be more stably lifted.

Figure 8E:
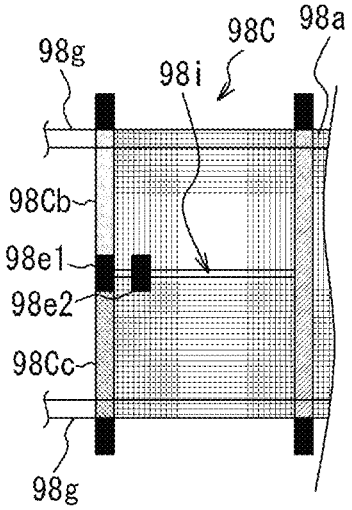

As in a hammock 98C shown in FIG. 8E, an overlapping portion 98*i* at which division-side portions of divided planar portions 98Cb, 98Cc overlap with each other may be provided. With this configuration, the care-requiring person can be more stably lifted.

[First Variation]

In the first embodiment, lifting/lowering movement of each of the support rods 13*a*, 13*b*, 14*a*, 14*b* is in conjunction with each of the support rod actuators 100*a*, 100*b*, 100*a*, 100*b*, but the present invention is not limited to such a configuration. Each of the support rod actuators 100*a*, 100*b*, 101*a*, 101*b* may be separately operated for lifting/lowering. That is, only the support rods 13*a*, 14*a* can be lifted by the support rod actuators 100*a*, 101*a*, or only the support rods 13*b*, 14 can be lifted by the support rod actuators 100*b*, 101*b*. With this configuration, roll-over of the care-requiring person P lying on the floor portion 23 of the bed body 22 on which the hammock 95 is placed as shown in a nursing-care device 10A of a first variation of FIGS. 9A to 9C can be supported and bedsores of the care-requiring person P can be reduced.

Figure 9A:
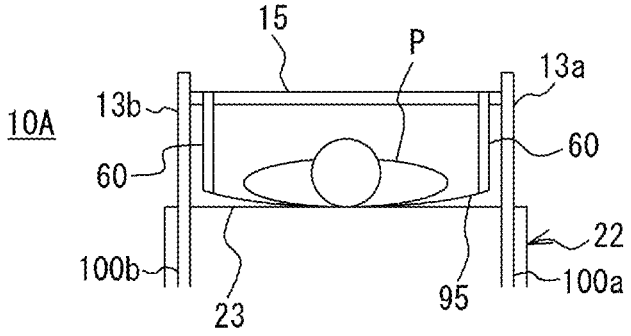
FIGS. 9A to 9C are views for describing a case for roll-over by means of a nursing-care device of a first variation.
Figure 9B:
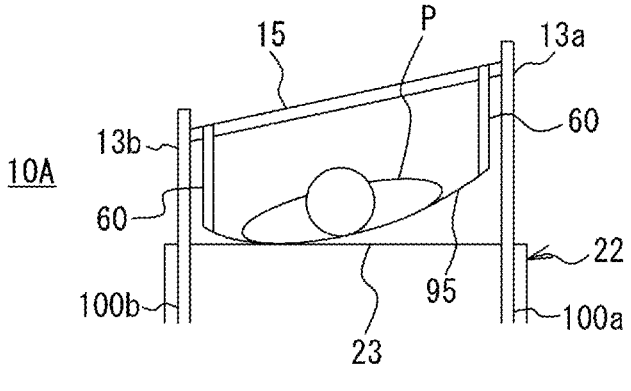

That is, only the support rod 13*a*, 14*a* side (the support rod 14*a* is not shown in the figure) is lifted from the state shown in FIG. 9A by the support rod actuators 100*a*, 101*a* (the support rod actuator 101*a* is not shown in the figure) as shown in FIG. 9B. Accordingly, the beam members 15 on which the hammock 95 is hung through belt bodies 60 are lifted inclined, and one side of the hammock 95, on which the care-requiring person P lies, in a longitudinal direction thereof is lifted. Thus, the care-requiring person P can be inclined on the floor portion 23, and can roll over.

Figure 9C:
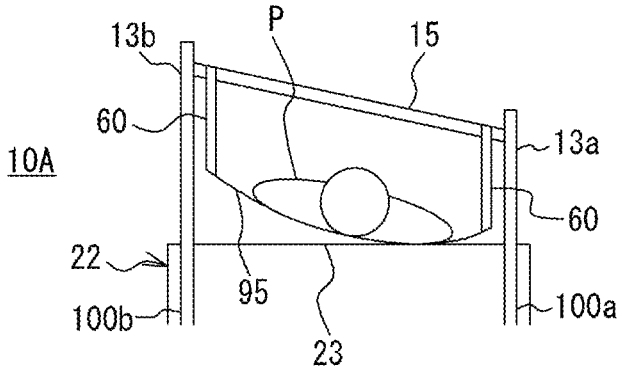

For inclining the opposite side, only the support rods 13*b*, 14*b* (the support rod 14*b* is not shown in the figure) are lifted by the support rod actuators 100*b*, 101*b* (the support rod actuator 101*b* is not shown in the figure) as shown in FIG. 9C, and in this manner, the opposite side can be inclined.

Note that the position of attachment of each belt body 60 of the hammock 95 to the beam member 15 can be an optional position. Further, the belt body 60 may be attached to each of the support rods 13*a*, 13*b*, 14*a*, 14*b*.

[Second Variation]

Figure 10A:
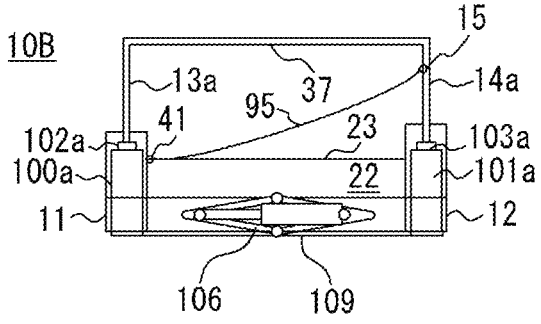
FIGS. 10A to 10C are views showing a case where the lifting member attachment portion of the second variation is used for a bed body.
Figure 10B:
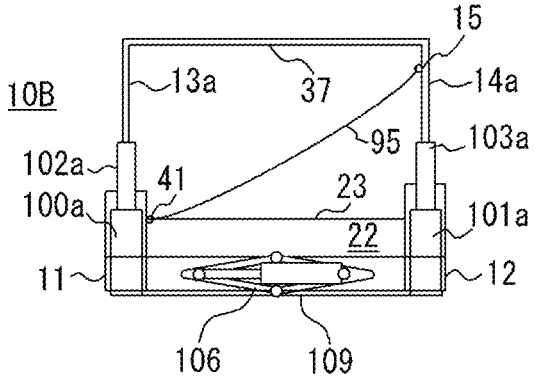

As in a nursing-care device 10B of a second variation shown in FIG. 10, only the support rods 13*a*, 13*b* on a support base 11 side can be lifted/lowered, or conversely, only the support rods 14*a*, 14*b* on a support base 12 side can be lifted/lowered. In this case, the way to hang the hammock 95 is changed. For example, as shown in FIG. 10A, one side of the hammock 95 is hung on the beam member 15 through the belt bodies 60, and the other side of the hammock 95 is attached to the lifting member attachment portions 41 of the floor portion 23 of the bed body 22. In this manner, the hammock 95 is attached in an inclined state. The support rods on the side on which the hammock 95 is attached to the beam member 15, e.g., a support rod 14*a*, 14*b* side, are lifted, and therefore, the angle of the hammock 95 can be changed as shown in FIG. 10B.

Figure 10C:
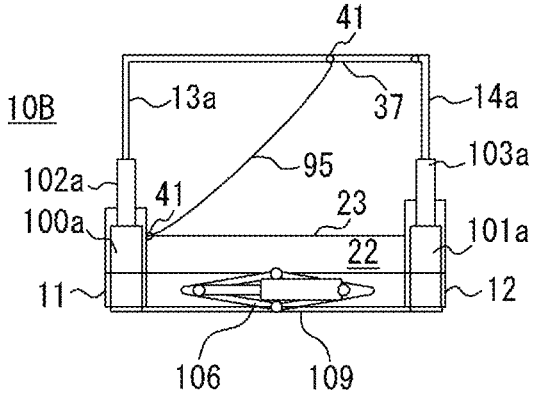

As shown in FIG. 10C, the hammock 80 can be also attached to the lifting member attachment portions 41 of the rod-shaped bodies 37, and can be in a more-inclined state. In this state, the hammock 80 may be moved on the side on which the hammock 80 is attached to the lifting member attachment portions 41 of the rod-shaped bodies 37. In this manner, the angle of the hammock can be brought into a more-inclined state.

Second Embodiment

Next, a nursing-care bed 10C of a second embodiment will be described with reference to FIG. 11. In the first embodiment, the case where the nursing-care bed 10 is configured such that the bed body 22 and the support bases 11, 12 are integrated has been described. However, in the second embodiment, a case where the nursing-care bed 10C is configured such that a bed body 22C and support bases 11C, 12C are separated from each other will be described. Note that the same reference numerals are used to represent configurations common to those of the first embodiment, and detailed description will be omitted.

Figure 11A:
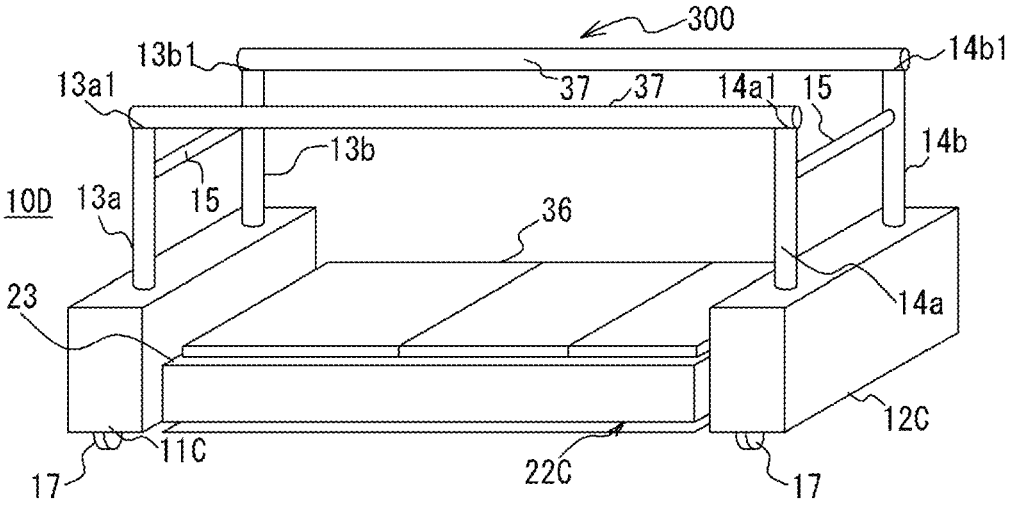
FIG. 11A is a perspective view of a nursing-care bed of a second embodiment.

As shown in FIG. 11A, the nursing-care bed 10C of the second embodiment includes the bed body 22C and a lift mechanism 300 having the pair of support bases 11C, 12C arranged to sandwich the bed body 22C. That is, the nursing-care bed 10C of the second embodiment is configured such that the bed body 22 and the support bases 11, 12 of the nursing-care bed 10 of the first embodiment are separated from each other.

As in the bed body 22C of the first embodiment, the bed body 22C of the second embodiment has a rectangular floor portion 23 formed with such predetermined area and thickness that a person can lie on the bed, and an opening (not shown in the figure) is provided at a center portion of the floor portion 23. Moreover, a grid-shaped frame (not shown in the figure) and a mat 36 are detachably provided at the opening formed at the floor portion 23. Note that casters 17 allowing movement of the support bases 11C, 12C are provided at lower portions of the support bases 11C, 12C.

Note that a bed actuator 104 forming a bed-side lifting/lowering unit of a lifting/lowering unit 16C, a pantograph 106, etc. are provided at the bed body 22C (see FIGS. 3A and 3B). These configurations are common to those of the first embodiment, and therefore, detailed description thereof will be omitted. Note that a well-known bed body can be also used as the bed body.

Figure 11B:
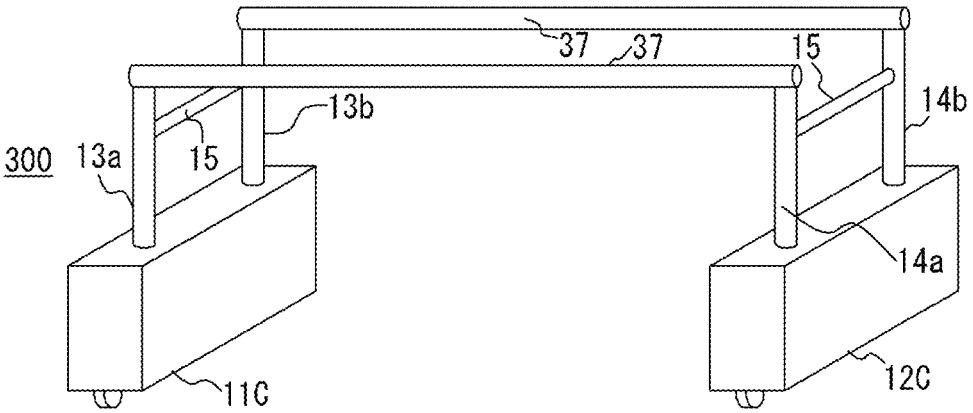
FIGS. 11B and 11C are perspective views of a lift mechanism.
Figure 11C:
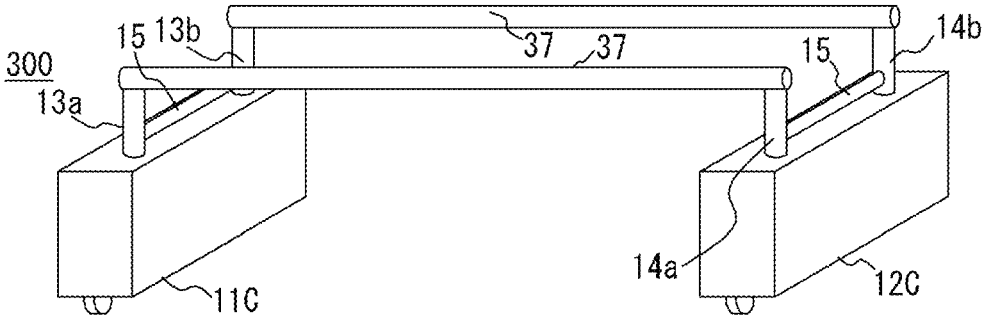

As shown in FIGS. 11B and 11C, the lift mechanism 300 includes at least one support base, e.g., the two support bases 11C, 12C in the second embodiment. The lift mechanism 300 has support rods 13*a*, 13*b* included in the support base 11C and support rods 14*a*, 14*b* included in the support base 12C. Upper portions of the support rod 13*a* and the support rod 14*a* are connected to each other through a rod-shaped body 37, and upper portions of the support rod 13*b* and the support rod 14*b* are connected to each other through a rod-shaped body 37. Moreover, beam members 15 are provided between the support rod 13*a* and the support rod 13*b* and between the support rod 14*a* and the support rod 14*b*. Note that these configurations and actuation mechanisms are common to those of the first embodiment, and therefore, detailed description thereof will be omitted.

As shown in FIG. 11A, the bed body 22C and the lift mechanism 300 are combined so that advantageous effects similar to those of the first embodiment can be provided. That is, a hammock as a lifting member is attached to any of the support rods 13*a*, 13*b*, 14*a*, 14*b* of the lift mechanism 300, the beam members 15, and the rod-shaped bodies 37, so that the hammock can be lifted/lowered. In this case, the hammock is configured so that the hammock can be moved to below the floor portion 23 of the bed body 22C on which the hammock is to be placed. In the case of using the well-known bed body, the hammock can be moved to below a portion corresponding to a floor portion of the bed body. With this configuration, transfer movement to other types of medical/nursing-care equipment such as a wheelchair can be facilitated.

Note that a sensor is provided at least at one of the bed body 22C or the lift mechanism 300 and the cycle of up-down movement in lifting/lowering of the lift mechanism 300 and the bed body 22C can be set to link with up-down movement of the bed body 22C. In this case, e.g., an optical sensor can be used as the sensor. Lifting/lowering of the bed body 22C and lifting/lowering of each of the support bases 11C, 12C of the lift mechanism 300 can be synchronized using a link mechanism.

Figure 12A:
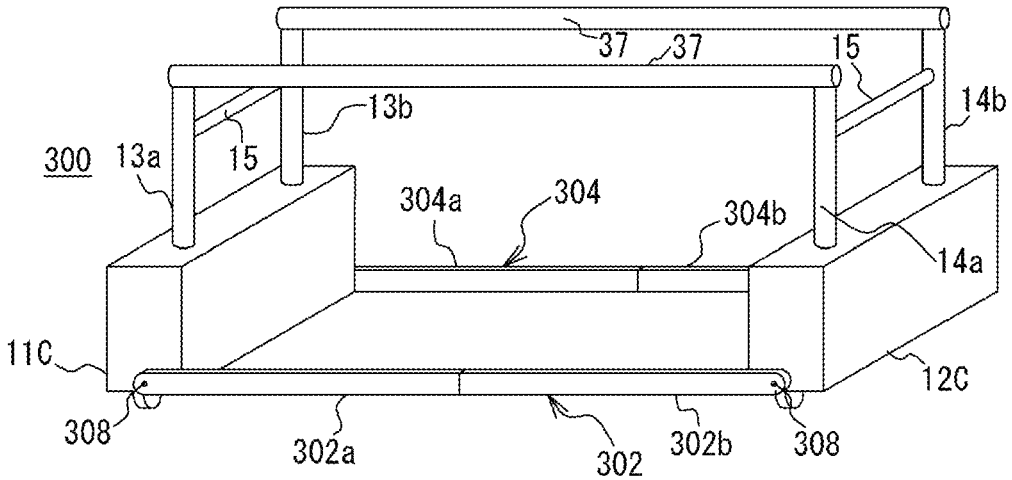
FIG. 12A is a perspective view showing one example in the case of providing a reinforcement member at the lift mechanism.

For reducing the instability of each of the support bases 11C, 12C of the lift mechanism 300 in the case of lifting a care-requiring person, reinforcement is made such that the support bases 11C, 12C are connected to each other. As the reinforcement of each of the support bases 11C, 12C, reinforcement members 302, 304 connecting side surfaces of the support bases 11C, 12C to each other can be provided as shown in FIG. 12A.

The reinforcement members 302, 304 can be formed as plate-shaped bodies having such lengths that the support base 11C and the support base 12C are connected to each other and having predetermined thicknesses and widths. Note that as long as the reinforcement can be made, these members are not limited to the plate-shaped bodies and may be rod-shaped bodies in optional shapes such as a round shape and an angular shape.

In a case where the reinforcement members 302, 304 are provided on the side surfaces of the support bases 11C, 12C, the reinforcement members 302, 304 may be provided on both side surfaces or the reinforcement member 302 or the reinforcement member 304 may be provided on either one of the side surfaces.

In the case of providing the reinforcement members 302, 304, these members can be configured dividable at substantially-center portions and fixable at such a divided portion by a predetermined method such that entrance of the separately-provided bed body 22C is allowed, for example.

Figure 12B:
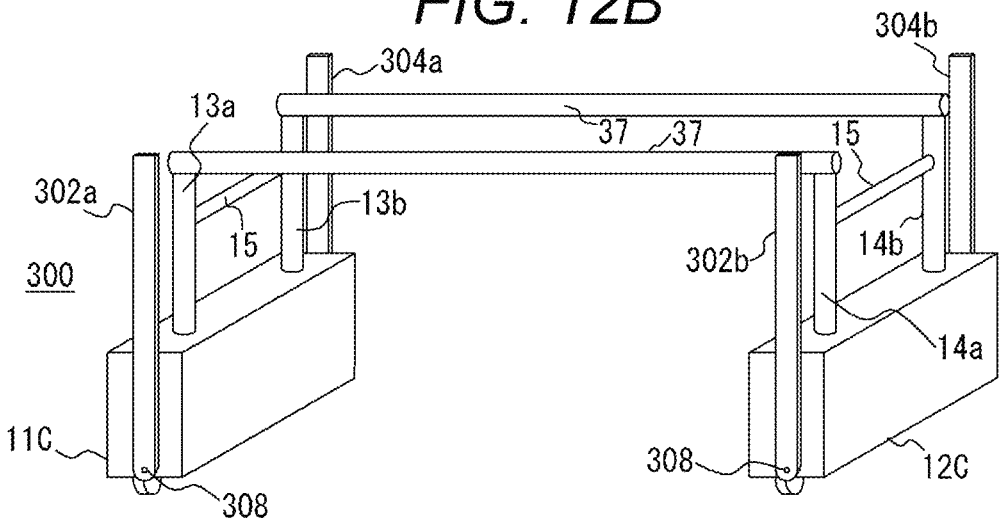
FIG. 12B is a perspective view showing a case where the reinforcement member of FIG. 12A is moved.

One reinforcement member 302*a* and the other reinforcement member 302*b* of the reinforcement member 302 divided as shown in FIG. 12B and one reinforcement member 304*a* and the other reinforcement member 304*b* of the reinforcement member 304 divided as shown in FIG. 12B can be configured to rotate about reinforcement member shaft portions 308 rotatably attached to the support bases 11C, 12C to move substantially upwardly. In a case where each of the reinforcement members 302*a*, 302*b*, 304*a*, 304*b* is moved as described above, these members can be fixed with fixing units (not shown) allowing fixing in the substantially vertical direction.

Note that the reinforcement members 302, 304 may be detachable from the support bases 11C, 12C.

Figure 12C:
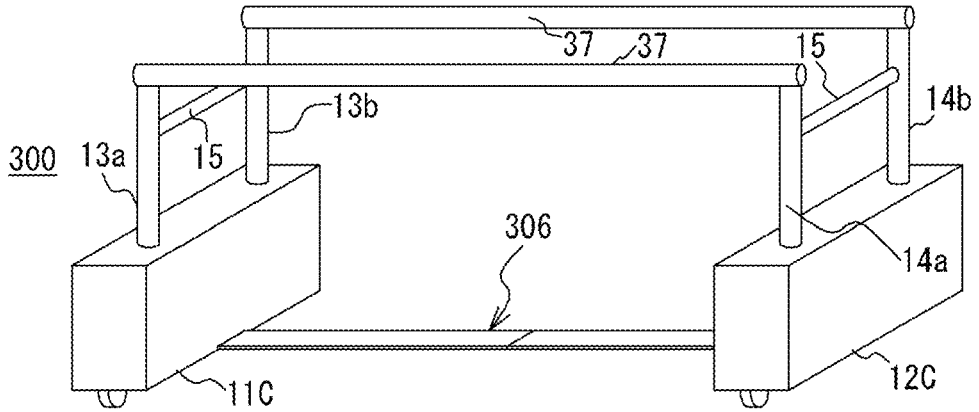
FIG. 12C is a perspective view showing another example of the reinforcement member.

As in the lift mechanism 300 shown in FIG. 12C, a reinforcement member 306 connecting bottom surfaces of the support bases 11C, 12C may be provided. Similarly, in the case of the reinforcement member 306, the reinforcement member 306 may be configured dividable at a center portion, or may be detachable from each of the support bases 11C, 12C. Further, in the case of the reinforcement member 306, corner portions thereof on the side from which the bed body enters may be chamfered and formed in an inclined shape, so that the bed body 22C can move on the reinforcement member 306. With this configuration, movement of the bed body 22C can be facilitated.

Note that in the case of combining the bed body and the lift mechanism, the bed body may be moved and set to the lift mechanism arranged first, or conversely, the lift mechanism may be moved and set to a location where the bed body is arranged first.

Third Embodiment

Figure 13A:
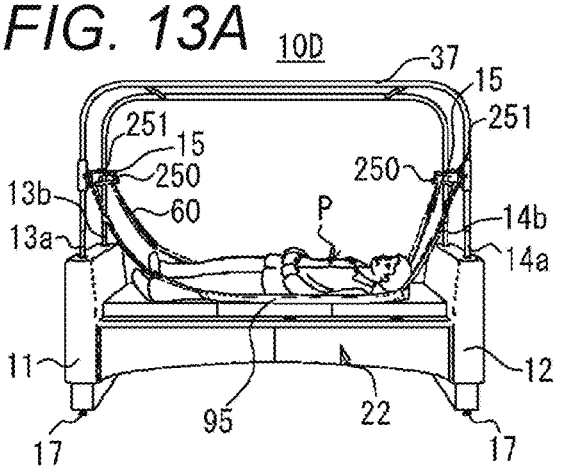
FIGS. 13A to 13D are views sequentially showing operation when a care-requiring person is moved from a nursing-care bed of a third embodiment to a wheelchair.

The nursing-care bed 10 of the first embodiment is applicable not only to the wheelchair but also to other types of medical/nursing-care equipment arranged at the side of the bed, such as the stretcher and the simple bathtub. For a nursing-care bed 10D of a third embodiment, the operation of moving a care-requiring person from the nursing-care bed 10D to a wheelchair in a case where the wheelchair is used as the other types of medical/nursing-care equipment will be hereinafter described by way of example with reference to FIGS. 13A to 13F. First, an actuation state of a suspension member will be described with reference to FIGS. 13E and 13F. The same reference numerals are used to represent the same components as those shown in FIGS. 1 to 5, and detailed description thereof will be omitted. Note that FIG. 13E shows a state in which the suspension member is slid and pulled out in a direction apart from a bed body, and FIG. 13F shows a state in which the suspension member is housed.

The laterally-slidable suspension member 250 is joined to a beam member 15 attached to support rods 13*a*, 13*b* on one side through a joint member 251. Note that the suspension member 250 of the third embodiment includes a slide bar 250*a* slidably movable in the joint member 251 and a hanging bar 250*b* hanging a hammock 95 through belt bodies 60. Note that the slide bar 250*a* and the hanging bar 250*b* are, at end portions thereof, coupled to each other through, e.g., a coupling member 250*f*. The joint member 251 has, e.g., a bearing therein, so that the slide bar 250*a* of the suspension member 250 can reciprocate in the fixed joint member 251 along a lateral direction, i.e., a traverse direction of the bed body 22.

The slide operation of the suspension member 250 may be manually performed or be electrically performed. Further, the hammock 95 as a lifting member having, e.g., a configuration shown in FIG. 5 is attached to the hanging bar 250*b* of the suspension member 250 through the belt bodies 60. Note that a suspension member 250 slidable in the lateral direction in the direction apart from the bed body 22 is similarly joined to a beam member 15 attached to support rods 14*a*, 14*b* on the opposite side through a joint member 251. Moreover, a switch mechanism 251*a* is provided at the joint member 251, and is connected to the slide bar 250*a* of the suspension member 250. It is configured such that the suspension member 250 is moved when the switch mechanism 251*a* of the joint member 251 is operated.

In the case of lowering the hammock 95, each beam member 15 attached to the support rods 13*a*, 13*b*, 14*a*, 14*b* is lowered in association with lifting of the bed body 22, and accordingly, the hammock 95 is lowered onto a floor portion 23 of the bed body 22. Since the bed body 22 is slightly lifted, a caregiver can easily laterally move a lying care-requiring person P onto the hammock 95 without an insecurity feeling and can place the care-requiring person P on the hammock 95 as shown in FIG. 13A.

Figure 13B:
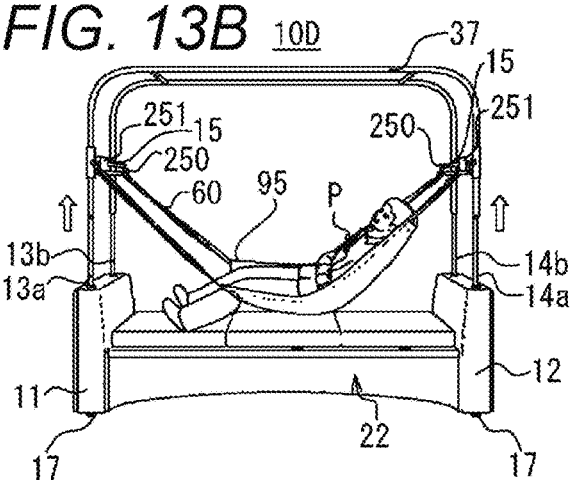

Next, in the case of lifting the hammock 95, each beam member 15 attached to the support rods 13*a*, 13*b*, 14*a*, 14*b* is lifted in association with lowering of the bed body 22, and accordingly, the hammock 95 and the care-requiring person P are lifted together from the floor portion 23 of the bed body 22 as shown in FIG. 13B. The bed body 22 is lowered synchronously, and therefore, a distance between the hammock 95 and the floor portion 23 of the bed body 22 can be substantially twice as long as a distance that the hammock 95 is lifted. Thus, the lifting distance can be reduced, and a space from the floor portion 23 can be sufficiently ensured.

Figure 13C:
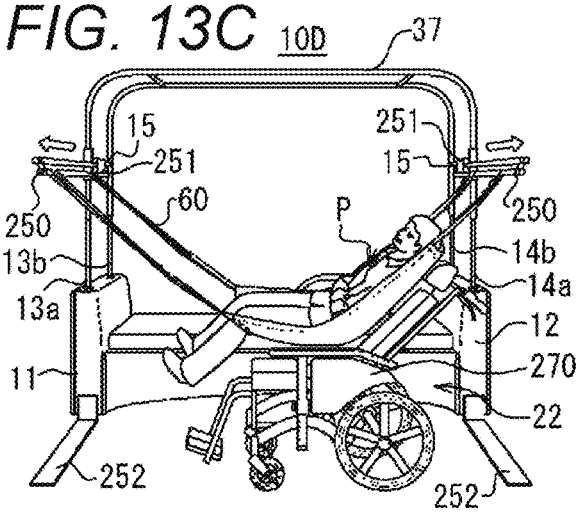

Next, the caregiver moves a wheelchair 270 to the side of the bed body 22, and the suspension members 250 joined to the beam members 15 through the joint members 251 are laterally moved (slid) to right above the wheelchair 270 as shown in FIG. 13C. Such movement can be easily performed with less vibration because the slide bars 250*a* of the suspension members 250 are joined through, e.g., bearings inside the joint members 251. Moreover, a slide fixing unit (not shown in the figure) to which the slide bar 250*a* of the suspension member 250 is slidably fixed can be provided inside the joint member 251 to avoid lateral movement of the suspension member 250 as long as the slide fixing unit is not released, and therefore, improper movement of the suspension member 250 can be reduced.

Figure 13D:
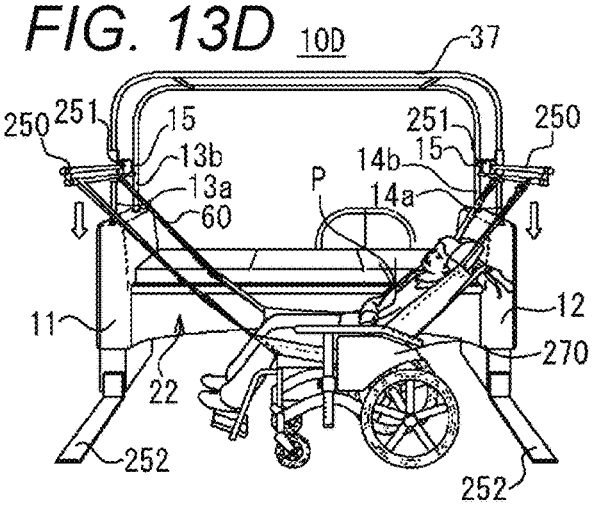
Figure 13E:
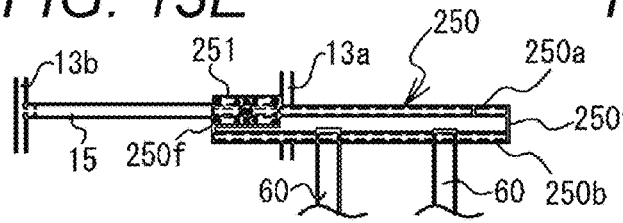
FIGS. 13E and 13F are views for describing states in which a suspension member is pulled out and housed by sliding.
Figure 13F:
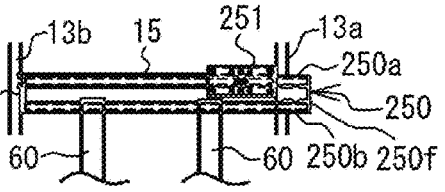

Thereafter, the beam members 15 attached to the support rods 13*a*, 13*b*, 14*a*, 14*b* are lowered as shown in FIG. 13D. Accordingly, the suspension members 250 joined to the beam members 15 at both ends are lowered, so that the care-requiring person P on the hammock 95 can be moved onto the wheelchair 270. At this point, at least the lowermost portion of the hammock 95, e.g., the buttocks of the care-requiring person P on the hammock 95 in the third embodiment, is moved to below the floor portion 23 of the bed body 22, and therefore, movement to the wheelchair is allowed. For the caregiver, only electric up-down movement and manual lateral movement of the nursing-care bed are required. Thus, the caregiver can safely move the care-requiring person P from the nursing-care bed to the wheelchair 270 with almost no burden.

Note that the beam member 15 to which the slidable suspension member 250 is attached through the joint member 251 may be placed at any location as long as the beam member 15 is a member cooperating with the support rods. For example, the beam member 15 may be provided at the support rods 13*a*, 13*b*, 14*a*, 14*b* as in this description or at a rod-shaped body 37 of a ceiling portion coupled to the support rods.

An adjustment portion capable of adjusting the length of a belt may be provided at the hammock. The adjustment portion may be of a manual type, or a mechanical unit such as a winch may be provided as the adjustment portion.

Figure 13G:
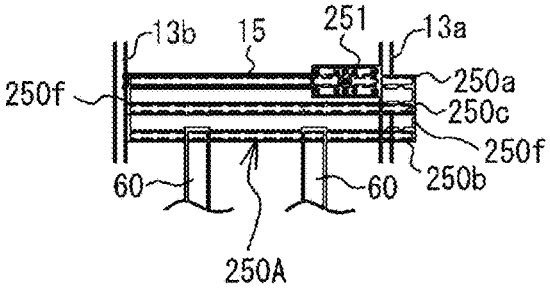
FIGS. 13G and 13H are views showing another suspension member and a claw member.
Figure 13H:
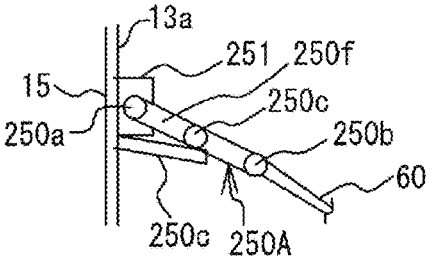

Note that the case where the suspension member 250 of the third embodiment includes the slide bar 250*a* slidable on the joint member 251 and the hanging bar 250*b* on which the hammock 95 is hung has been described, but the present invention is not limited to such a case and an engagement bar 250*c* can be provided between the slide bar 250*a* and the hanging bar 250*b* as in a suspension member 250A shown in FIGS. 13G and 13H. The engagement bar 250*c* engages with a claw member 250*d* provided at the beam member 15, so that the suspension member 250A can be fixed with a predetermined angle. The angle of the claw member 250*d* can be an optional angle. In this case, the beam member 15 includes a plate-shaped body, and therefore, a space for providing the claw member 250*d* can be ensured. Moreover, the slide bar 250*a*, the engagement bar 250*c*, and the hanging bar 250*b* are, at end portions thereof, coupled to each other through, e.g., the coupling member 250*f*.

An overturn prevention mechanism 252 may be provided as shown in FIG. 14A such that overturn of the bed is avoided when the suspension members 250 move to the outside of the bed. The overturn prevention mechanism 252 is preferably housed in, e.g., a bed side surface when the nursing-care bed 10 is moved or the suspension members 250 are not slidably moved. For housing the overturn prevention mechanism 252, an overturn prevention extending portion 252*b* as a portion extending from a support base attachment portion 252*a* as a portion attached to each of support bases 11, 12 of the bed body 22 is folded up about a corner portion 252*c* onto the support base attachment portion 252*a*, as illustrated in, e.g., FIG. 14B. In this manner, the overturn prevention mechanism 252 can be housed along a side portion 24, 25 of the bed body 22. Note that the overturn prevention mechanisms 252 are, for example, provided on both support bases 11, 12.

Specifically, as shown in FIG. 14C, a movable member 256 having a planar portion $\mathbf{256}_2$ and at least opposing side portions $\mathbf{256}_1$ is provided between the support base attachment portion 252*a* having at least opposing side surfaces $\mathbf{252}a_1$ and the overturn prevention extending portion 252*b* in a state in which the movable member 256 is inclined with respect to the support base attachment portion 252*a* and the overturn prevention extending portion 252*b*.

At each side portion $\mathbf{256}_1$ of the movable member 256, at least one corner shaft portion, e.g., a pair of corner shaft portions 256*a* in the third embodiment, is provided, which is rotatably supported on bearing portions 254*a* of a pair of rib-shaped corner members 254 provided on an overturn prevention extending portion 252*b* side at the corner portion 252*c*. Moreover, at least one movable pin, e.g., a pair of movable pins 256*b* in the third embodiment, is provided at each side portion $\mathbf{256}_1$, the movable pin being formed at the side surface $\mathbf{252}a_1$ of the support base attachment portion 252*a*, being provided with at least one crank portion 258*a*, and being movable in at least one groove portion, e.g., a pair of groove portions 258 in the third embodiment.

Note that the movable member 256 is in the form of a substantially backwards C-shaped plate-shaped body having the side portions $\mathbf{256}_1$ and the planar portion $\mathbf{256}_2$, and the corner shaft portions 246*a* are provided on one side of the movable member 256 and the movable pins 256*b* are provided on the other side. A restriction groove portion 258*b* into which the movable pin 256*b* enters to restrict movement of the movable member 256 is provided at a lower end portion of the groove portion 258 on the overturn prevention extending portion 252*b* side. The movable pin 256*b* enters the restriction groove portion 258*b* so that movement of the overturn prevention extending portion 252*b* in a tilted state can be restricted. Note that FIGS. 14C and 14D do not show the support bases etc.

In the case of folding up the overturn prevention extending portion 252*b* of the overturn prevention mechanism 252, an end portion of the overturn prevention extending portion 252*b* on the opposite side of the corner portion is lifted in a substantially arc. Accordingly, the corner shaft portions 256*a* of the movable member 256 are rotatably moved, and the movable pins 256*b* of the movable member 256 are moved upwardly, i.e., in a direction apart from the corner portion 252*c*, in the groove portions 258 provided at the support base attachment portion 252*a* and are moved such that the inclination of the movable member 256 becomes closer to a substantially right angle. Such movement is performed after the movable pins 256*b* is pulled out of the restriction groove portions 258*b*.

Thereafter, as shown in FIG. 14D, folding of the overturn prevention mechanism 252 is completed when the support base attachment portion 252*a* and the overturn prevention extending portion 252*b* become parallel with each other. At this point, the overturn prevention extending portion 252*b* is fixed to the support base attachment portion 252*a* or the support base 11, 12 by means of, e.g., magnetic force, a belt body, or a velcro tape.

On the other hand, in the case of bringing down the overturn prevention extending portion 252*b* of the overturn prevention mechanism 252, the overturn prevention extending portion 252*b* in a fixed state is pulled away from the support base attachment portion 252*a*, and the overturn prevention extending portion 252*b* is brought down until the overturn prevention extending portion 252*b* is placed on a floor on which the bed body 22 is placed. In this case, the crank portion 258*a* is provided at the groove portion 258, so that the overturn prevention extending portion 252*b* can be temporarily stopped by the crank portions 258*a* if the overturn prevention extending portion 252*b* falls with great force while being brought down. A defect such as pinching of a user or the caregiver can be reduced.

Note that a lock mechanism 259 is provided, so that the overturn prevention mechanism 252 can be locked in a state in which the support base attachment portion 252*a* and the overturn prevention extending portion 252*b* are folded on each other and unexpected movement in a direction in which the overturn prevention extending portion 252*b* is folded is reduced. The lock mechanism 259 is, for example, provided at the planar portion $\mathbf{256}_2$ of the movable member 256, and a typical mechanism such as a snap lock can be provided.

As in an overturn prevention mechanism 252A shown in FIG. 14E, an overturn prevention extending portion 252Ab as an extending portion may be rotated relative to a support base attachment portion 252Aa as a portion attached to the support base 11, 12 to move to a bed body 22 side, and may be housed in this manner.

Specifically, as shown in FIGS. 14F and 14G, the overturn prevention mechanism 252A includes the support base attachment portion 252Aa provided on the lower side of the support base 12, i.e., on a floor side opposite to the support rods 14*a*, 14*b* (see FIG. 1), a rotary member 280 rotatably attached to the support base attachment portion 252Aa and attached to the overturn prevention extending portion 252Ab in a liftable/lowerable manner, and the overturn prevention extending portion 252Ab attached to the rotary member 280. Note that the overturn prevention mechanism 252A provided on the support base 12 side will be described as a representative with reference to FIGS. 14F and 14G.

The support base attachment portion 252Aa has a planar plate portion 281 formed as a plate-shaped body with a predetermined thickness and protruding from the support base 12 and a rotation groove portion 282 from which a later-described rotary-member-side operation member 283 formed at the planar plate portion 281 protrudes and in which the rotary-member-side operation member 283 is movable in a substantially arc shape.

The rotary member 280 has a rotary plate portion 284 provided adjacent to the support base attachment portion 252Aa substantially in parallel, the rotary-member-side operation member 283 attached to the rotary plate portion 284 and protruding from the rotation groove portion 282 to a support base attachment portion 252Aa side, and a drooping member 285 provided to droop from the rotary plate portion 284. The drooping member 285 is formed in an L-shape. Note that the support base attachment portion 252Aa and the rotary member 280 are rotatably attached to each other through a not-shown shaft portion.

The overturn prevention extending portion 252Ab has a corner portion 252Ac liftably attached to the drooping member 285 of the rotary member 280, and a standing member 287 provided substantially in parallel with the drooping member 285 is provided at the corner portion 252Ac. Moreover, a rectangular lifting/lowering groove portion 286 is provided at the standing member 287, and a standing-member-side operation member 288 protruding from the lifting/lowering groove portion 286 and configured to fix lifting/lowering of the overturn prevention extending portion 252Ab or cancel such fixed lifting/lowering is provided at the drooping member 285. Note that another lifting/lowering groove portion may be provided at the standing member 287 in addition to the lifting/lowering groove portion 286, and a protruding member may be provided at the drooping member 285 to penetrate the another lifting/lowering groove portion. With this configuration, lifting/lowering of the overturn prevention extending portion 252Ab may be supported.

Note that in the case of using the overturn prevention extending portion 252Ab, the rotary member 280 rotates the overturn prevention extending portion 252Ab to a use position, i.e., in the direction apart from the bed body 22, and is fixed to the support base attachment portion 252Aa by the rotary-member-side operation member 283, and the standing-member-side operation member 288 fixes the overturn prevention extending portion 252Ab on the lower side, i.e., a state in which the overturn prevention extending portion 252Ab contacts the floor.

In the case of housing the overturn prevention extending portion 252Ab from the state in which the overturn prevention extending portion 252Ab of the overturn prevention mechanism 252A is used, the fixed standing-member-side operation member 288 protruding from the standing member 287 of the overturn prevention extending portion 252Ab on a corner portion 252Ac side is released to move the overturn prevention extending portion 252Ab upwardly. At this point, the standing-member-side operation member 288 moves in the lifting/lowering groove portion 286 upwardly. Thereafter, the standing-member-side operation member 288 is operated again in a state after the overturn prevention extending portion 252Ab is moved upwardly, and the overturn prevention extending portion 252Ab is fixed on the upper side.

Next, the fixed rotary-member-side operation member 283 of the rotary member 280 is released, and the rotary member 280 and the overturn prevention extending portion 252Ab are together rotatably moved to the bed body 22 side. At this point, the rotary-member-side operation member 283 moves the rotation groove portion 282 formed at the planar plate portion 281 of the support base attachment portion 252Aa.

Thereafter, rotation of the rotary member 280 is fixed by the rotary-member-side operation member 283 after the overturn prevention extending portion 252Ab is moved to the bed body 22 side (see FIG. 14G).

Note that in a case where the extending portion 252*b* of the overturn prevention mechanism 252 is housed, such a portion can be fixed at a housing position by means of a magnet or a spring member. The portion 252*b* can be also fixed to a predetermined frame by a L-shaped or backwards C-shaped metal fitting or a string member.

Further, a safety function is provided so that the suspension members 250 can slide only when the overturn prevention mechanisms 252 are set, and accordingly, an accident due to failure to set the overturn prevention mechanisms 252 can be prevented.

As shown in FIG. 14A, a slide cover 250*e* configured to cover the suspension member 250 can be also attached such that improper protrusion of the suspension member 250 is avoided. As shown in FIG. 14, the slide cover 250*e* is moved to a position not restricting movement of the suspension member 250 in a case where the suspension member 250 is slidable. On the other hand, in a case where the suspension member 250 is not moved to house the overturn prevention mechanism 252 as shown in FIGS. 14B and 14E, the slide cover 250*e* is moved to a position where the cover restricts the movement of the suspension member 250.

Figure 15A:
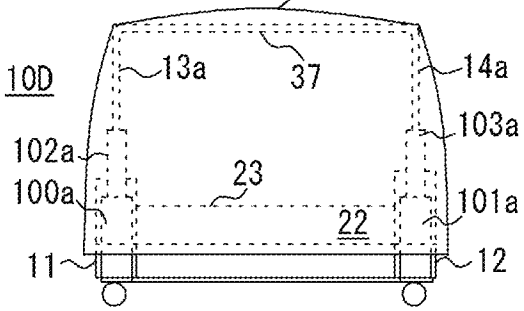
FIGS. 15A to 15C are views showing the case of using the moisture-proof cold-proof cover.
Figure 15B:
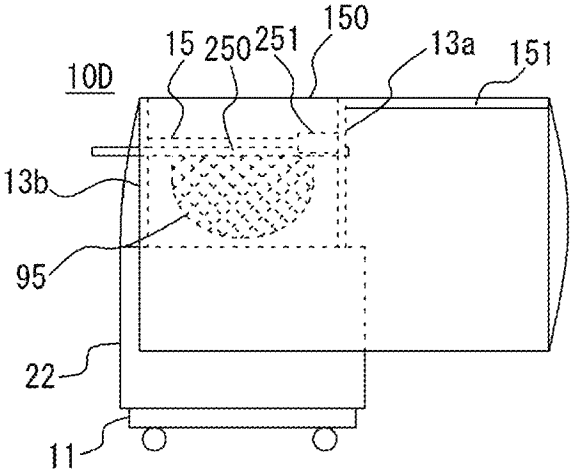
Figure 15C:
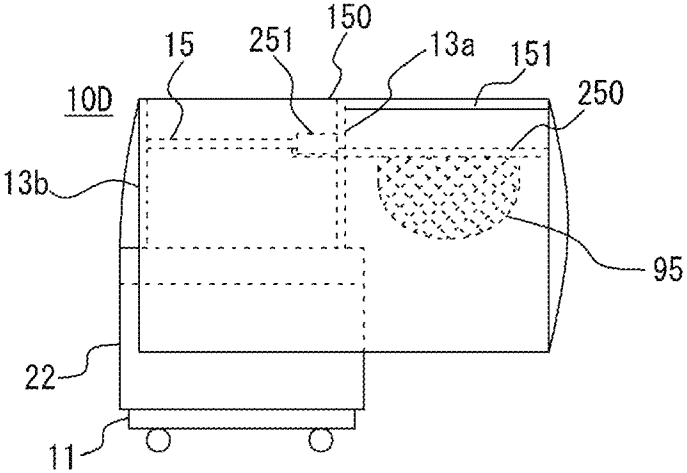

As shown in FIGS. 15A to 15C, the nursing-care bed 10D of the third embodiment can be also covered with a moisture-proof cold-proof cover 150 provided with a curtain. With the above-described moisture-proof cold-proof cover 150, a room temperature can be easily managed for the caregiver. With the curtain, caregiver's entrance into and exit from the moisture-proof cold-proof cover 150 can be facilitated. Note that in the third embodiment, an area where the suspension members 250 move is also covered with the moisture-proof cold-proof cover 150, and therefore, an eave 151 may be provided above the bed body 22 as shown in FIGS. 15B and 15C.

In a relationship between each of the support rod actuators 100*a*, 100*b*, 101*a*, 101*b* and the bed actuator 104, in a case where the hammock 95 is, by the suspension members 250, arranged at a position apart from the bed body 22, cooperation of each of the support rod actuators 100*a*, 100*b*, 101*a*, 101*b* and the bed actuator 104 can be canceled and each actuator can be operated independently. That is, the movement distance of the bed actuator 104 and the movement distance of each of the support rod actuators 100*a*, 100*b*, 101*a*, 101*b* are changed such that the movement distance of each of the support rod actuators 100*a*, 100*b*, 101*a*, 101*b* is increased. In this manner, the movement distance of the hammock 95 can be more increased. Consequently, movement of the care-requiring person P to, e.g., the wheelchair can be more facilitated.

[Third Variation]

Note that in the nursing-care bed 10 of the first embodiment, the case where the single bed actuator 104, or the single pantograph 106, etc. for lifting/lowering the bed body 22 is used has been described, but the present invention is not limited to such a case and a bed actuator 104*a*, 104*b*, the pantograph 106, etc. for lifting/lowering the bed body 22 may be provided at each of the support bases 11, 12.

That is, as in a nursing-care bed 10E of a third variation shown in FIGS. 16A and 16B, it can be configured such that the bed actuators 104*a*, 104*b* (the bed actuator 104*b* is not shown in the figure) are each provided at the support bases 11, 12 (only the support base 11 side is shown in FIG. 16B) and each end portion of the bed body 22 in the longitudinal direction is supported and lifted/lowered. Note that these configurations are common to the bed actuator 104, the pantograph 106, etc. of the first embodiment, and therefore, detailed description thereof will be omitted.

As in the first embodiment, the support rod actuators 100*a*, 100*b*, 101*a*, 101*b* and the bed actuators 104*a*, 104*b* are electrically connected to a control section 110A via a cable or wirelessly and a lifting/lowering switch 111A is electrically connected to the control section 110A via a wire or wirelessly, as shown in FIG. 16C. The control section 110A converts a command from the lifting/lowering switch 111A into operation of the support rod actuators 100*a*, 100*b*, 101*a*, 101*b* and the bed actuators 104*a*, 104*b*.

The bed actuator 104*a* on the support base 11 side and the bed actuator 104*b* on the support base 12 side may cooperate with each other for lifting/lowering, or may be separately operated for lifting/lowering without cooperation.

In this case, when the bed actuator 104*a* on the support base 11 side and the bed actuator 104*b* on the support base 12 side cooperate with each other for lifting/lowering, a relationship shown in FIG. 16D is satisfied, and operation similar to that of the first embodiment is performed.

When the bed actuator 104*a* on the support base 11 side and the bed actuator 104*b* on the support base 12 side are separately operated for lifting/lowering, only one side of the bed body 22, e.g., the bed actuator 104*b* on the support base 12 side, is operated to lift one side of the bed body 22, so that the bed body 22 can be inclined, as shown in FIG. 16E. In this case, the bed body 22 and each of the support bases 11, 12 are in flexible connection with each other. With this configuration, the caregiver easily provides a care.

Note that the case of inclining the bed body 22 is not limited to the case where the support base 11 side and the support base 12 side are separately vertically moved as described above, and one or the other of the side portions may be moved inclined. In this case, the bed actuators 104*a*, 104*b* each provided at the support bases 11, 12 may be used, or another bed actuator (not shown in the figure) may be provided at least at one side portion. With this configuration, the bed body 22 can be moved in a twisting direction. This can contribute to movement of the care-requiring person and the easiness of the care provided by the caregiver.

[Fourth Variation]

As shown in FIG. 17, in a nursing-care bed 10F of a fourth variation, the water tank 28 is provided at the bed body 22. Thus, the care-requiring person can be in the water tank 28 with the care-requiring person being hung on the hammock 95 in such a manner that the bed body 22 is lifted and the support rods 13*a*, 13*b*, 14*a*, 14*b* on which the hammock 95 is hung are lowered. In this case, hot water is stored in the water tank 28 such that the care-requiring person can take a bath. Moreover, the care-requiring person can take a shower by means of a separately-prepared shower device.

Figure 17A:
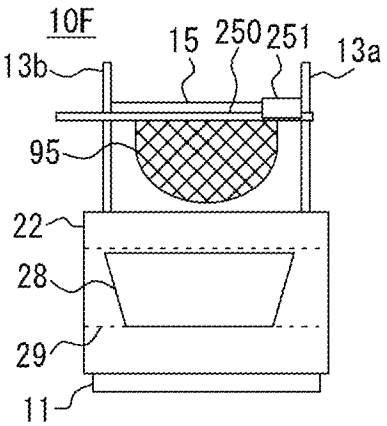
FIGS. 17A to 17C are views showing the form of use of the nursing-care bed in a case where a water tank is moved in a lateral direction.
Figure 17B:
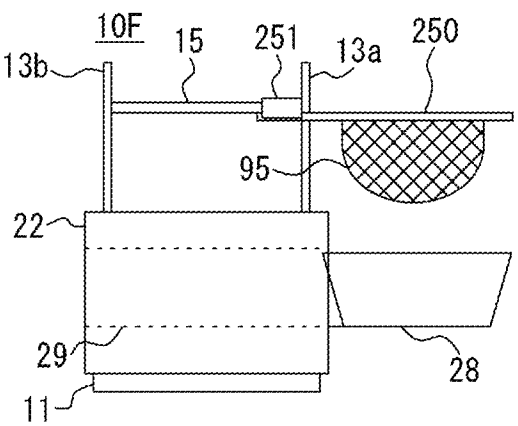

In this case, for the water tank 28A of the fourth variation, a guide portion 29 capable of moving the water tank 28 to a lower portion thereof as shown in FIG. 17A is provided. With the guide portion 29, the water tank 28 can be moved in the same direction as the direction in which the suspension members 250 of the third embodiment are moved, as shown in FIG. 17B.

Figure 17C:
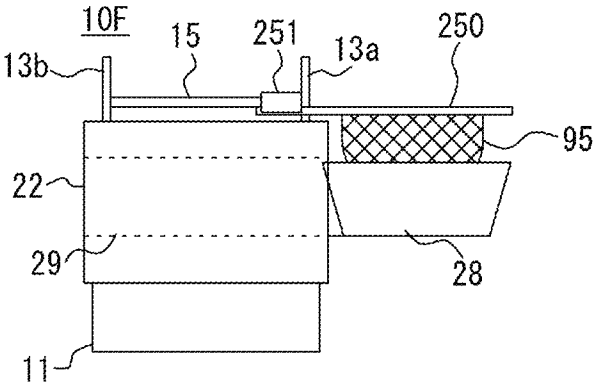

In this case, the care-requiring person (not shown in the figure) on the hammock 95 hung on the suspension members 250 is moved to above the water tank 28, and thereafter, the bed body 22 is lifted and each of the support rods 13*a*, 13*b*, 14*a*, 14*b* to which the suspension members 250 are attached is lowered. In this manner, bathing etc. are allowed at a position apart from the bed body 22 as shown in FIG. 17C. In this case, the above-described overturn prevention mechanism (not shown in the figure) is provided, so that overturn can be reduced.

Note that the case where the number of support rods is four (the support rods 13*a*, 13*b*, 14*a*, 14*b*) in the nursing-care bed 10D of the third embodiment has been described, but the present invention is not limited to this case and the number of support rods may be other numbers such as one, two, or multiple numbers.

Figure 18A:
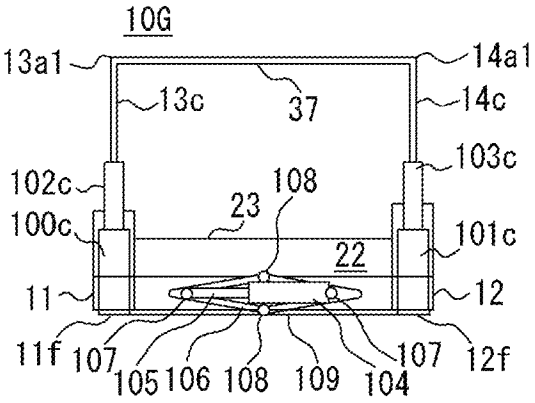
FIGS. 18A and 18B are views showing the nursing-care bed in a case where two support rods are provided.
Figure 18B:
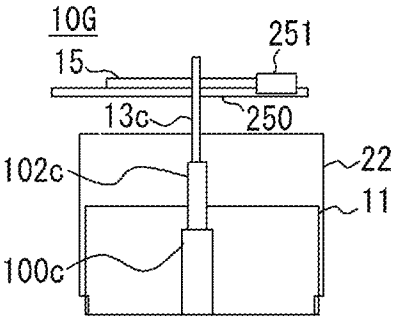

For example, in a nursing-care bed 10G shown in FIGS. 18A and 18B, a single support rod 13*c* and a single support rod 14*c*, two support rods in total, are each provided at the support bases 11, 12. Note that support rod actuators 100*c*, 101*c* are each provided for lifting/lowering at these support rods 13*c*, 14*c*.

Figure 18C:
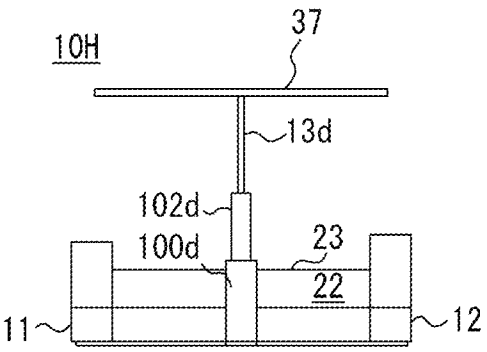
FIGS. 18C and 18D are views showing the nursing-care bed in a case where a single support rod is provided.
Figure 18D:
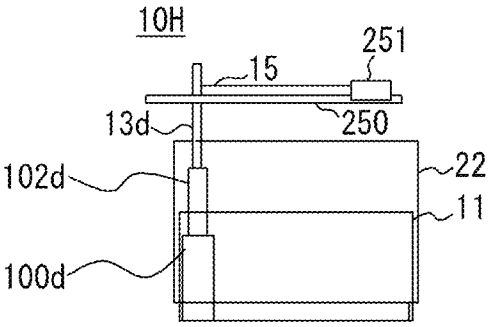

In a nursing-care bed 10H shown in FIGS. 18C and 18D, a single support rod 13*d* is provided at a substantially center portion of the bed body 22. Moreover, a support rod actuator 100*d* is provided for lifting/lowering at the support rod 13*d*. Note that FIG. 18C does not show the bed actuator.

Note that even in the case where the number of support rods is one, two, or other numbers, if the hammock is hung, the hammock is hung so that the hammock can be supported at four points at the four corners.

Note that the corresponding configurations described in the third embodiment and each variation are applicable to the lift mechanism 300 of the nursing-care bed 10C of the second embodiment and the configurations described in the third embodiment are also applicable to a combination with the bed body 22C.

For example, movement from the bed body 22C to the wheelchair 270 by the lift mechanism 300 is allowed as in FIGS. 13A to 13D. Note that FIGS. 13E and 13F show the suspension member 250 and the joint member 251 and configurations similar to those of the first embodiment can be used as these members.

It is configured such that the rod-shaped bodies 37 of the lift mechanism 300 are foldable, and therefore, the support bases 11C, 12C of the lift mechanism 300 can be arranged next to each other. Thus, the lift mechanism 300 can be compactified.

Reference Example, Fifth to Sixth Variations

Figure 19A:
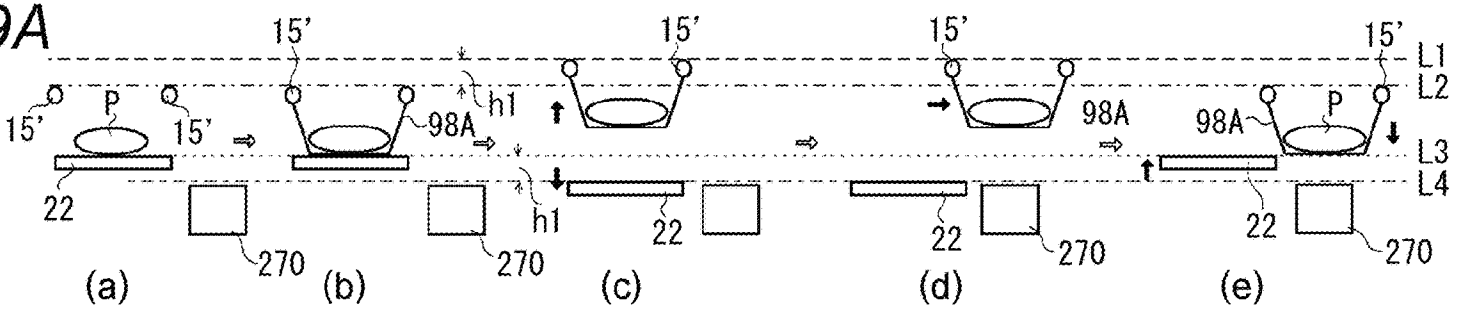
FIG. 19 is a view sequentially showing operation when the care-requiring person is moved from the nursing-care bed to the wheelchair, FIG. 19A showing a reference example and FIGS. 19B and 19C showing examples of fifth and sixth variations.

Operation when the care-requiring person is moved from the nursing-care bed 10D of the third embodiment shown in FIG. 13 to the wheelchair will be described herein with reference to FIG. 19. Note that FIG. 19A shows a reference example and FIGS. 19B to 19C each show examples corresponding to fifth to seventh variations. FIGS. 19A to 19C are each schematic views showing a state in which a portion corresponding to the abdomen of the care-requiring person lying on the bed is cut in the lateral direction and the vertical direction, and for the sake of easy understanding of the operation, each portion is omitted or zoomed in or out as necessary. These figures do not necessarily show precise shapes and dimensions.

Figure 19B:
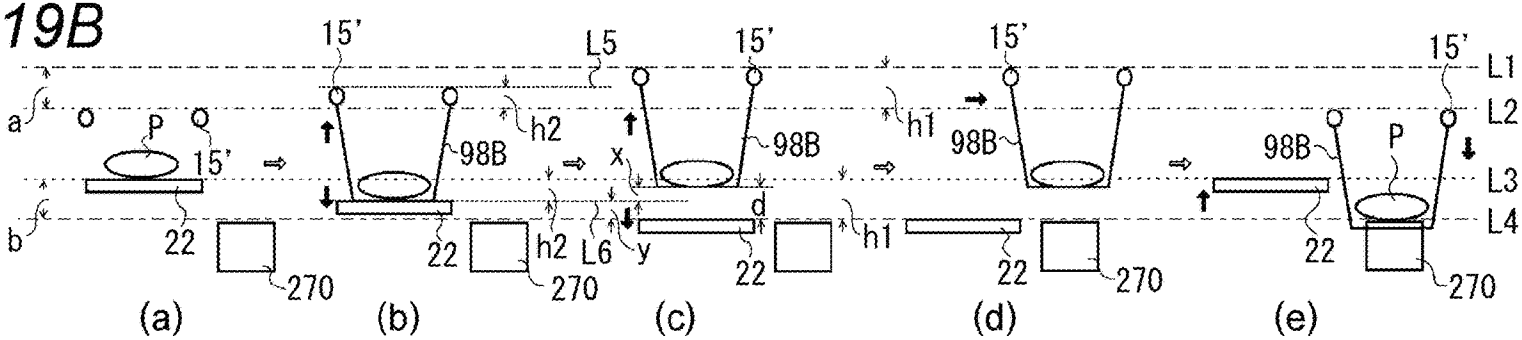
Figure 19C:
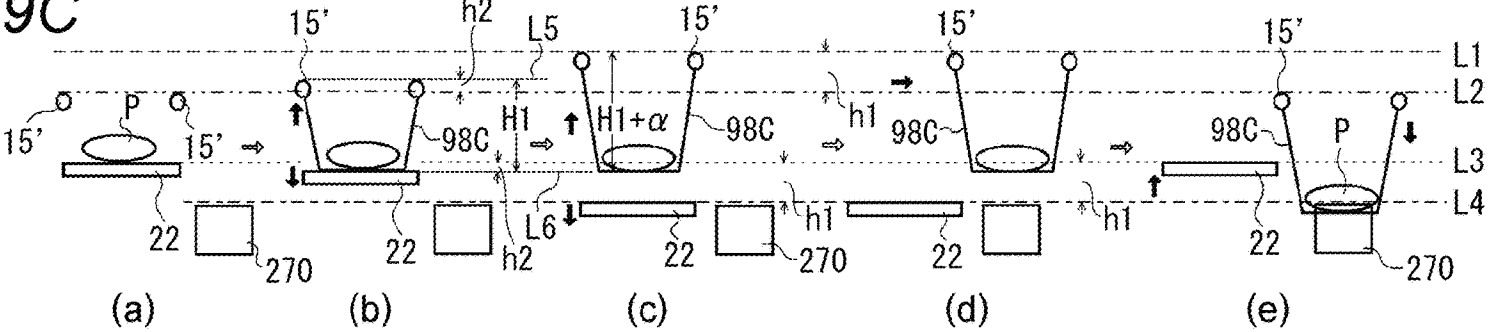

In FIGS. 19A to 19C, the same reference numerals are used to represent configurations similar to those in the cases of the nursing-care beds 10, 10A to 10D described in the first to third embodiments, and detailed description thereof will be omitted. Further, the beam member (see a reference numeral 15 of FIG. 13) is not specifically shown in FIG. 19 because the beam member interrupts understanding of the operation. Instead, in each view of FIG. 19, the configuration of the beam member is shown as two circle portions 15' indicating the fixing positions of each of hammocks 98A to 98D as the lift-up units at the beam members. Thus, a portion indicated by a reference numeral 15' is hereinafter expressed as the beam member. Note that in FIG. 19A, it is assumed that a non-sagging non-extending hammock is used as the hammock 98A.

First, the reference example will be described using FIG. 19A. FIG. 19A(a) shows a state in which the normal care-requiring person P lies on the bed body 22. Note that a long dashed line L1 shown in FIG. 19A indicates an uppermost position at which the beam member 15' can move in synchronization with the bed body 22, a chain double-dashed line L2 indicates the height of the beam member 15' when the normal care-requiring person P lies on the bed body 22, a short dashed line L3 indicates the height of the bed body 22 when the normal care-requiring person P lies on the bed body 22, and a chain line L4 indicates a lowermost height at which the bed body 22 can move in synchronization with the beam member 15'. Note that a nursing-care product, e.g., the wheelchair 270, is arranged at the side of the bed body 22. In this case, the height of the chain line L4 is higher than the uppermost height of the wheelchair 270.

In a state in which the care-requiring person P lies on the bed body 22, the hammock 98A forming the lifting member is inserted into between the care-requiring person P and the bed body 22 and is attached to the beam members 15' as shown in FIG. 19A(b). Subsequently, when the beam members 15' are lifted up to the position of the dashed line L1 as shown in FIG. 19A(c), the bed body 22 is lowered to the position of the chain line L4 in synchronization with such lifting. At this point, the lifting distance of the beam member 15' and the lowering distance of the bed body 22 are set to the same h1. For example, h1 is set to 30 cm. With this configuration, a distance between an upper portion of the bed body 22 and the care-requiring person P is, for example, 60 cm, and a sufficient nursing-care space is ensured. The distance between the upper portion of the bed body 22 and the care-requiring person P as described herein is preferably longer than a predetermined distance, and for example, can be set to equal to or longer than 20 cm.

In this state, the beam members 15' are moved in the lateral direction of the bed body 22 to move the care-requiring person P to above the wheelchair 270, as shown in FIG. 19A(d). Subsequently, when the beam members 15' are lowered to lower the hammock 98A as shown in FIG. 19A(e), the bed body 22 is lifted, but the care-requiring person P cannot be lowered only to the same height as that of the bed body 22. For this reason, the care-requiring person P is hung in air above the wheelchair 270. Even in this state, the care-requiring person P can be easily seated on a seating surface of the wheelchair 270. For laying down the care-requiring person P, the person being seated on the wheelchair 270, on the bed body 22, the above-described steps may be performed in the opposite way. However, not only when the care-requiring person P is seated on the seating surface of the wheelchair 270 but also when the care-requiring person P is placed on the hammock 98A from the wheelchair 270, the caregiver needs to hold the care-requiring person. For this reason, it is less likely to save the labor of the caregiver.

[Fifth Variation]

A solution to the problem of the reference example of FIG. 19A is the fifth variation shown in FIG. 19B. FIG. 19B is similar to FIG. 19A in the settings of L1 to L4. However, an intermediate lifting position (a thin dashed line L5) of the beam member 15' is set between the long dashed line L1 and the chain double-dashed line L2, and an intermediate lowering position (a thin dashed line L6) of the bed body 22 is set between the short dashed line L3 and the chain line L4. The movable distance of the beam member 15' in an upper-lower direction is represented by a, the movable distance of the bed body 22 in the upper-lower direction is represented by b, and the distance between the upper portion of the bed body 22 and the care-requiring person P when the beam member 15' is at the highest position is represented by d. Although not specifically limited, description will be made herein assuming as a=30 cm and b=30 cm. The intermediate lifting distance of the beam member 15' and the intermediate lowering distance of the bed body 22 in this case are set to the same h2. For example, h1 is set to 30 cm, and h2 is set to 20 cm. In this case, the distance d between the upper portion of the bed body 22 and the care-requiring person P is, for example, 20 cm, and slide movement is facilitated and a certain nursing-care space is ensured.

FIG. 19B(a) shows, as in the case of FIG. 19A(a), a state in which the normal care-requiring person P lies on the bed body 22. From this state, when the beam members 15' are lifted to the position of the thin dashed line L5 as shown in FIG. 19B(b), the bed body 22 is lowered to the position of the thin dashed line L6 in synchronization with such lifting. In this state, the hammock 98B forming the lifting member is inserted into between the care-requiring person P and the bed body 22, and is attached to the beam members 15'. Although it is also assumed that a non-sagging non-extending hammock is used as the hammock 98B, the size of the hammock 98B needs to be larger than that of the hammock 98A shown in FIG. 19A by the amount of lifting of the beam member 15' and the amount of lowering of the bed body 22.

Subsequently, when the beam members 15' are lifted to the position of the dashed line L1, the bed body 22 is lowered to the position of the chain line L4 in synchronization with such lifting. At this point, the lifting distance of the beam member 15' and the lowering distance of the bed body 22 from the state of FIG. 19B(b) are set to the same (h1–h2), and the height of the care-requiring person P is set higher than the uppermost height of the wheelchair 270. In this state, the beam members 15' are moved in the lateral direction of the bed body 22 and the care-requiring person P is moved to above the wheelchair 270, as shown in FIG. 19B(d). Subsequently, when the beam members 15' are lowered and the hammock 98B is lowered by h1 as shown in FIG. 19B(e), the bed body 22 is lifted and brought into the same state as that shown in FIG. 19A, but the height of the care-requiring person P is brought into a state similar to that shown in FIG. 19B(b) and reaches lower than the height of the bed body 22 (lower by, e.g., 10 cm). Thus, the care-requiring person P can be lowered close to the seating surface of the wheelchair 270. Accordingly, the care-requiring person P can be easily seated on the wheelchair 270, and the care-requiring person P seated on the wheelchair 270 can easily lie on the bed body 22 with the care-requiring person P being on the hammock 98B.

The case where h2=20 cm is set has been described herein as one example, but generally, the position h2 of the bed body 22 in FIG. 19B(b) can be specified according to the dimensions of a, b, d, x, and y. Assuming that the difference of the position of the bed body 22 in FIG. 19B(b) from the lowermost position of the bed body 22 of FIG. 19B(c) is y and a difference in the height between the bed body 22 in FIG. 19B(b) and the care-requiring person P in FIG. 19B(c) is x, $$d = x + y \qquad \text{(First Expression)}$$

is satisfied. The distance between the upper portion of the bed body 22 and the care-requiring person P when the beam member 15' is at the highest position is represented by d, and is set as such a distance that slide movement of the care-requiring person P is facilitated and a certain nursing-care space is ensured.

The position of the position h2 of the bed body 22 in FIG. 19B(b) can be specified according to x and y. The movement amount of the beam member 15' within the range of a and the movement amount of the bed body 22 within the range of b are in a proportional relationship, and therefore, $$x / y = a / b \qquad \text{(Second Expression)}$$

is satisfied. When the first expression and the second expression are solved, $$x = (a \cdot d)/(a + b) \text{ and} \quad \text{(Third Expression)}$$

$$y = (b \cdot d)/(a + b) \quad \text{(Fourth Expression)}$$

are obtained.

[Sixth Variation]

It is assumed that in the example shown in FIG. 19B, the non-extendable/contractable hammock is used as the hammock 98B. On the other hand, an extendable/contractable hammock is used as the hammock 98C in the sixth variation shown in FIG. 19C, so that advantageous effects similar to those in the case of FIG. 19B can be provided. As in the case of FIG. 19B, the intermediate lifting position (the thin dashed line L5) of the beam member 15' and the intermediate lowering position (the thin dashed line L6) of the bed body 22 are set and are set to the same h2 in FIG. 19C, but h2 is set to, e.g., 10 cm considering extension of the hammock 98C.

FIG. 19C(a) shows, as in the case of FIG. 19A(a), a state in which the normal care-requiring person P lies on the bed body 22. From this state, when the beam members 15' are lifted to the position of the thin dashed line L5 as shown in FIG. 19C(b), the bed body 22 is lowered to the position of the thin dashed line L6 in synchronization with such lifting. In this state, the hammock 98C forming the lifting member is inserted into between the care-requiring person P and the bed body 22, and is attached to the beam members 15'. The extendable/contractable hammock is used as the hammock 98C, and the size of the hammock 98C needs to be larger than that of the hammock 98A shown in FIG. 19A by the amount of lifting of the beam member 15' and the amount of lowering of the bed body 22. H represents the difference in the height between the beam member 15' and the care-requiring person P, and is the dimension of the hammock 98C in a height direction before extension.

Subsequently, when the beam members 15' are lifted to the position of the dashed line L1 as shown in FIG. 19C(c), the bed body 22 is lowered to the position of the chain line L4 in synchronization with such lifting. At this point, the lifting distance of the beam member 15' and the lowering distance of the bed body 22 from the state of FIG. 19C(b) are set to the same (h1−h2), the dimension of the hammock in the height direction is (H1+α), and the hammock is extended by α. Extension of the hammock 98C is taken into consideration such that the height of the care-requiring person P is higher than the uppermost height of the wheelchair 270, the care-requiring person P is properly slidably movable, and the nursing-care space is ensured. In this state, the beam members 15' are moved in the lateral direction of the bed body 22 and the care-requiring person P is moved to above the wheelchair 270, as shown in FIG. 19C(d). Subsequently, when the beam members 15' are lowered to lower the hammock 98C by h1 as shown in FIG. 19C(e), the bed body 22 is lifted and brought into the same state as that shown in FIG. 19A, but the extension a of the hammock 98C is added and the height of the care-requiring person P is at a position lower than that in the state shown in FIG. 19C(b). Thus, the height of the bed body 22 becomes lower than the height of the bed body 22, and therefore, the care-requiring person P can be lowered close to the seating surface of the wheelchair 270. Accordingly, the care-requiring person P can be easily seated on the wheelchair 27, and the care-requiring person P seated on the wheelchair 270 can easily lie on the bed body 22 with the care-requiring person P being on the hammock 98C. Although the type of extendable/contractable hammock 98C is not specifically limited, various forms such as a form that the material of the hammock 98C is extendable/contractable, a form that the hammock itself is extendable/contractable, a form that a belt body is extendable/contractable, a form that an actuator is attached to a belt body to change the length of the belt body, and a form that, e.g., a mechanism capable of manually adjusting the length of a belt body by means of a belt length adjustment metal fitting (e.g., a belt length adjustment metal fitting similar to that used for packing), a velcro tape, etc. is provided at the belt body can be employed. Instead of using the belt or the extendable/contractable hammock 98C, the hammock is sagged by a predetermined amount in the state of FIG. 19C(b) so that advantageous effects similar to those of the extendable/contractable hammock 98C can be provided even when the non-extendable/contractable hammock 98B (shown in FIG. 19B) is used.

[Seventh Variation]

Figure 20A:
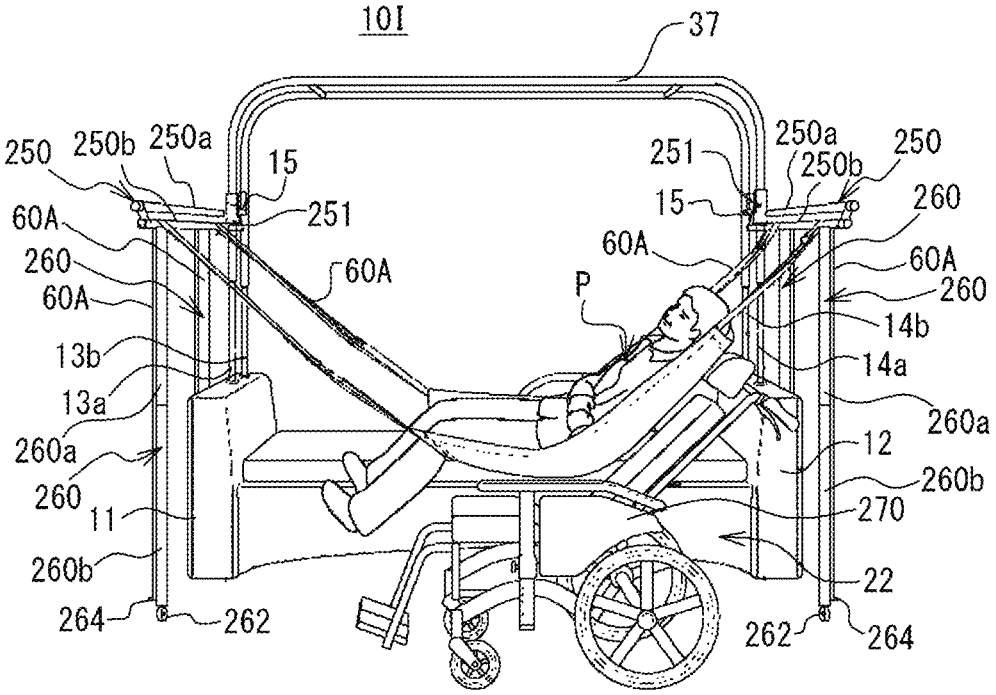
FIGS. 20A to 20C are perspective views showing a nursing-care bed of a seventh variation.
Figure 20B:
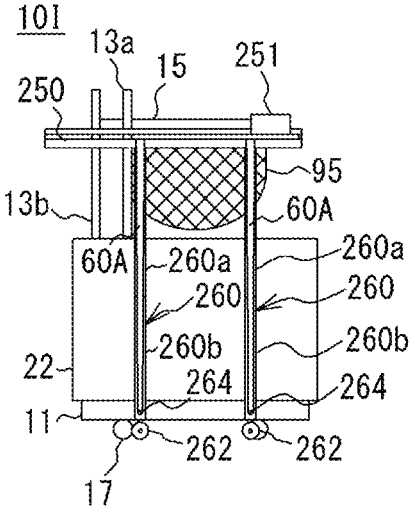
Figure 20C:
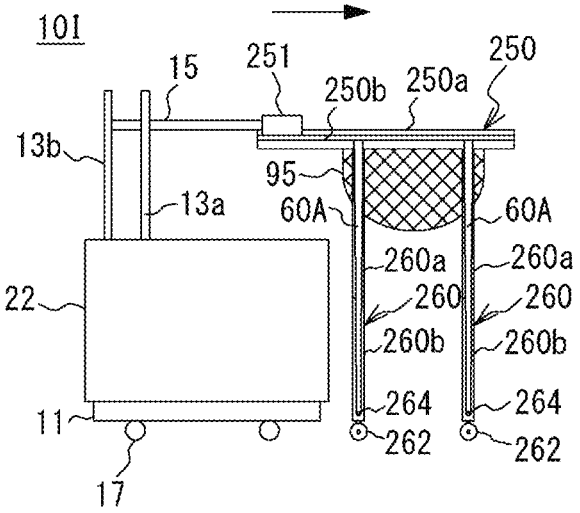

As the nursing-care bed of the third embodiment, the case where the overturn prevention mechanism 252 is provided to avoid turn-over of the bed body 22 when the suspension members 250 are moved to the outside of the bed as described with reference to FIG. 14 has been described, but the present invention is not limited to this case and slide support poles 260 configured to support the suspension members 250 from below may be provided for reducing turn-over or inclination of the bed body 22 as in a nursing-care bed 10I shown in FIGS. 20A to 20C. Note that the slide support poles 260 are provided on both of one support base 11 side and the other support base 12 side and are provided at portions at which belt bodies 60A of the hammock 95 as suspension members are arranged. In this case, a state as in FIG. 20C can be brought by movement of the hammock 95 through the suspension members 250 from a state shown in FIG. 20B. Note that for preventing the probability of the moving belt bodies 60A being caught, a portion between the support rod 13*a* and the support rod 13*b* and a portion between the support rod 14*a* and the support rod 14*b* are narrowed as compared to the third embodiment. Even with this configuration, the slide support poles 260 are provided, so that the hammock 95 etc. can be supported.

The slide support pole 260 is formed as a rod-shaped body having a length from the lower side of the slidably-movable suspension member 250 to the floor on which the nursing-care bed is placed, and on the floor side, is provided with, e.g., a movable caster 262, so that the slide support pole 260 can move according to movement of the suspension member 250. Moreover, the slide support pole 260 has a divided configuration, and a damper (not shown in the figure) may be provided at a portion at which an upper pole 260*a* and a lower pole 260*b* are divided from each other. This damper is configured such that the upper pole 260*a* of the slide support pole 260 applies stress upwardly, i.e., to a suspension member 250 side, and is vertically movable according to vertical movement of the suspension member 250.

A protruding belt locking portion 264 is provided above the caster 262 on the floor side of the lower pole 260*b* of each slide support pole 260. Each belt body 60A extending from the hammock 95 is connected to the belt locking portion 264. With this configuration, the movement distance of the hammock 95 can be substantially twice as long as that in vertical movement of each support rod.

Note that the slide support pole 260 is also applicable to each of the above-described embodiments and variations and the lift mechanism.

[Eighth Variation]

The lift mechanism 300 described in the second embodiment can be configured such that the rod-shaped body 37 on the upper side and the reinforcement member 302 are bent at substantially center portions and are folded. That is, a rod-shaped-body-side folding portion 37*c* provided at the rod-shaped body 37 of the lift mechanism 300 and a reinforcement-member-side folding portion 302*c* provided at the reinforcement member 302 are folded, and in this manner, the support base 11C and the support base 12C can be moved to approach each other as shown in FIG. 21B. In this case, a portion of the rod-shaped body 37 on one support base 11C side is a rod-shaped body 37*a*, and a portion on the other support base 12C side is a rod-shaped body 37*b*. Moreover, a portion of the reinforcement member 302 on one support base 11C side is the reinforcement member 302*a*, and a portion on the other support base 12C side is the reinforcement member 302*b*.

It is configured such that the rod-shaped-body-side folding portion 37*c* of the rod-shaped body 37 and the reinforcement-member-side folding portion 302*c* of the reinforcement member 302 are folded, and therefore, the support bases 11C, 12C of the lift mechanism 300 can be close to each other and the lift mechanism 300 can be compactified. For example, a housing space in an unused state can be saved, and delivery can be facilitated.

Figure 21A:
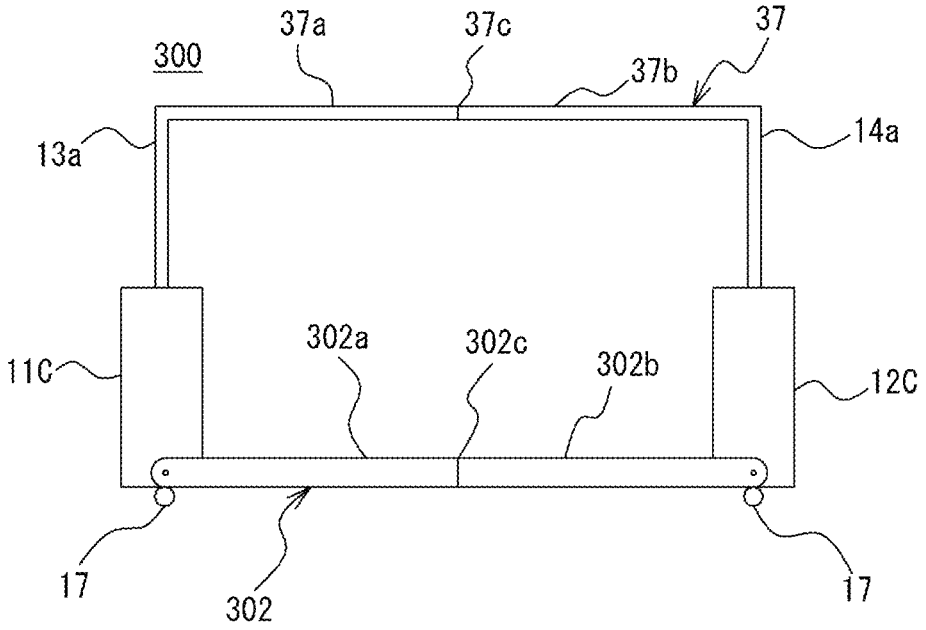
FIG. 21 shows a lift mechanism of an eighth variation, FIG. 21A being a side view showing a state before folding and FIG. 21B being a side view showing a state after folding.
Figure 21B:
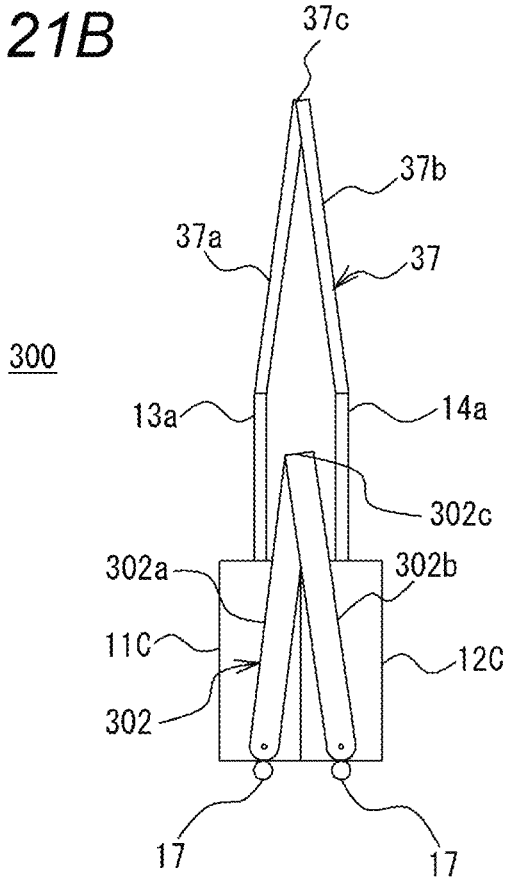

Note that FIG. 21 shows the views from one side, but in a case where another rod-shaped body 37 and another reinforcement member 302 are provided, a rod-shaped-body-side folding portion 37*c* and a reinforcement-member-side folding portion 302*c* of the reinforcement member 302 can be similarly provided.

Folding of, e.g., the rod-shaped body 37 and the reinforcement member 302 is not limited to the case where the rod-shaped body 37 and the reinforcement member 302 are folded at a single location as shown in FIG. 21, and the rod-shaped body 37 and the reinforcement member 302 may be folded at multiple locations.

The rod-shaped body 37 may be compactified such that the rod-shaped body 37*b* on the other side enters the rod-shaped body 37*a* on one side. Similarly, the reinforcement member 302 may be compactified such that the reinforcement member 302*b* on the other side enters the reinforcement member 302*a* on one side.

[Ninth Variation]

Figure 22A:
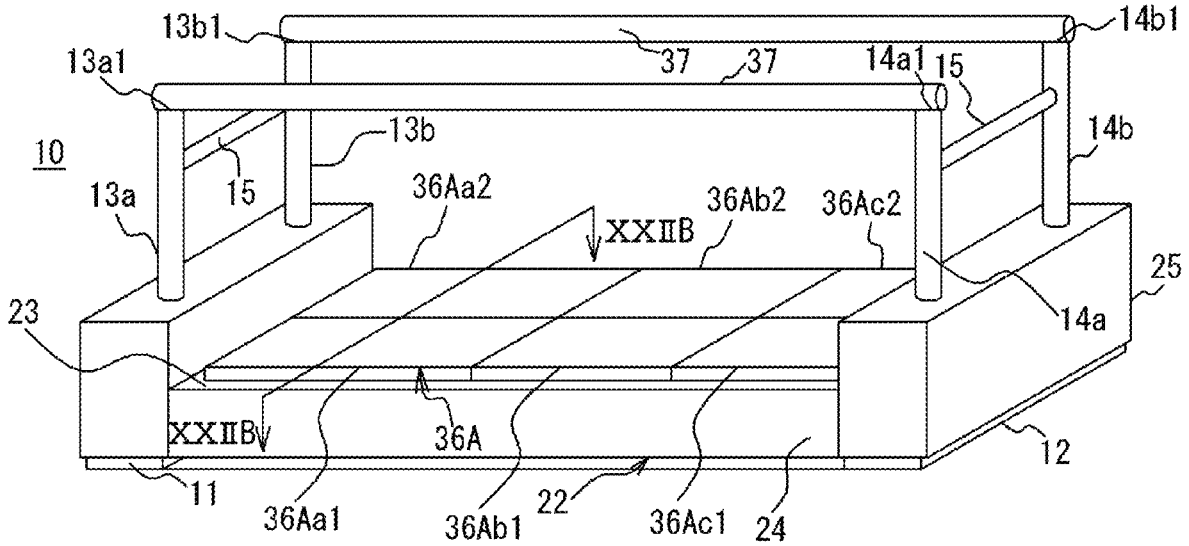
FIG. 22 shows a nursing-care device of a ninth variation, FIG. 22A being a perspective view, FIG. 22B being a sectional view along an XXIIB-XXIIB line of FIG. 22A, FIG. 22C being a sectional view corresponding to FIG. 22B and showing a mat standing state, FIG. 22D being a sectional view showing another step of standing a mat, and FIG. 22E being a sectional view corresponding to FIG. 22B and showing a mat housed state.
Figure 22B:
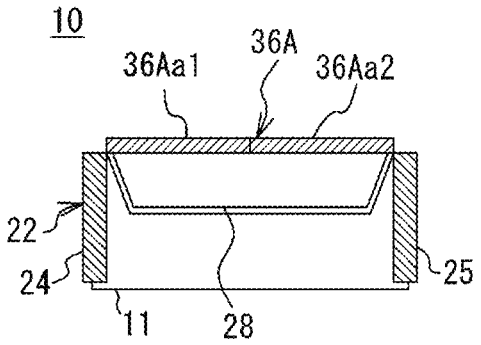

For example, the case where the mat 36 provided on the bed body 22 of the first embodiment is divided in three has been described, but the present invention is not limited to such a case and it can be configured such that the mat 36*a* is divided from a substantially center portion of the mat 36*a* in the traverse direction along the longitudinal direction as shown in FIGS. 22A and 22B. That is, the mat 36*a* includes a mat 36Aa, 36Ab, and 36Ac, and the mat 36Aa further includes a mat 36Aa1 and a mat 36Aa2. Moreover, the mat 36Ab also includes a mat 36Ab1 and a mat 36Ab2, and the mat 36Ac also includes a mat 36Ac1 and a mat 36Ac2.

Figure 22C:
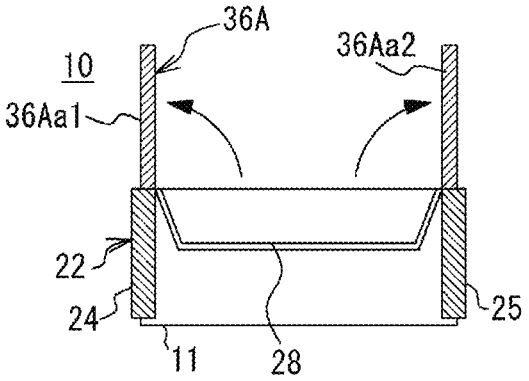
Figure 22D:
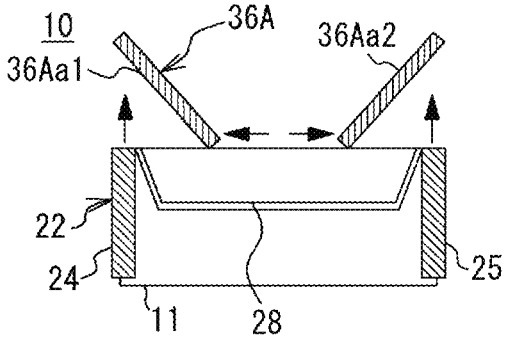

The mat 36*a* divided as described above can be configured to stand from the center portion about the longitudinal sides of the bed body 22 as shown in FIG. 22C. Note that FIG. 22C shows the mat 36Aa1 and the mat 36Aa2 of the mat 36Aa. The mat 36A (e.g., the mats 36Aa1, 36Aa2) stands, so that water splash can be reduced when the care-requiring person uses the water tank 28, for example.

As another standing method, portions of the mat 36Aa1 and the mat 36Aa2 of the mat 36Aa on a side portion 24 side and a side portion 25 side of the bed body 22 are moved upwardly, i.e., in a direction apart from the floor portion 23, and portions of the mat 36Aa1 and the mat 36Aa2 on a floor portion 23 side on the center side are slidably moved to the side portion 24 side and the side portion 25 side of the bed body 22. In this manner, each of the mat 36Aa1 and the mat 36Aa2 can stand substantially vertically.

Figure 22E:
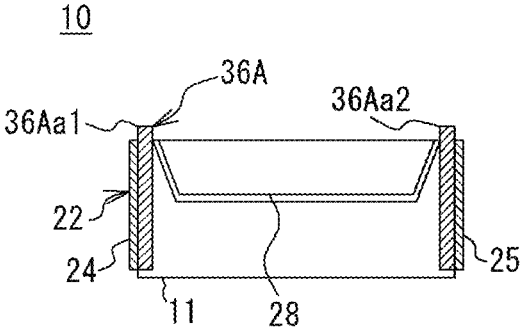

Further, as shown in FIG. 22E, the standing mat 36A (e.g., the mats 36Aa1, 36Aa2) may be housed inside the bed body 22 on the side portion 24 side and the side portion 25 side thereof.

[Tenth Variation]

Figure 23B:
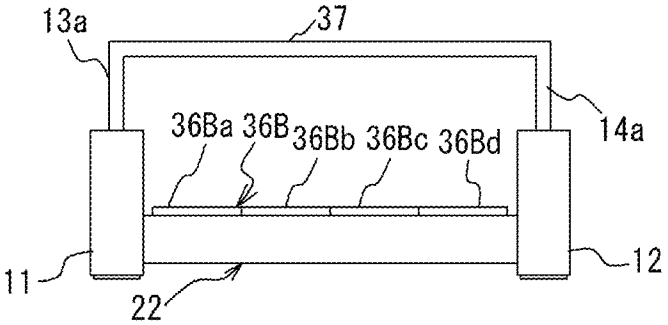

In the first embodiment, the case where the mat 36 is divided in three and these divided mats are formed with different sizes has been described, but the present invention is not limited to such a case. For example, as in a mat 36B shown in FIGS. 23A and 23B, the mat 36B may be divided in four, and mats 36Ba, 36Bb, 36Bc, 36Bd may be formed with an equal size.

In the case of using the reclining mechanism 38, it can be configured such that two (the mats 36Ba, 36Bb in the tenth variation) of the four divided mats are reclined.

With this configuration, the mats can be formed with the same shape, and therefore, manufacturing can be facilitated and the mats can be placed with no error.

Figure 24:
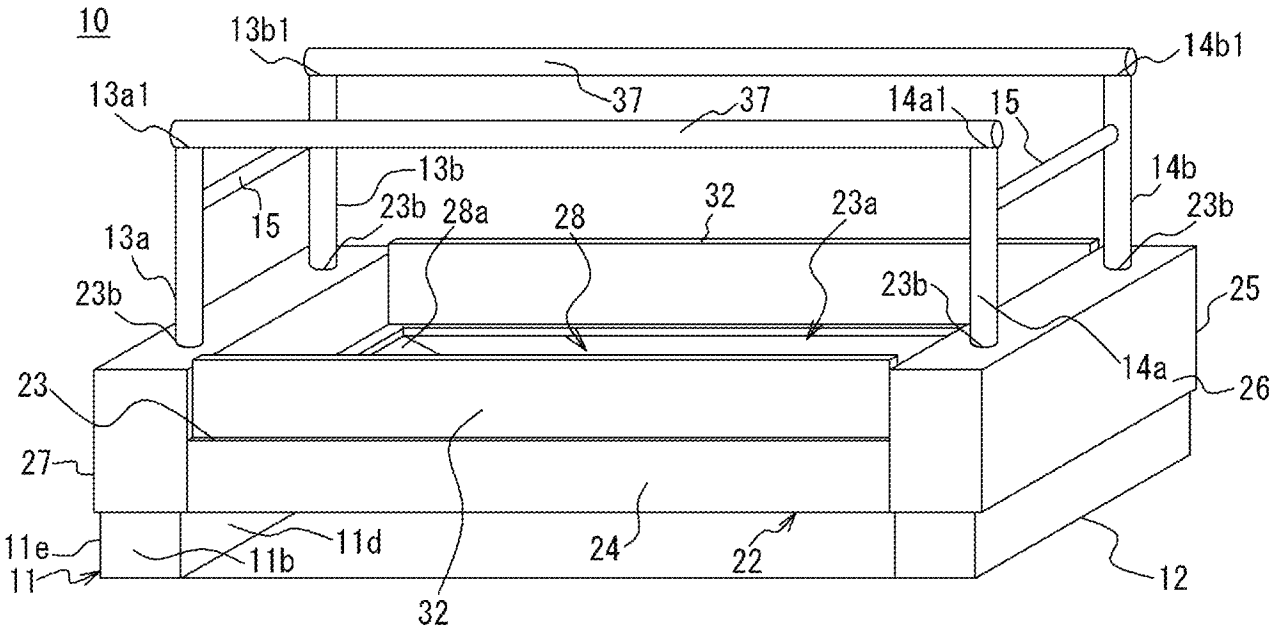
FIG. 24 is a perspective view of a nursing-care device provided with a fence member.

For example, in the nursing-care device 10 of the first embodiment, fence members 32 can be attached to the floor portion 23 of the bed body 22 on the side portion 24 side and the side portion 25 side for, e.g., prevention of fall of the care-requiring person from the bed body 22. In this case, as shown in FIG. 24, the fence member 32 can be formed as a plate-shaped body, and can be in a shape with a certain height such as a height at which water splashed when the care-requiring person uses the water tank 28 does not come out of the water tank 28. With this configuration, water splash when the care-requiring person uses the water tank can be reduced. It may be configured such that the fence member 32 is housed inside the bed body 22. Note that the fence member 32 is preferably formed with a size from the support base 11 on one side to the support base 12 on the other side.

[Eleventh Variation] Bed Body and Rod-Shaped Body Length Adjustment

For example, a nursing-care device 10J can be configured such that the length of the bed body 22 and the length of the rod-shaped body 37 on the upper side are adjustable according to the height of the care-requiring person targeted for use in the nursing-care device 10 of the first embodiment.

Figure 25A:
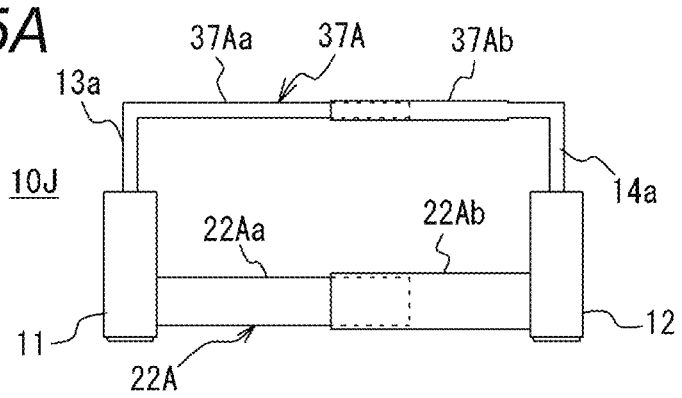
FIG. 25 shows a nursing-care device of an eleventh variation, FIG. 25A being a side view, FIG. 25B being a sectional view showing a state in which a bed body and a rod-shaped body are extended, and FIG. 25C being a side view showing a state in which the bed body and the rod-shaped body are contracted.

First, as the configuration in which the length of the bed body 22A of the nursing-care device 10J is adjusted, it can be configured such that a bed body 22A is divided in multiple portions, e.g., in two, and one bed body 22Aa is movable in or out of the other bed body 22Ab (also called an insert) as shown in FIG. 25A.

Figure 25B:
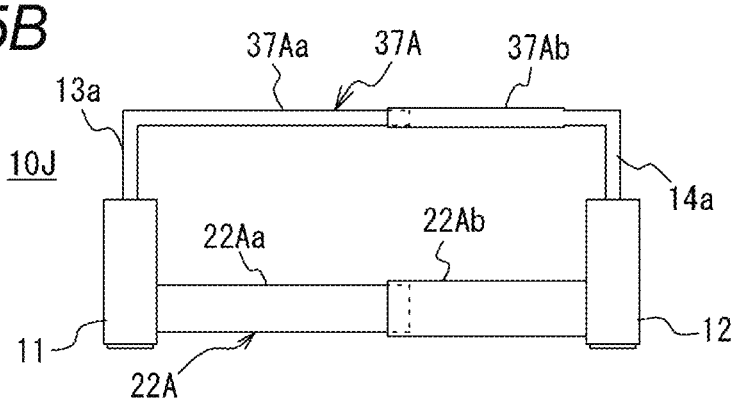

With this configuration, the bed body 22Ab on the other side can be pulled out of the bed body 22Aa on one side and the bed body 22A can be used in a long state as shown in FIG. 25B in a case where a care-requiring person with a high height uses the bed, for example. On the other hand, in a case where a care-requiring person with a low height uses the bed, the bed body 22Ab on the other side is drawn into the bed body 22Aa on one side by a predetermined length so that the bed body 22A can be used in a short state.

It is configured such that the length of the rod-shaped body 37A on the upper side is similarly adjustable at the same time as adjustment of the length of the bed body 22A.

Figure 25C:
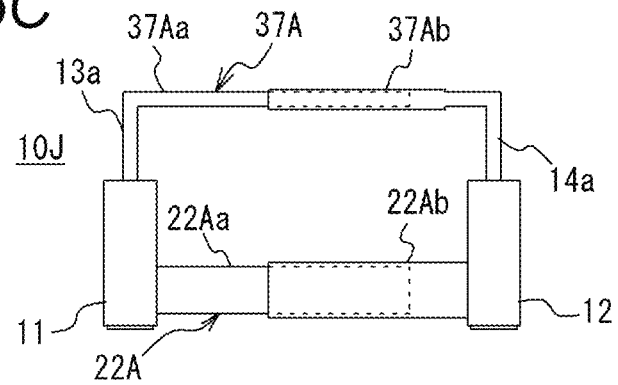

For adjustment of the length of a rod-shaped body 37A, it can be configured such that a rod-shaped body 37Ab on the other side is movable in or out of a rod-shaped body 37Aa on one side (see FIGS. 25A to 25C).

Note that the bed body and the rod-shaped body are not limited to the case of division in two, and may be divided in three or more.

After adjustment of the length of the bed body has ended, a water tank, a frame, and a mat corresponding to the adjusted length are used.

The case where, e.g., the hammock 80, 95, 98 is used as the lifting member has been described in the first embodiment etc., but the present invention is not limited to such a case and the sheet placed on the mat 36 can be used as in the hammock when the nursing-care device 10 is used as the bed.

Figure 26:
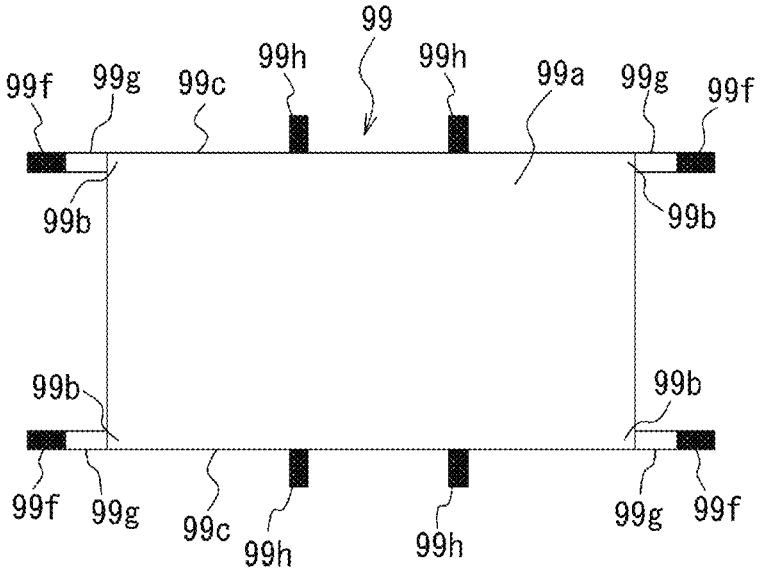
FIG. 26 is a plan view showing a hammock sheet.

As shown in FIG. 26, a hammock sheet 99 includes, for example, a planar portion 99*a* formed of a fabric member with such a size that the mat 36 on the bed body 22 is covered and ring portions 99*f* provided at corner portions 99*b* at four corners of the planar portion 99*a*. Note that in FIG. 26, the planar portion 99*a* and each ring portion 99*f* are connected to each other through a belt body 99*g*. Moreover, each ring portion 99*f* is, upon use, attached to a corresponding one of support rods 13*a*, 13*b*, 14*a*, 14*b* of the bed body 22, the beam members 15, the suspension members 250, the rod-shaped bodies 37, etc.

As described above, the sheet placed on the mat 36 is used as the hammock sheet 99 as in the hammock, so that the necessity of transferring the care-requiring person onto, e.g., another hammock 80 can be eliminated and movement and rehabilitation of the care-requiring person, reduction in bedsores, etc. can be easily achieved.

Side ring portions 99*h* may be provided at both side surfaces 99*c* of the planar portion 99*a* in a longitudinal direction thereof.

[Twelfth Variation]

For example, the shape of the bed body 22 of the first embodiment on the side portion 24, 25 side can be such a shape that the nursing-care equipment such as the wheelchair is not caught in between the lifting/lowering bed body 22 and the floor or it is safe even when the nursing-care equipment is caught.

Figure 27A:
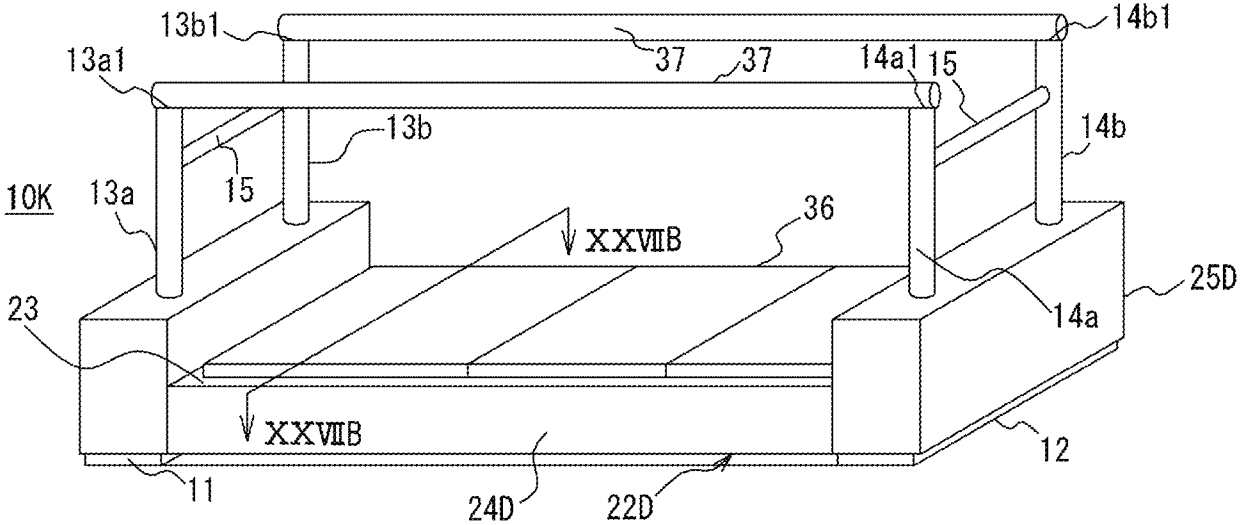
FIG. 27 shows a nursing-care device of a twelfth variation, FIG. 27A being a perspective view, FIG. 27B being a sectional view along an XXVIIB-XXVIIB line of FIG. 27A, FIG. 27C being a sectional view corresponding to FIG. 27B and showing another shape, and FIG. 27D being a sectional view corresponding to FIG. 27B and showing still another shape.
Figure 27B:
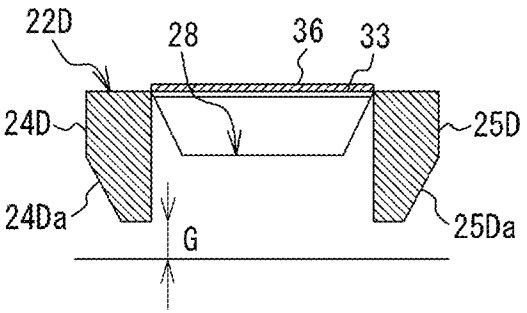

For example, as the shape of a side portion 24D, 25D of a bed body 22D of a nursing-care device 10K shown in FIG. 27A, it can be configured such that an inclined portion 24Da, 25Da inclined outward of the bed body 22D as extending upward of the floor side are formed as shown in FIG. 27B. With these inclined portions 24Da, 25Da, the caught wheelchair is pushed out along such inclination, and the probability of being caught by the bed body 22D is reduced. Further, for enhancing the safety, a distance G between the lower side of the side portion 24D, 25D of the bed body 22D, i.e., a surface opposite to the floor portion 23, and the floor is preferably equal to or shorter than about 45 cm. With such a distance G, the probability of, e.g., the nursing-care equipment or a medical tool such as the wheelchair being caught can be reduced.

Figure 27C:
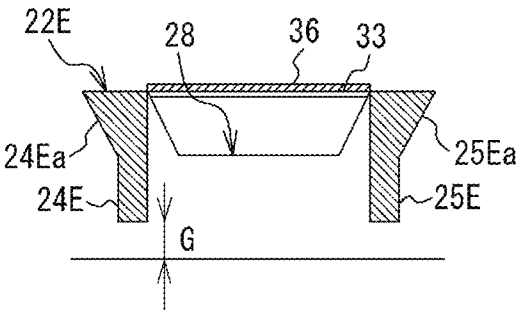

As another shape, an inclined portion 24Ea, 25Ea can be formed from the middle of a side portion 24E, 25E as in a bed body 22E shown in FIG. 27C. With these inclined portions 24Ea, 25Ea, the probability of, e.g., the wheelchair being caught can be reduced as described above. Further, for enhancing the safety, a distance G between the lower side of the side portion 24E, 25E of the bed body 22E, i.e., a surface opposite to the floor portion 23, and the floor is preferably equal to or shorter than about 45 cm as described above. With such a distance G, the probability of, e.g., the nursing-care equipment or the medical tool such as the wheelchair being caught can be reduced.

Figure 27D:
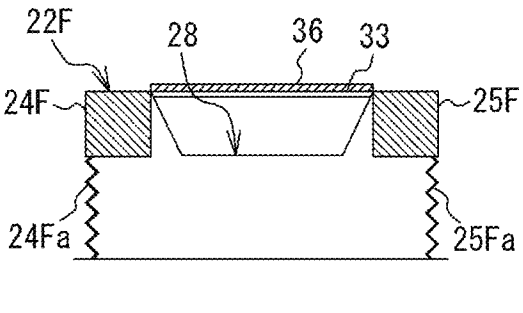

As still another configuration, an accordion-shaped curtain 24Fa, 25Fa can be provided below each side portion 24F, 25F of a bed body 22F as in a bed body 22F shown in FIG. 27D. With these accordion-shaped curtains 24Fa, 25Fa, entrance of the wheelchair etc. can be reduced, and the probability of the wheelchair being caught by the bed body 22F can be reduced. Note that the curtain 24Fa, 25Fa is formed in an accordion shape, so that the curtain 24Fa, 25Fa can be deformed according to lifting/lowering of the bed body 22F and the safety can be further enhanced without the curtain 24Fa, 25Fa being apart from the floor.

[Thirteenth Variation]

Figure 28B:
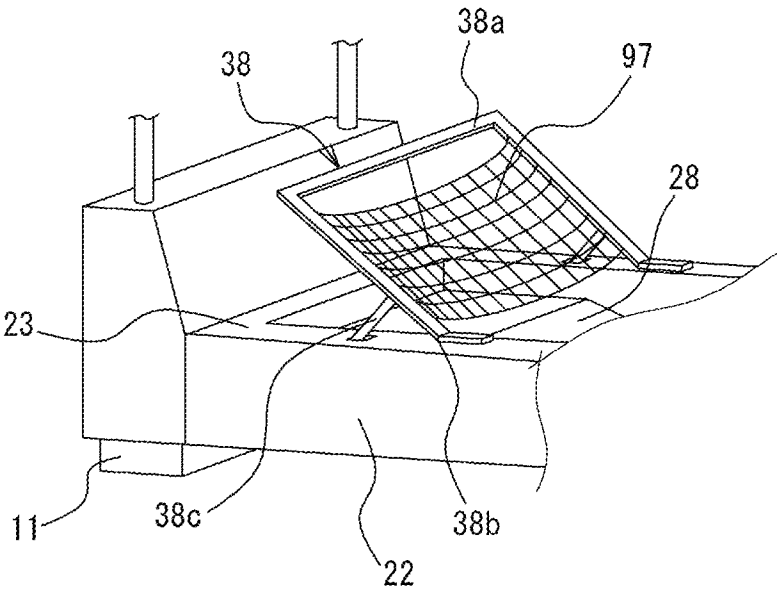
FIG. 28 shows a nursing-care device of a thirteenth variation, FIG. 28A being a partial perspective view in a state in which the reclining mechanism is not actuated and FIG. 28B being a partial perspective view in a state in which the reclining mechanism is actuated.
Figure 28A:
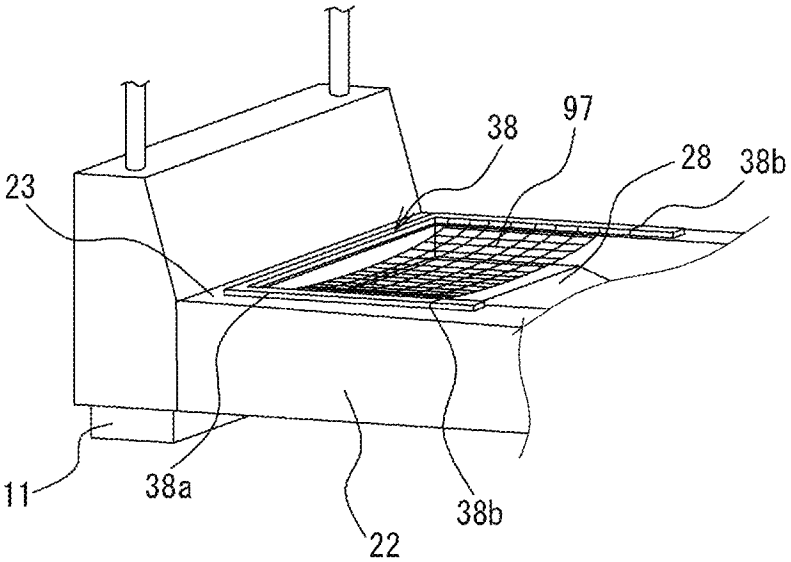

Using the reclining mechanism 38 described in the first embodiment, reclining can be performed such that an area of the care-requiring person from the head to the upper half of the body is supported during bathing when the care-requiring person uses the water tank 28 as a bathtub. That is, the frame 38*a* of the reclining mechanism 38 is covered with, e.g., a net member 97 as shown in FIG. 28A. In a state in which the care-requiring person is supported on the net member 97 during bathing, the reclining mechanism 38 is moved, and the frame 38*a* is moved about the shaft portions 38*b* by the shaft members 38*c* as shown in FIG. 28B. In this manner, reclining can be performed. With the net member 97 provided at the frame 38*a* as described above, reclining can be performed while the care-requiring person is bathing, the frame 38*a* can be effectively utilized, and the care-requiring person can easily sit up. In addition, a burden on the caregiver can be reduced. Note that the case of providing the net member 97 at the frame 38*a* has been described with reference to FIG. 28, but the present invention is not limited to such a case and a belt body, a duckboard, etc. can be used instead of the net member as long such a member can support the care-requiring person.

Figure 29B:
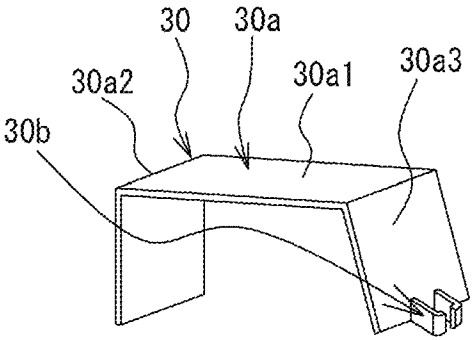
FIG. 29B is a perspective view showing the shower holder.
Figure 29A:
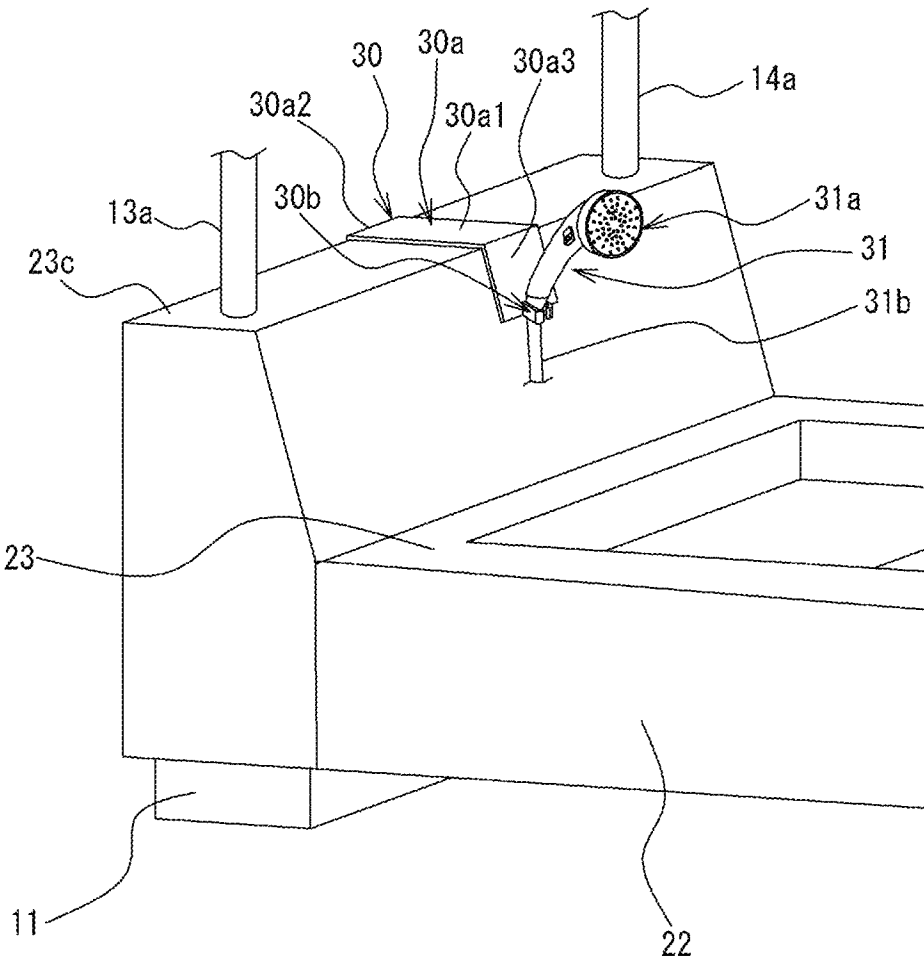
FIG. 29A is a partial perspective view showing a state in which a shower holder is placed at a head board.

For example, in a case where the shower is used in the water tank 28 in the nursing-care device 10 of the first embodiment as shown in FIG. 29A, a shower head holder 30 configured to fix a shower head 31*a* of a shower device 31 can be attached to an upper portion of the support base 11.

As shown in FIGS. 29A and 29B, the shower head holder 30 includes a head-board-side attachment portion 30*a* attached to a head board 23*c* and a holder portion 30*b* attached to the shower head 31*a*.

Note that the shower device 31 has the shower head 31*a* for showering and a hose portion 31*b* which is connected to the shower head 31*a* and to which liquid such as water or hot water is supplied. A pump device configured to send out the liquid or a water faucet (not shown in the figure) is connected to a tip end of the hose portion 31*b*.

The head-board-side attachment portion 30*a* of the shower head holder 30 includes an upper portion 30*a*1 formed in such a shape that the head-board-side attachment portion 30*a* can be hooked on an upper portion of the head board 23*c*, such as a backwards C-shape, and arranged on the upper portion of the head board 23*c*, one extending portion 30*a*2 extending to the opposite side of the head board 23*c* from the water tank 28, and the other extending portion 30*a*3 extending to a water tank 28 side and provided with the holder portion 30*b*.

In the case of using the shower, the head-board-side attachment portion 30*a* of the shower head holder 30 is hooked on the head board 23*c*, and thereafter, the shower head 31*a* is inserted into the holder portion 30*b* for attachment of the shower head 31*a*. Then, the liquid is sent from, e.g., the pump device to use the shower.

Note that the case where the shower head holder 30 is attached to a head board 23*c* side of the bed body 22 has been described with reference to FIG. 29, but the present invention is not limited to such a case and the shower head holder 30 may be attached to a foot board side.

[Fourteenth Variation]

For example, the water tank 28 used in the nursing-care device 10 of the first embodiment can be configured as shown in FIG. 30. That is, a water tank 28B of a nursing-care device 10L shown in FIGS. 30A and 30B includes a water tank support portion 28Ba supported on the bed body 22, water tank side portions 28Bb suspending downward of the periphery of the water tank support portion 287Ba, and a water tank bottom portion 28Bc provided at lower end portions of the water tank side portions 28Bb.

Figure 30A:
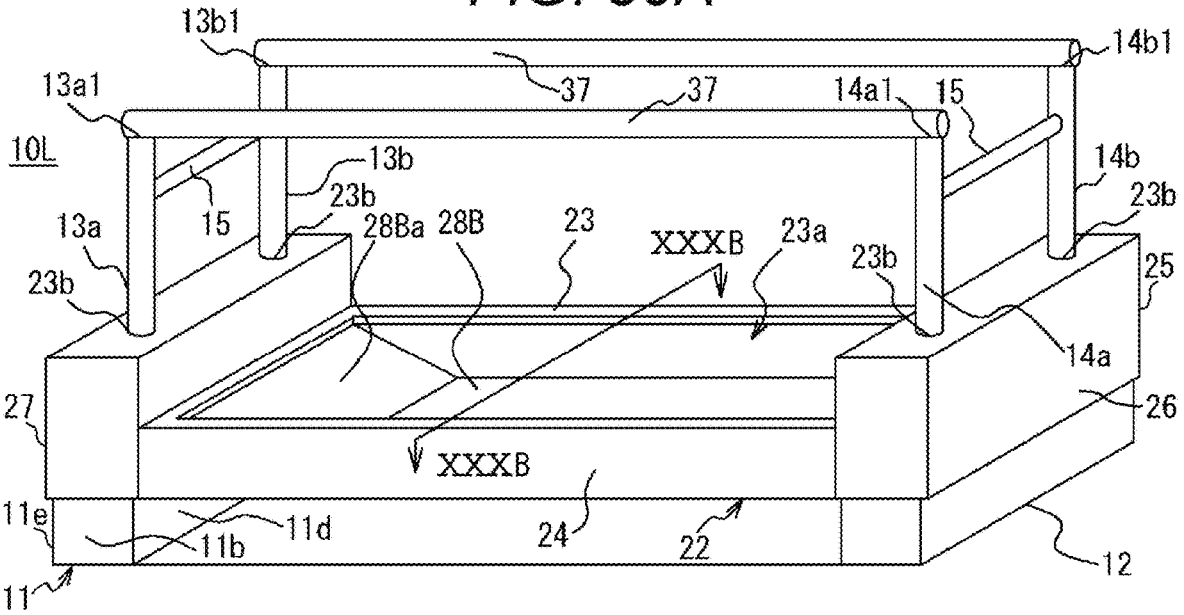
FIG. 30 shows a nursing-care device of a fourteenth variation, FIG. 30A being a perspective view, FIG. 30B being a sectional view shown along an XXXB-XXXB line of FIG. 30A and showing a state in which an accordion of a water tank is contracted, FIG. 30C being a sectional view corresponding to FIG. 30B and showing a state in which the accordion of the water tank is extended, FIG. 30D being a sectional view showing another configuration of the accordion of the water tank in a state in which the accordion is extended, and FIG. 30E being a sectional view showing a state in which the accordion of the water tank of FIG. 30D is extended.
Figure 30B:
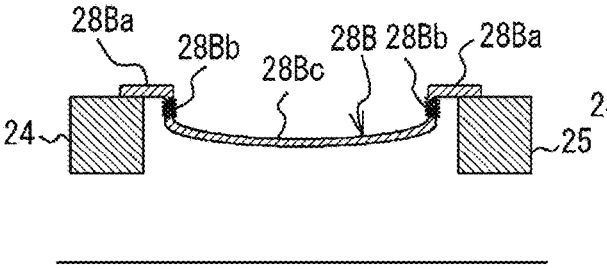
Figure 30C:
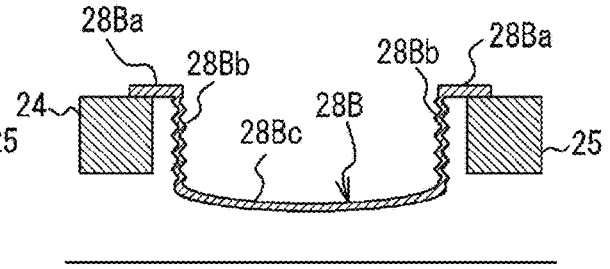

In the water tank 28B shown in FIG. 30B, the water tank side portions 28Bb are formed in an accordion shape. With this configuration, the water tank side portions 28Bb can be extended/contracted as shown in FIG. 30C and the water tank can be used as a deep water tank even in the case of a low bed body. Note that FIG. 30B shows a state in which the accordion of the water tank side portions 28Bb are contracted and FIG. 30C shows a state in which the accordion of the water tank side portions 28Bb are extended.

Figure 30D:
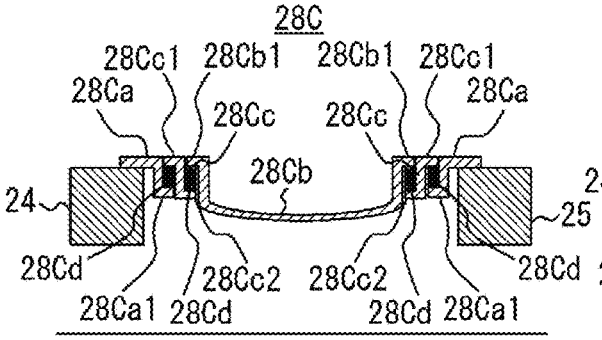
Figure 30E:
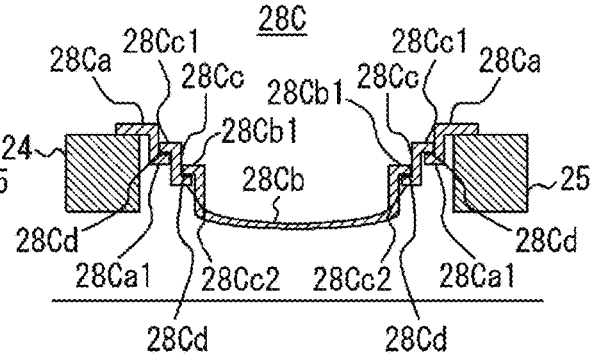

As the structure of another water tank 28C, it can be configured such that the water tank 28C is divided in multiple portions and these members are connected to each other through accordion-shaped extension/contraction members as shown in FIGS. 30D and 30E. That is, as shown in FIG. 30D, the water tank 28C has a pair of first water tank members 28Ca attached to the side portions 24, 25 of the bed body 22, a second water tank member 28Cb to be a bottom portion of the water tank 28C, and water tank connection members 28Cc connecting the first water tank members 28Ca to the second water tank member 28Cb. These members are connected to each other through extendable/contractable accordion members 28Cd. The side of the first water tank member 28Ca opposite to the side attached to the side portion 24, 25 has a first claw portion 28Ca1 suspending downwardly and subsequently extending in a perpendicular direction. The water tank connection member 28Cc is formed as a crank-shaped member having a second claw portion 28Cc1 locked to the first claw portion 28Ca1 and a third claw portion 28Cc2 suspending downward of the second claw portion 28Cc1 and subsequently extending in a substantially perpendicular direction. The second water tank member 28Cb includes fourth claw portions 28Cb1 provided on a water tank connection member 28Cc side and locked to the third claw portions 28Cc2 of the water tank connection members 28Cc and a bottom portion 28Cb2 of the water tank 28C. The first claw portion 28Ca1 of the first water tank member 28Ca and the second claw portion 28Cc1 of the water tank connection member 28Cc are connected to each other through the accordion member 28Cd, and the third claw portion 28Cc2 of the water tank connection member 28Cc and the fourth claw portion 28Cb1 of the second water tank member 28Cb are connected to each other through the accordion member 28Cd.

The second water tank member 28Cb and the water tank connection members 28Cc are moved upwardly in a state in which each accordion member 28Cd is extended as shown in FIG. 30D, and in this manner, the water tank 28C is compactly housed. Conversely, the second water tank member 28Cb and the water tank connection members 28Cc are moved downwardly in a state in which each accordion member 28Cd is contracted, and in this manner, the water tank 28C is brought into a usable state.

[Fifteenth Variation]

Figure 31A:
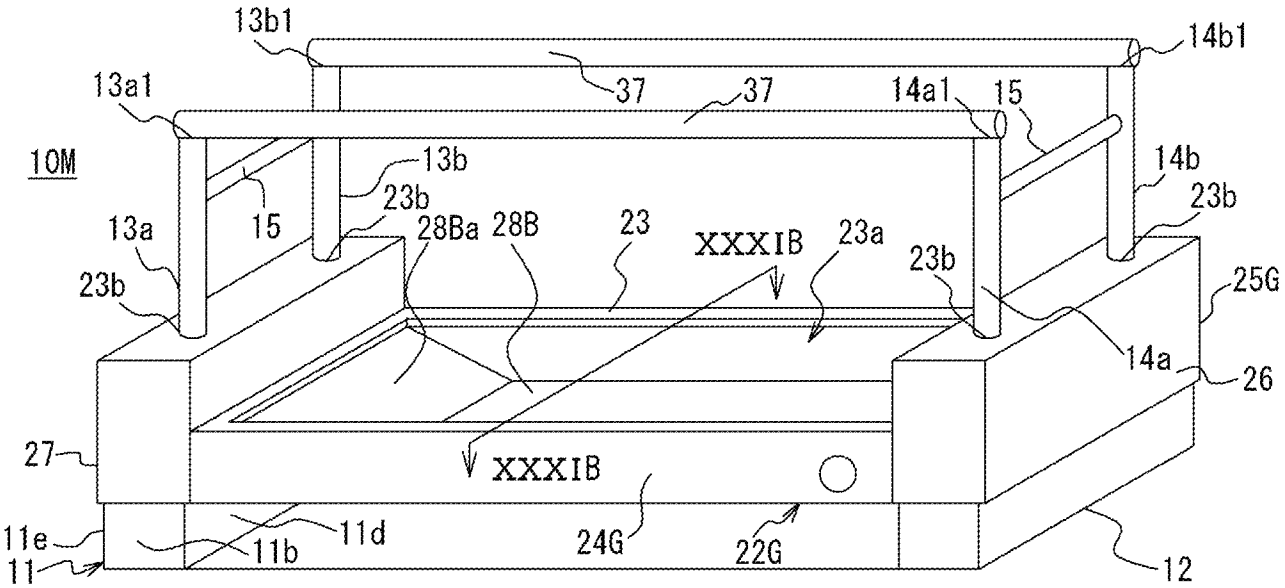
FIG. 31 shows a nursing-care device of a fifteenth variation, FIG. 31A being a perspective view and FIG. 31B being a sectional view along an XXXIB-XXXIB line of FIG. 31A.
Figure 31B:
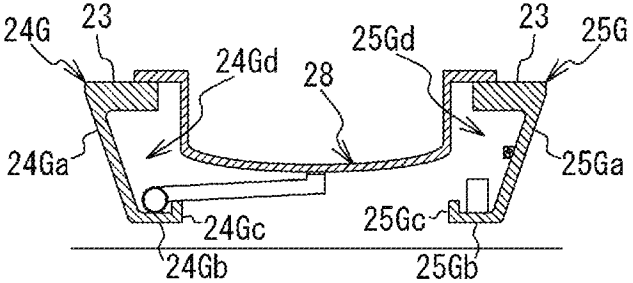

For example, the side portions 24, 25 of the bed body 22 forming the nursing-care device 10 of the first embodiment can be configured as in FIG. 31. That is, it is configured such that a space 24Gd is provided inside a side portion 24G of a nursing-care device 10M shown in FIG. 31A and hose portion 31*b*, i.e., on the side on which the water tank 28 is provided. The space 24Gd includes, at the side portion 24G, a suspending portion 24Ga suspending downward of the floor portion 23 and provided inclined to the water tank 28 side, an extending portion 24Gb extending inward, i.e., toward the water tank 28 side, of an end portion of the suspending portion 24Ga substantially in parallel with the floor portion 23, and a standing portion 24Gc standing upward, i.e., toward the floor portion 23, of an end portion of the extending portion 24Gb. A portion surrounded by the floor portion 23, the suspending portion 24Ga, the extending portion 24Gb, and the standing portion 24Gc is the space 24Gd. The space 24Gd is provided inside the side portion 24G of a bed body 22G as described above, so that goods necessary for a nursing care, a nursing-care device operation unit (a controller), a drain pipe, etc. can be placed in the space 24Gd and mess around the nursing-care device can be reduced. Note that the side portion 24G side has been described above as a representative, but a similar configuration can be employed for the side portion 25G on the opposite side. In this case, a space 25Gd is provided in a space surrounded by the floor portion 23, a suspending portion 25Ga, an extending portion 25Gb, and a standing portion 25Gc.

A hole reaching the space 24Gd or an opening of a slit may be formed at the extending portion 24Gb. As such an opening, hole-shaped openings or openings longer than the hole-shaped opening are provided at predetermined intervals at multiple locations. With this configuration, a wire, a pipe, a predetermined device, etc. arranged in the space 24Gd can be fixed with, e.g., a band from the bottom side of the extending portion 24Gb.

[Sixteenth Variation]

Figure 32A:
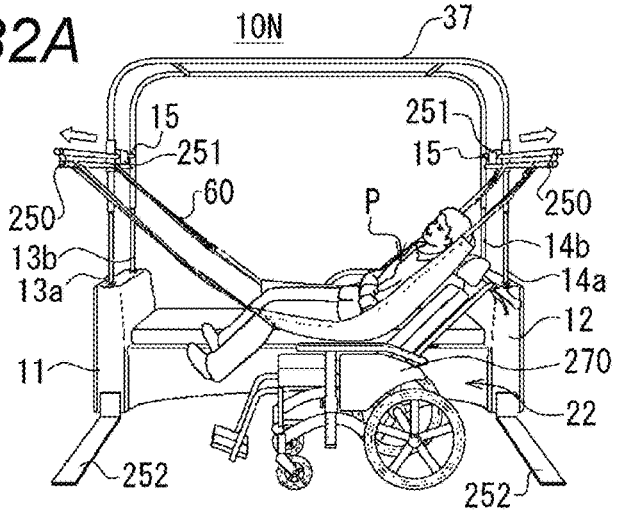
FIG. 32 shows a nursing-care device of a sixteenth variation, FIG. 32A being a perspective view showing part of operation when a care-requiring person is moved from a nursing-care bed to a wheelchair, FIGS. 32B to 32D being partially-enlarged views showing operation of a suspension member and a joint member, FIG. 32E being a sectional view along an XXXIIIB-XXXIIIB line of FIG. 32B, FIG. 32F being a sectional view corresponding to FIG. 32E and showing a state in which a switch is pressed, and FIGS. 32G and 32H being views showing another switch mechanism.
Figure 32B:
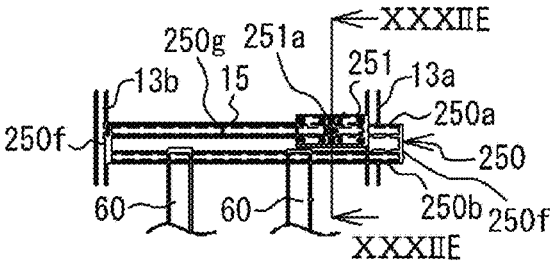
Figure 32C:
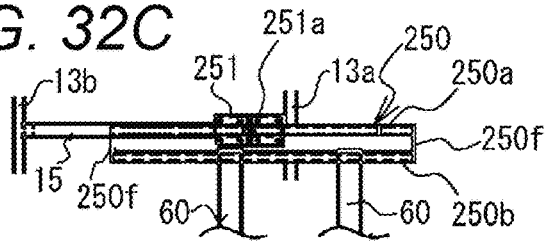
Figure 32D:
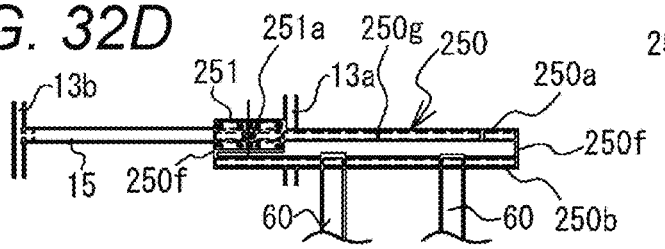

It has been described that the lifted care-requiring person is slidably moved to the position apart from the bed body 22 by means of the suspension members 250 and the joint members 251 as described in the third embodiment (see FIG. 32A). In this case, a configuration for stopping slide movement of the suspension members 250 in the middle may be added. That is, the switch mechanism 251*a* provided at the joint member 251 is fitted in a stop groove portion 250*g* formed at the slide bar 250*a* of the suspension member 250 as shown in FIGS. 32B to 32D, and in this manner, slide movement to the end with great force can be reduced. The switch mechanism 251*a* is operated again after temporal stop in the stop groove portion 250*g*, and in this manner, the remaining slide movement can be performed.

Figure 32E:
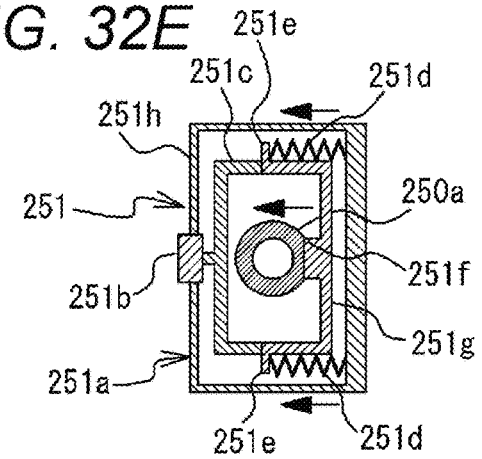
Figure 32F:
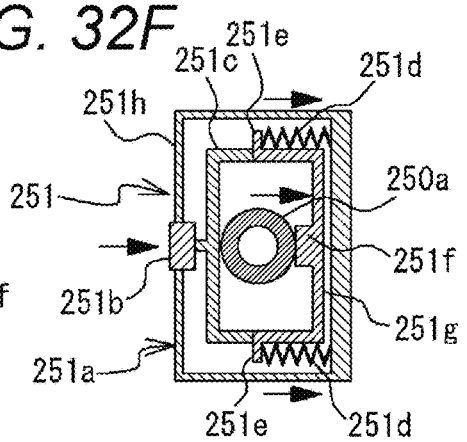

The structure of the switch mechanism 251*a* will be described with reference to FIGS. 32E and 32F. The switch mechanism 251*a* is included in a box 251*h* of the joint member 251. The switch mechanism 251*a* has a switch button 251*b* to be pressed by the user, a transmission member 251*c* to which pressing of the switch button 251*b* is transmitted, a spring body pressing portion 251*e* to be pressed by a spring body 251*d*, a locking portion 251*f* locked to the slide bar 250*a* of the suspension member 250, and a locking member 251*g* to be repeatedly moved according to movement of the transmission member 251*c*. In this case, in a state in which the switch button 251*b* is not pressed as shown in FIG. 32E, the locking member 251*g* is pressed to a slide bar 250*a* side by elastic force of the spring body 251*d*, and accordingly, the slide bar 250*a* is locked by the locking portion 251*f* and movement of the suspension member 250 is restricted. On the other hand, when the switch button 251*b* is pressed as shown in FIG. 32F, the transmission member 251*c* is moved by such pressing, and accordingly, the locking member 251*g* is moved against the elastic force of the spring body 251*d* and the locking portion 251*f* is separated from the slide bar 250*a*. Thus, movement of the suspension member 250 is allowed by unlocking.

Note that the switch mechanism is not limited to the configuration shown in FIGS. 32E and 32F, and a mechanism configured to hold a switch pressed state after the switch is pressed once can be also employed. In this case, it is configured such that the switch is pressed again to cancel the switch pressed state.

Figure 32G:
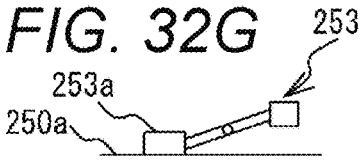
Figure 32H:
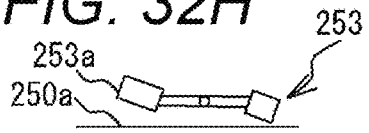

As the switch mechanism, a pressure-contact switch 253 may be provided as shown in FIGS. 32G and 32H. According to the pressure-contact switch 253, a state in which a pressing member 253*a* is separated from the slide bar 250*a* is held after the switch is pressed once, and movement of the suspension member 250 can be performed without stop. Thus, with the pressure-contact switch 253, the fixed suspension member 250 on one side is released and the suspension member 250 on the other side is operated, and in this manner, both suspension members 250 are easily moved at the same time. For stopping movement of the suspension members 250, the pressing member 253*a* presses the slide bar 250*a* in such a manner that the pressure-contact switch 253 is pressed again, and therefore, movement of the suspension member 250 can be restricted.

[Seventeenth Variation]

Figure 33A:
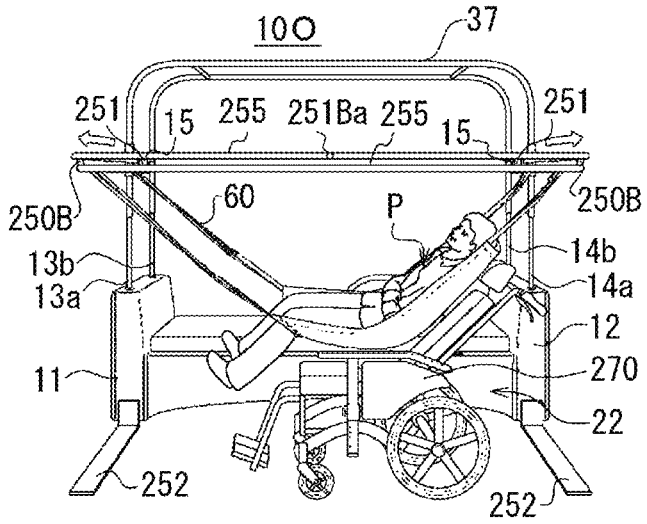
FIGS. 33A and 33B are perspective views showing a nursing-care device of a seventeenth variation.
Figure 33B:
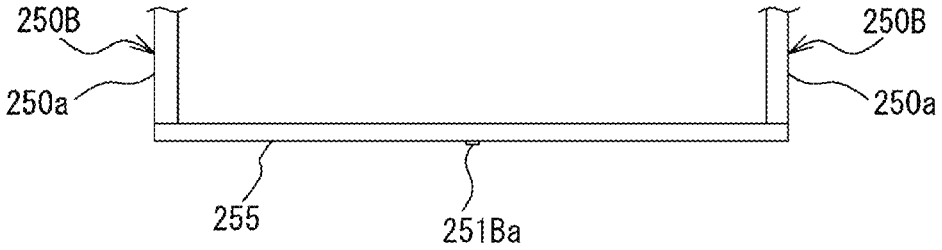

In the nursing-care device 10D of the third embodiment, the suspension members 250 and the joint members 251 are provided on both of one support base 11 side and the other support base 12 side, and therefore, these members are actuated independently. In a nursing-care device 100 shown in FIGS. 33A and 33B, a connection member 255 connecting an end portion of a suspension member 250B on one support base 11 side and an end portion of a suspension member 250B on the other support base 12 side to each other is provided. Moreover, a switch mechanism 251Ba is provided at the connection member 255. The switch mechanism 251Ba is configured such that the suspension member 250B on one support base 11 side and the suspension member 250B on the other support base 12 side can be simultaneously brought into a movable state by switch operation. With this configuration, both suspension members 250B can be simultaneously moved by the single caregiver, and the caregiver can easily provide a care.

Note that as the method for simultaneously moving the suspension member 250B on one support base 11 side and the suspension member 250B on the other support base 12 side, drive can be controlled using a motor.

Figure 34C:
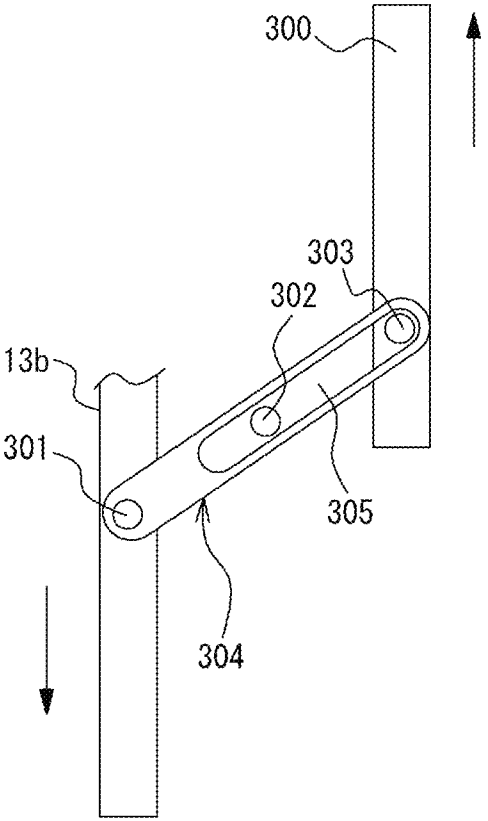
FIGS. 34A to 34C are schematic views showing a link mechanism.

A cooperation relationship between another bed body 22 and each of the support rods 13*a*, 13*b*, 14*a*, 14*b* will be described with reference to FIG. 34. Note that FIG. 34 shows a partially-enlarged view and cooperation between the support rod 13*b* and the bed body 22 will be described.

A bed-side lifting/lowering member 300 connected to the bed body 22 is a member to be vertically moved according to movement of the actuator configured to lift/lower the bed body 22. A cooperation member 304 is provided between the bed-side lifting/lowering member 300 and the support rod 13*b*. The cooperation member 304 is fixed with a rotary shaft portion 301 on a support rod 13*b* side, and a fixed shaft portion 302 is provided between the support rod 13*b* and the bed-side lifting/lowering member 300. A lifting/lowering shaft portion 303 is provided on a cooperation member 304 side at the bed-side lifting/lowering member 300. At the cooperation member 304, the rotary shaft portion 301 on the support rod 13*b* side and a long movement groove portion 305 in which both of the fixed shaft portion 302 and the lifting/lowering shaft portion 303 are fitted is provided.

Figure 34B:
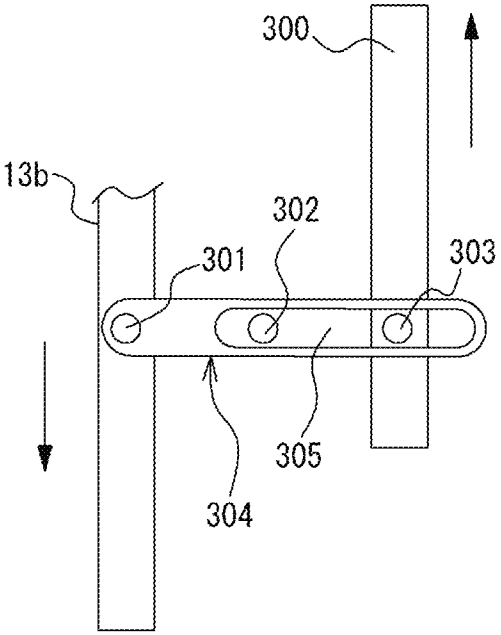
Figure 34A:
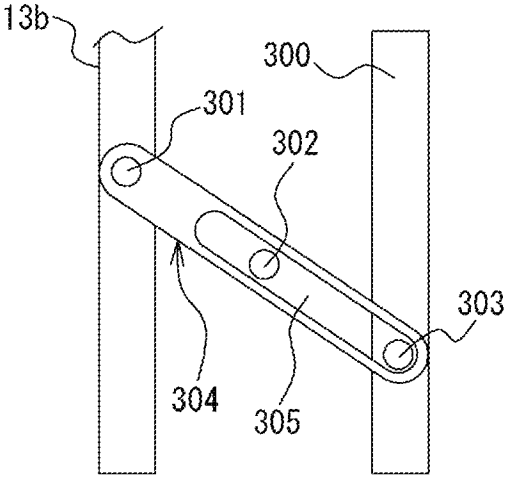

Each member is arranged as shown in FIG. 34A, and the bed-side lifting/lowering member 300 on the bed body 22 side is arranged on the lower side and the support rod 13*b* is arranged on the lower side.

Thereafter, when the actuator on the bed body 22 side is actuated to move the bed body 22 and the bed-side lifting/lowering member 300 upwardly, the lifting/lowering shaft portion 303 of the bed-side lifting/lowering member 300 is, as shown in FIG. 34B, lifted to rotate the cooperation member 304 about the fixed shaft portion 302 and rotate the cooperation member 304 about the rotary shaft portion 301 on the support rod 13*b* side. Accordingly, the support rod 13*b* is moved downwardly.

When the actuator of the bed body 22 is further actuated, the cooperation member 304 is further rotated about the fixed shaft portion 302 to move the bed-side lifting/lowering member 300 of the bed body 22 upwardly and move the support rod 13*b* downwardly.

The rotary shaft portion 301 is provided at the support rod 13*b* as described above, so that the cooperation member 304 can be rotated without the cooperation member 304 protruding outward of the bed body 22 upon rotation of the cooperation member 304.

[Eighteenth Variation]

Figure 35:
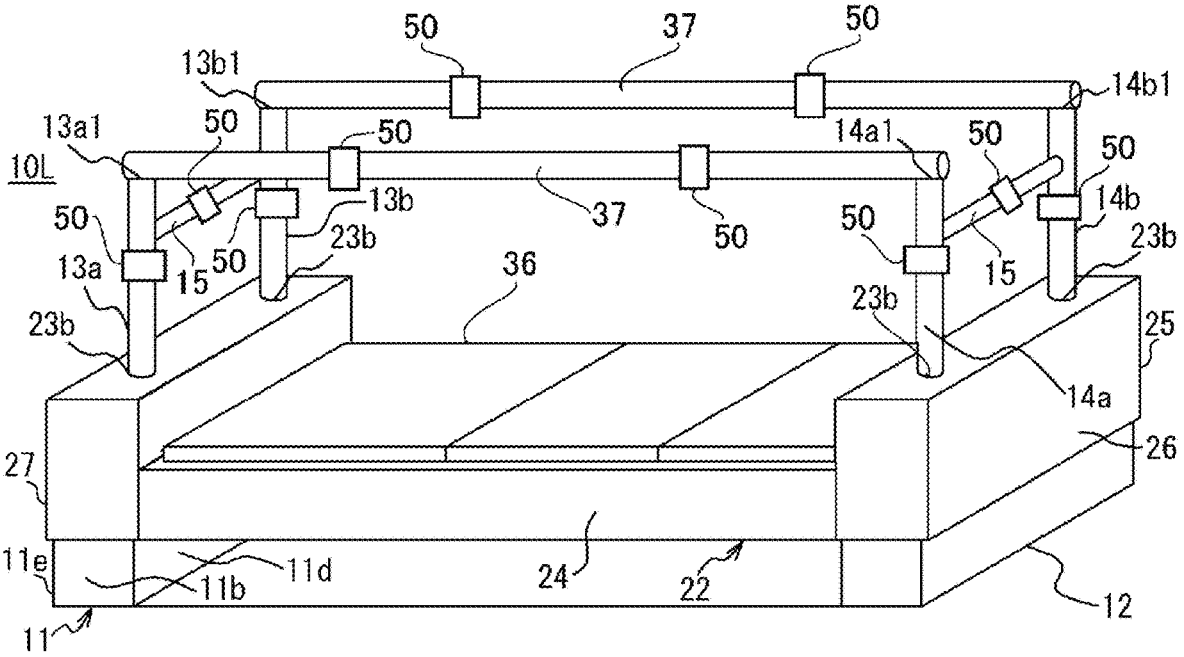
FIG. 35 is a perspective view showing sensor arrangement.

A variation in which sensors 50 are provided at the support rods 13*a*, 13*b*, 14*a*, 14*b*, the beam members 15, and the rod-shaped bodies 37 will be described with reference to FIG. 35. FIG. 35 is a perspective view showing arrangement of the sensors. As the sensors 50, various sensors such as an image sensor, an infrared sensor, an acceleration sensor, a gyro sensor, a temperature sensor, and a humidity sensor can be employed, for example. With various sensors 50, the posture, operation, state, etc. of the care-requiring person are detected, and according to these detection results, the preferable posture, height, operation, etc. of the bed for the care-requiring person can be automatically determined to properly control each portion of the bed. For example, there is the risk of bedsores in a case where the care-requiring person is in the same posture for a certain time or longer, and for this reason, the angle of the bed body 22 is inclined or the amount of lift-up of each belt body of the hammock is adjusted in the case of using the hammock, so that the posture of the care-requiring person can be changed comfortably. For example, in a case where it is detected that the care-requiring person attempts to sit up, the reclining mechanism is actuated, so that adjustment can be performed to obtain the desired angle of the upper body of the care-requiring person. Note that although the number, type, and arrangement of the sensors are not specifically limited, the sensors 50 can be fixed to the support rods 13*a*, 13*b*, 14*a*, 14*b*, the beam members 15, and the rod-shaped bodies 37, and therefore, each sensor 50 can stably properly detect the state of the care-requiring person. Moreover, a movable sensor can be used as the sensor 50.

The sensors 50 may detect not only the state of the care-requiring person but also the posture, motion, state, etc. of the caregiver and the shape, position, etc. of an object around the bed, such as the wheelchair. With this configuration, a control device can grasp nursing-care motion necessary for the care-requiring person from the states of the caregiver, the care-requiring person, and the object around the bed, and can properly control operation of each portion of the bed such that the burden on the caregiver is reduced while a posture comfortable for the care-requiring person is maintained. The control device can have a learning function such as mechanical learning to control each portion of the bed as desired according to the characteristics and preference of each care-requiring person. In a case where the control device has a communication function, a nursing care necessary for the care-requiring person can be properly provided at the right time by means of a computer network and information in various databases, considering, e.g., a nursing-care schedule including other care-requiring persons, an event, a season, and a weather. Further, a situation on a caregiver side can be also taken into consideration, and therefore, the burden on the caregiver can be significantly reduced. At, e.g., a nursing-care facility or a hospital, a nursing-care efficiency can be improved across the entirety of the nursing-care facility or the hospital, and a finer comfortable nursing care can be provided.

Fourth Embodiment

Figure 36:
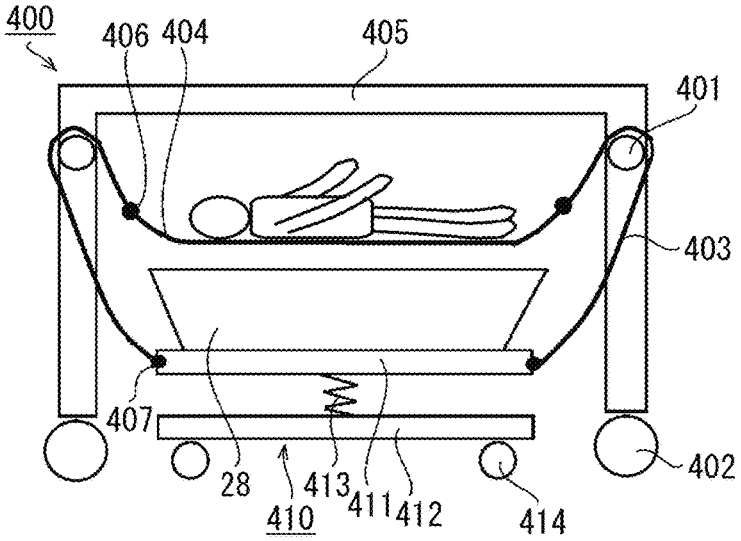
FIG. 36 is a view for describing a belt drive device of a fourth embodiment.
Figure 37:
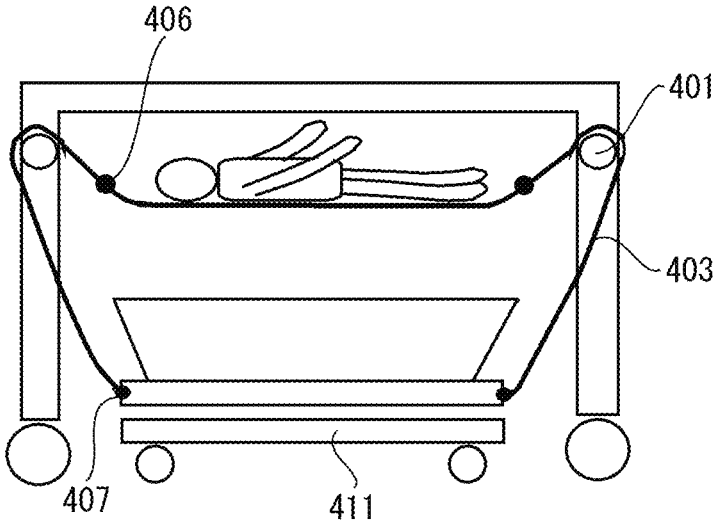
FIG. 37 is a view for describing a state when a hammock of FIG. 36 is at a high position.

An invention according to a fourth embodiment of the present application will be described with reference to FIGS. 36 and 37. FIG. 36 is a view for describing a belt drive device of the fourth embodiment. FIG. 37 is a view for describing a state when a hammock of FIG. 36 is at a high position.

The belt drive device 400 includes belt hooking portions 401 on which a belt 403 is hooked, a support body 405, and casters 402. On the other hand, a lifting/lowering base drive device 410 includes a lifting/lowering base 411, a base 412, an actuator 413, and casters 414. Both ends of the belt 403 are detachably connected to the lifting/lowering base 411 through belt connection portions 407. The hammock 404 is fixed to a center portion of the belt 403 by, e.g., a pair of hammock connection portions 406. Connection between the hammock 404 and the belt 403 is not specifically limited, and various structures such as a structure in which both ends of the hammock 404 are connected to the hammock connection portions 406 at two locations on the single belt, a structure in which two locations at end portions of the hammock 404 on each of the right and left sides, i.e., four locations in total, are connected using two belts, and a structure in which both ends of the hammock 404 are connected to end portions of two belts on one side and end portions of both belts on the other side are connected to the belt connection portions 407 can be employed. The belt is not limited to a single belt, and may be multiple belts. Moreover, the belt connection portion 407 has such a structure that the belt is easily attached to or detached from the belt connection portion 407. The height of the hammock 404 is changed through the belt according to lifting/lowering of the lifting/lowering base 411. When the lifting/lowering base 411 is at a high position, the hammock 404 is at a low position (see FIG. 36). Conversely, when the lifting/lowering base 411 is at a low position, the hammock 404 is at a high position (see FIG. 37). As the actuator 413 configured to drive the lifting/lowering base 411, various actuators such as an electric actuator, a hydraulic actuator, a pneumatic actuator, and a water hydraulic actuator can be used. Note that the example where a water tank 28 is placed on the base 411 has been described in the present embodiment, but the present embodiment is not limited to such an example and the base 411 is applicable to, e.g., a bed, a chair, a wheelchair, and a stretcher.

In FIG. 36, the water tank 28 is separatable from the lifting/lowering base 411. Moreover, the belt drive device 400 and the lifting/lowering base drive device 410 are separately configured. As described above, the belt connection portion 407 easily detachably connects the belt, and therefore, delivery and handling of both devices 400, 410 are facilitated. Note that the casters 402, 414 etc. are provided so that each device can be easily delivered, but can be omitted in the case of using each device in a fixed manner. In the present embodiment, the belt 403 drives the hammock 404 in cooperation with the lifting/lowering base 411, and therefore, an interval between the lifting/lowering base 411 and the hammock 404 can be substantially twice as long as that in the case of using only a typical lifting/lowering bed.

[Variation 4-1]

Figure 38:
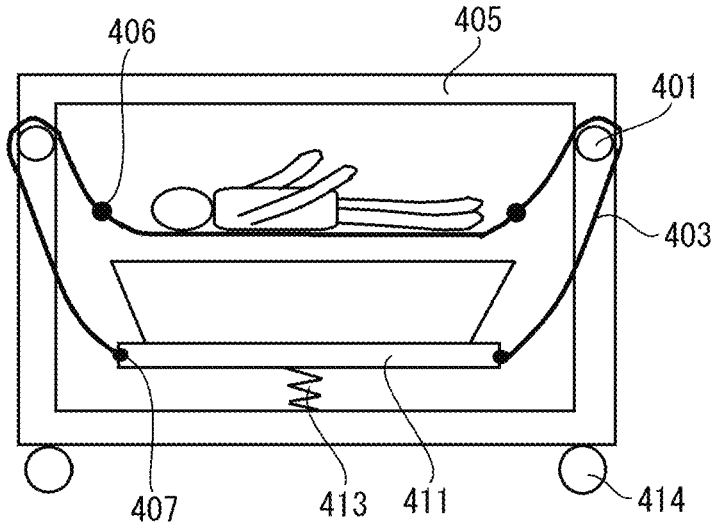
FIG. 38 is a view for describing a first variation of the fourth embodiment.

An invention according to Variation 4-1 of the present embodiment will be described with reference to FIG. 38. FIG. 38 is a view for describing Variation 4-1 of the fourth embodiment. In Variation 4-1, the lifting/lowering base drive device 410 and the belt drive device 400 can be integrated. With this configuration, the number of components can be reduced, and stiffness can be easily enhanced.

[Variation 4-2]

Figure 39:
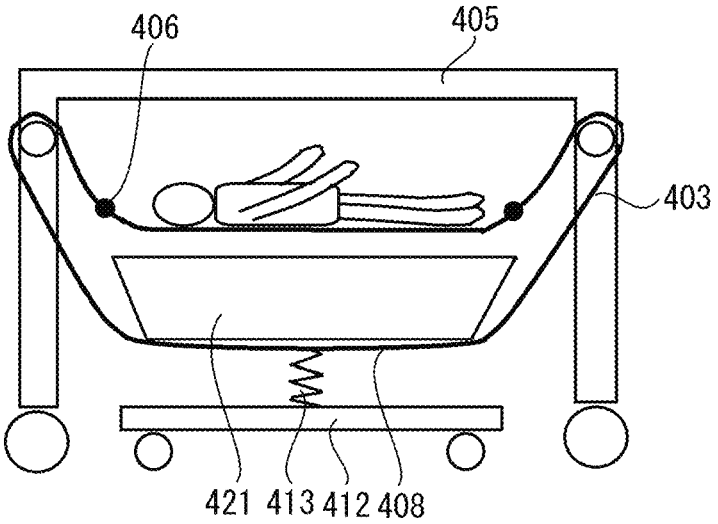
FIG. 39 is a view for describing a second variation of the fourth embodiment.

An invention according to Variation 4-2 of the present embodiment will be described with reference to FIG. 39. FIG. 39 is a view for describing Variation 4-2 of the fourth embodiment. As a lifting/lowering bed 420, one dedicated to the belt drive device 400 is not necessary, and a versatile lifting/lowering bed such as a commercially-available bed can be utilized. The belt 403 is engaged with a floor portion engagement portion 408 below the lifting/lowering bed, and therefore, can cooperate with drive of a floor portion 421 and can drive the hammock 404.

[Variation 4-3]

Figure 40:
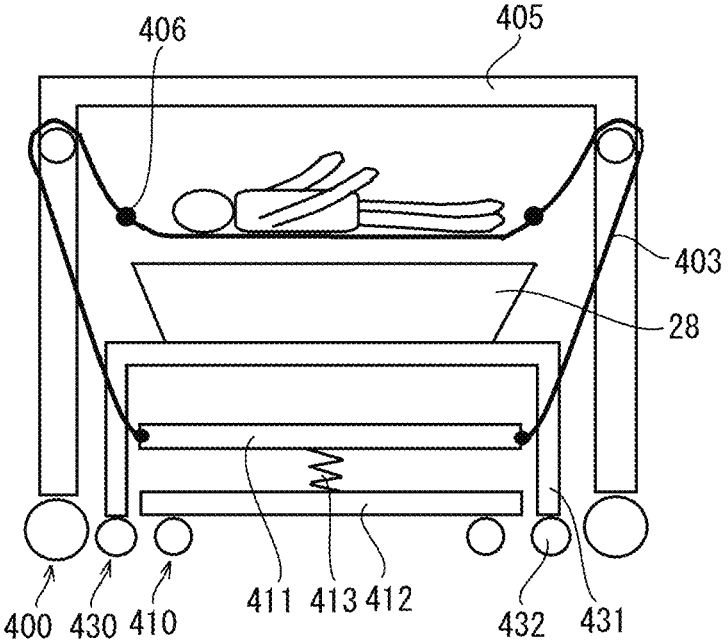
FIG. 40 is a view for describing a third variation of the fourth embodiment.

An invention according to Variation 4-3 of the present embodiment will be described with reference to FIG. 40. FIG. 40 is a view for describing Variation 4-3 of the fourth embodiment. Arrangement can be made such that a water tank fixing device 430 with a fixed height of a water tank 28 is provided between the belt drive device 400 and the lifting/lowering base drive device 410. With this configuration, a care-requiring person P is lifted/lowered using an optional water tank 28 such as a commercially-available water tank so that labor in a bathing care can be saved.

Fifth Embodiment

Figure 41:
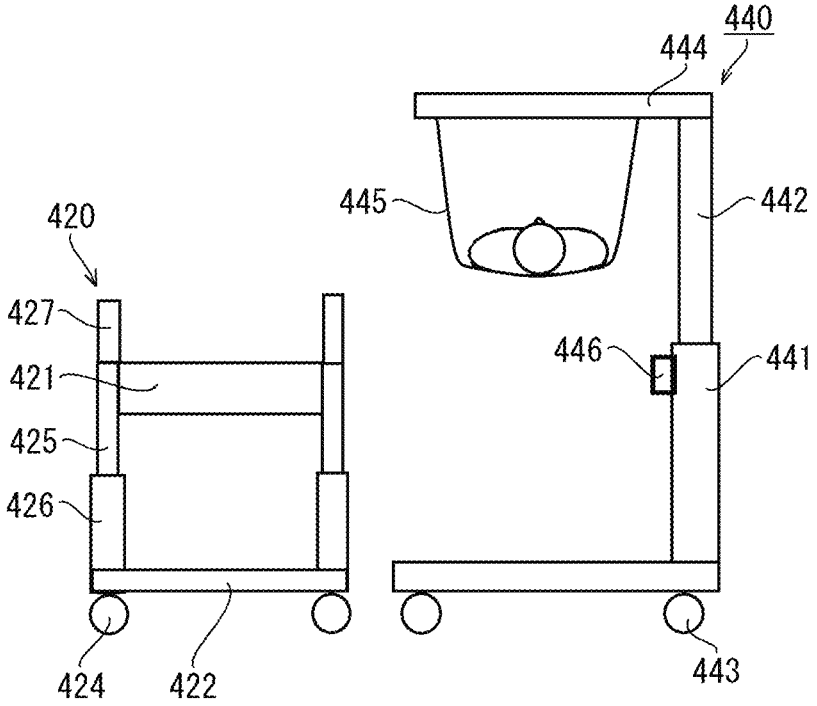
FIG. 41 is a view for describing a hammock lifting/lowering device of a fifth embodiment.
Figure 42:
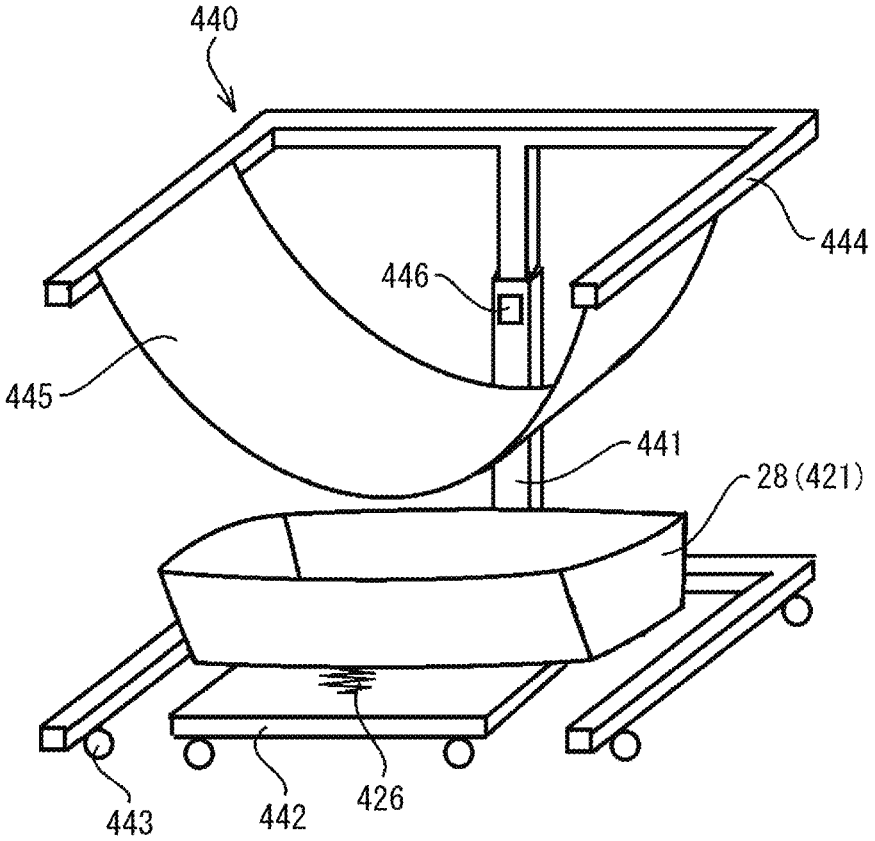
FIG. 42 is a perspective view of FIG. 41.
Figure 43:
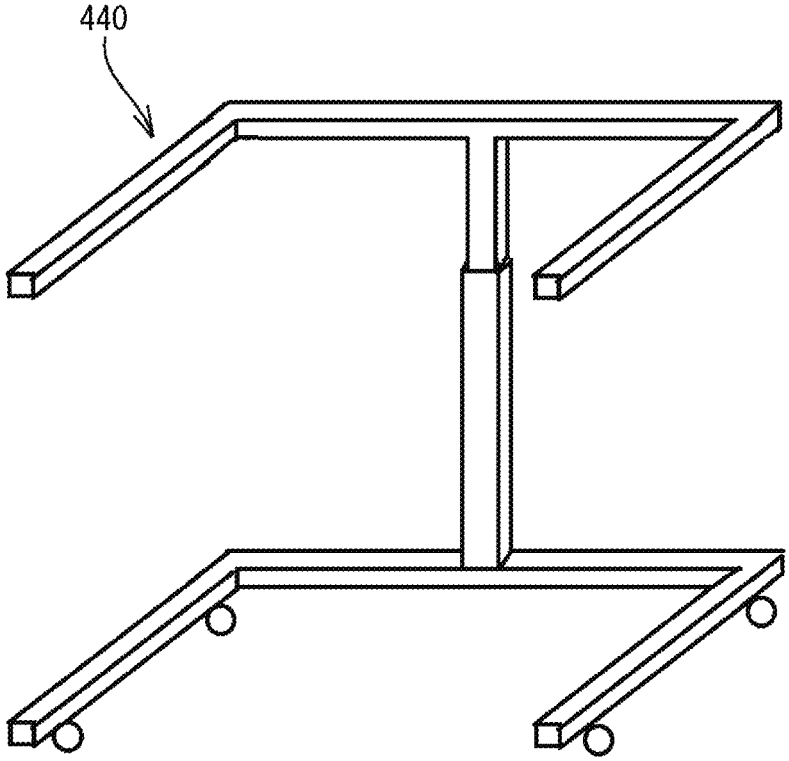
FIG. 43 is a partial perspective view of the hammock lifting/lowering device of FIG. 41.

An invention according to a fifth embodiment of the present application will be described with reference to FIGS. 41 to 43. FIG. 41 is a view for describing a hammock lifting/lowering device of the fifth embodiment, FIG. 42 is a perspective view of FIG. 41, and FIG. 43 is a partial perspective view of the hammock lifting/lowering device of FIG. 41. The hammock lifting/lowering device 440 includes a support base 441, a lifting/lowering portion 442, casters 443, a hammock attachment portion 444, a hammock 445, and a sensor 446. The lifting/lowering portion 442 is lifted/lowered by an actuator provided in the support base 441, thereby lifting/lowering the hammock 445. The lifting/lowering bed 420 is provided separately from the hammock lifting/lowering device 440, and includes a floor portion 421, a support rod 425, a support rod actuator 426, a base 422, casters 424, and a frame 427.

The hammock lifting/lowering device 440 is movable relative to the lifting/lowering bed 420 in a right-left direction of FIG. 41, and can deliver a care-requiring person P from another location to the lifting/lowering bed or can transfer the care-requiring person P from the lifting/lowering bed to another location. When the care-requiring person is above the lifting/lowering bed, the lifting/lowering bed is lifted and the hammock 445 is lowered, and in this manner, the care-requiring person P can lie on the floor portion 421. On the other hand, the lifting/lowering bed is lowered and the hammock is lifted, and in this manner, the care-requiring person P can be lifted from the floor portion 421 (hereinafter sometimes referred to as "reverse operation"). The sensor 446 can detect the height of the floor portion 421 of the lifting/lowering bed 420, and therefore, according to lifting/lowering of the lifting/lowering bed, the height of the hammock 445 of the hammock lifting/lowering device 440 can be automatically controlled so that the reverse operation can be performed.

For enhancing the stiffness of the hammock attachment portion 444 and the lifting/lowering portion 442, these components are firmly integrated, e.g., integrally molded. Note that in some cases, the operation of lifting/lowering the care-requiring person P can be performed only by the operation of lifting/lowering the hammock lifting/lowering device 440 or the lifting/lowering bed 420. Determination on whether the operation of lifting/lowering only the hammock lifting/lowering device 440, the operation of lifting/lowering only the lifting/lowering bed 420, or the reverse operation of both devices is to be employed is made from, e.g., a dimensional relationship among the care-requiring person P, the floor portion 421, the hammock 445, etc. and the drive distance of each device. For example, it is effective to perform the reverse operation of both devices in a case where long movement distances of both devices 440, 420 cannot be taken,

[Variation 5-1]

Figure 44:
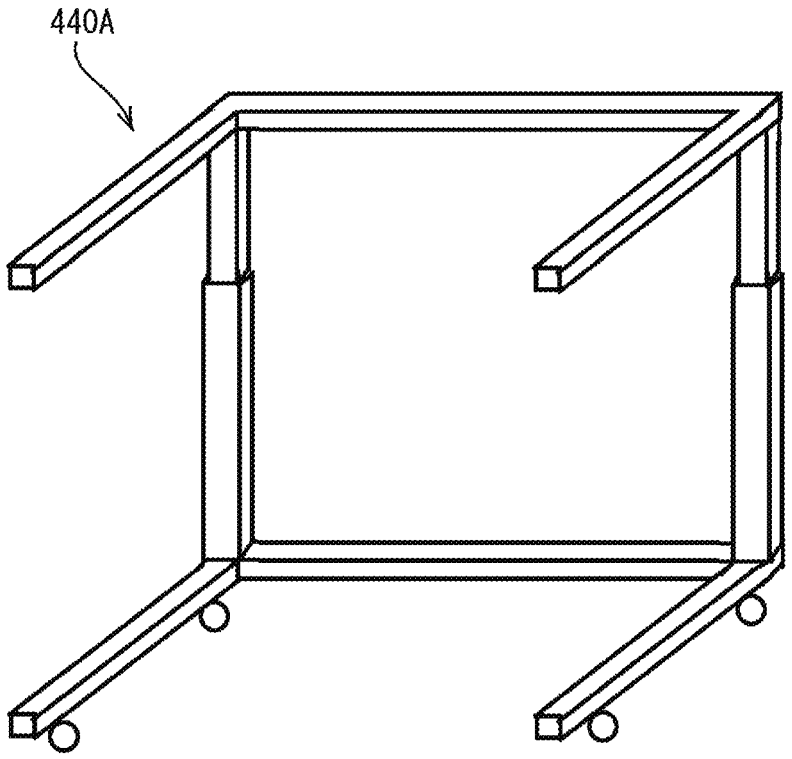
FIG. 44 is a view for describing a first variation of the fifth embodiment.

An invention according to Variation 5-1 of the present embodiment will be described with reference to FIG. 44. FIG. 44 is a view for describing Variation 5-1 of the fifth embodiment. In Variation 5-1, two support rods are provided at the support base 441.

[Variation 5-2]

Figure 45:
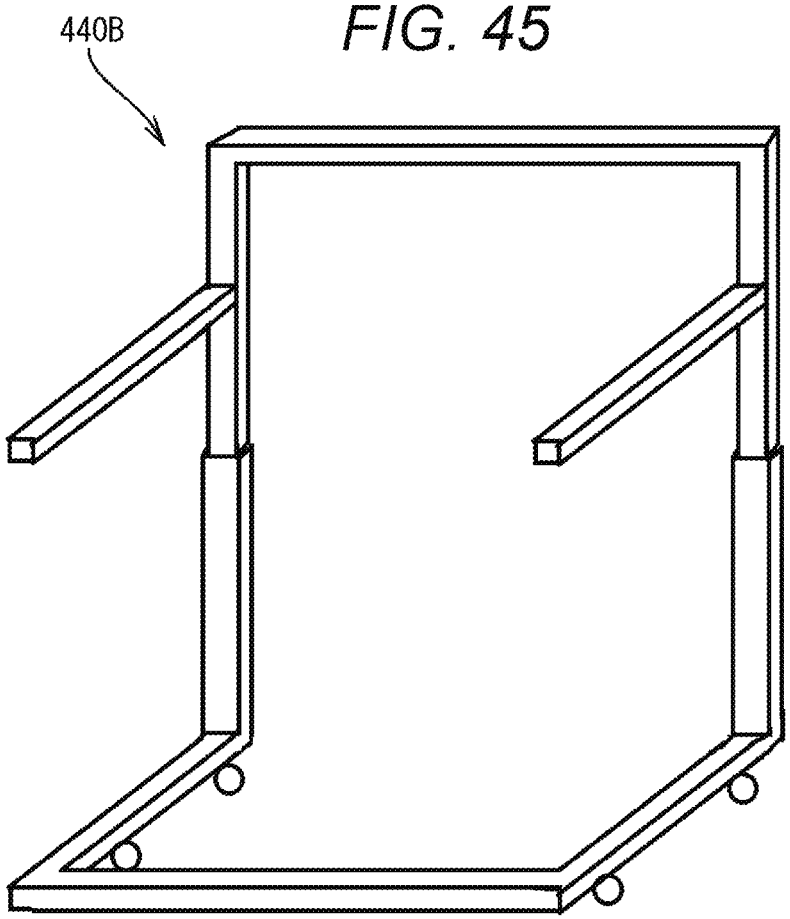
FIG. 45 is a view for describing a second variation of the fifth embodiment.

An invention according to Variation 5-2 of the present embodiment will be described with reference to FIG. 45. FIG. 45 is a view for describing Variation 5-2 of the fifth embodiment. In a hammock lifting/lowering device 440B of Variation 5-2, the base of the support base 441 is in a backwards C-shape in a direction opposite to that of FIG. 44.

[Variation 5-3]

Figure 46:
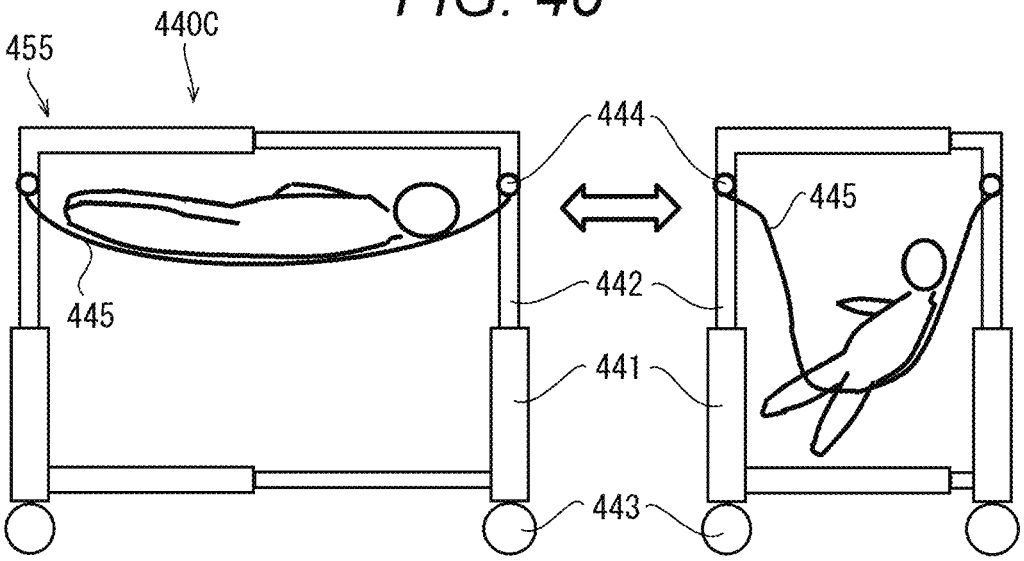
FIG. 46 is a view for describing a third variation of the fifth embodiment.

An invention according to Variation 5-3 of the present embodiment will be described with reference to FIG. 46. FIG. 46 is a view for describing Variation 5-3 of the fifth embodiment. With an extension/contraction device 455, the hammock 445 is at a high position in a case where a hammock lifting/lowering device 440C is wide (wide in the right-left direction in FIG. 46). On the other hand, in a case where the width of the hammock lifting/lowering device 440C is narrow (narrow in the right-left direction in FIG. 46), the hammock 404 is at a low position. An actuator is provided at the extension/contraction device 455, and can drive the hammock lifting/lowering device 440C to extend/contract the hammock lifting/lowering device 440C in a length direction thereof (the right-left direction in FIG. 46). With this configuration, the operation of lifting/lowering the care-requiring person P is allowed even in a narrow space. Moreover, by drive of the extension/contraction device, the care-requiring person P can be lifted/lowered to a desired position in the height direction.

[Variation 5-4]

Figure 47:
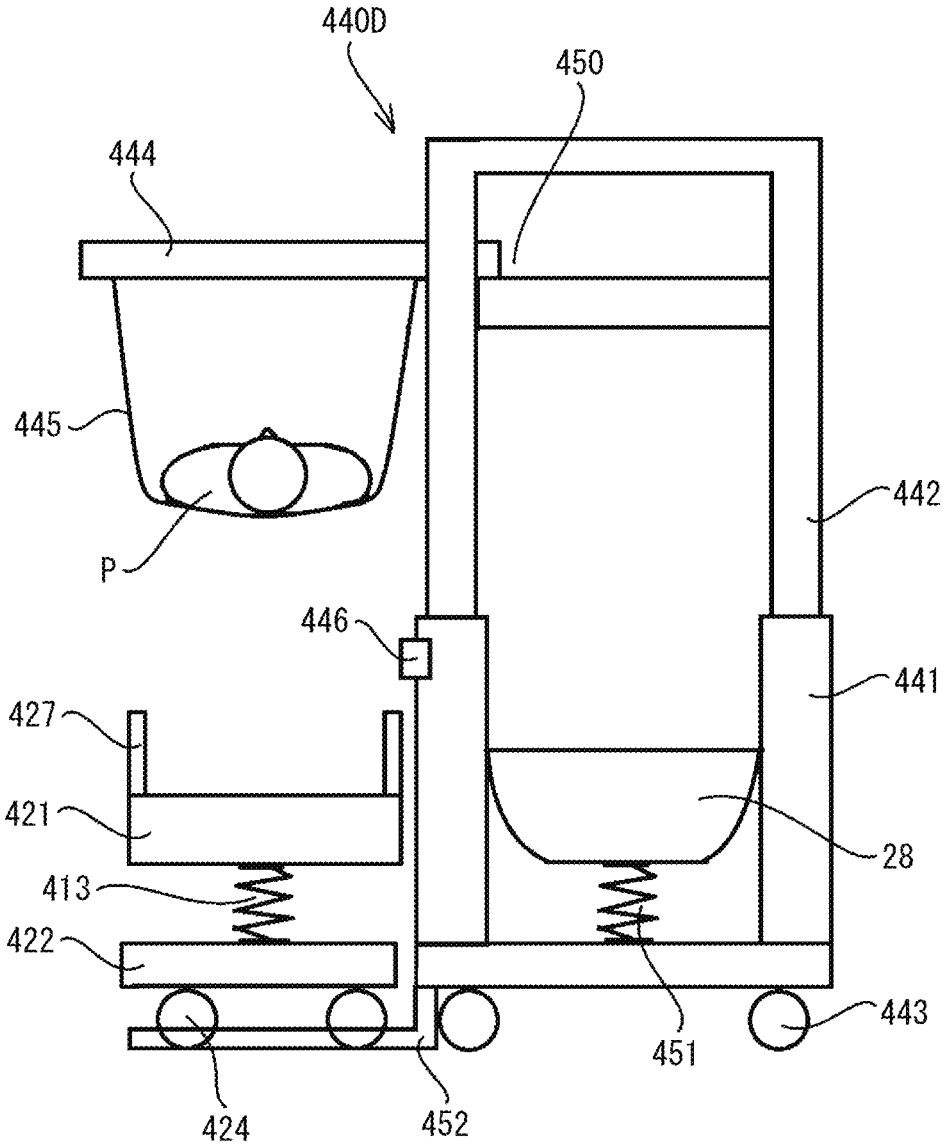
FIG. 47 is a view for describing a fourth variation of the fifth embodiment.

An invention according to Variation 5-4 of the present embodiment will be described with reference to FIG. 47. FIG. 47 is a view for describing Variation 5-4 of the fifth embodiment. In Variation 5-4, a hammock lifting/lowering device 440D further includes a slide member 450, an actuator 451, and an overturn prevention member 452. By the slide member 450, the hammock attachment portion 444 is slidable in the right-left direction in FIG. 47 manually or by a not-shown actuator. With this configuration, the reverse operation is allowed for the hammock 445 and the floor portion 421. For example, the overturn prevention member rotates in the horizontal direction or slides in the length direction, and therefore, can be housed below the support base 441. The hammock lifting/lowering device 440D and the lifting/lowering bed 420 having the floor portion 421 are separately provided, and as the lifting/lowering bed 420, a commercially-available lifting/lowering bed can be utilized without the need for providing a dedicated nursing-care bed. FIG. 47 shows the example of movement of the water tank 28 and the floor portion 421, but the present embodiment is not limited to such an example. For example, utilization for various purposes such as transfer of the care-requiring person P from the stretcher or the wheelchair to the floor portion or the water tank is allowed.

[Variation 5-5]

Figure 48:
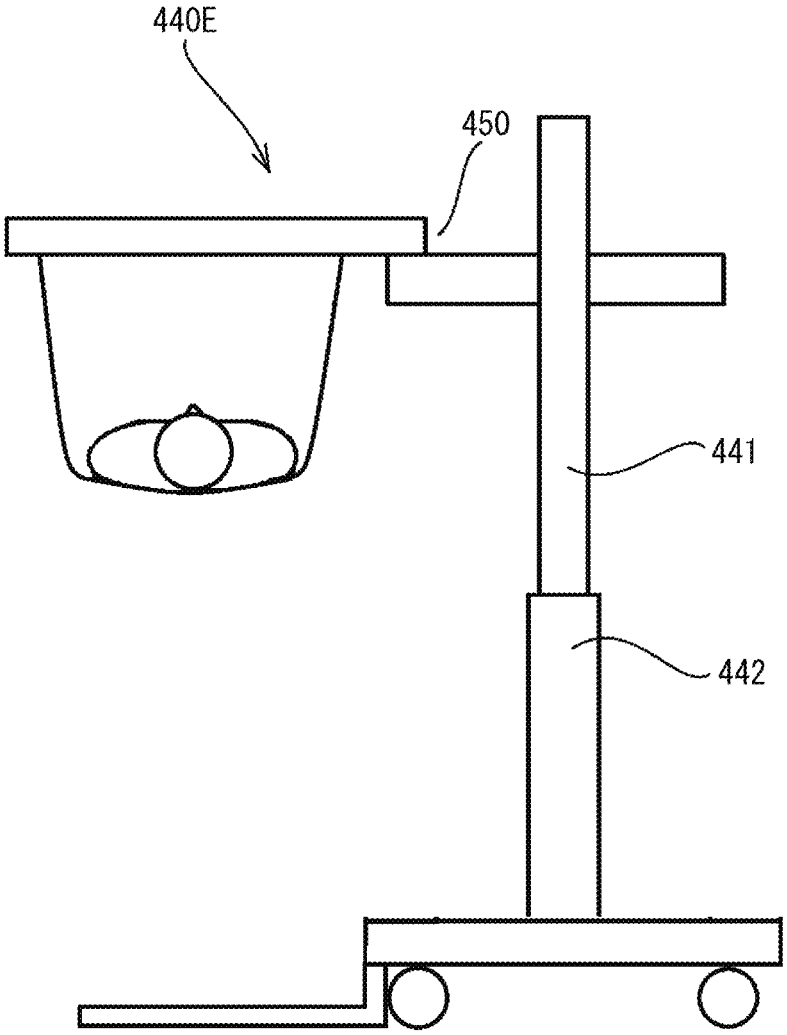
FIG. 48 is a view for describing a fifth variation of the fifth embodiment.

An invention according to Variation 5-5 of the present embodiment will be described with reference to FIG. 48. FIG. 48 is a view for describing Variation 5-5 of the fifth embodiment. In Variation 5-4, the example where four support rods are provided as the support base 441 has been described. Variation 5-5 is an example where there are two support rods. In Variation 5-5, the slide member 450 is also provided, so that by the slide member 450, the hammock attachment portion 444 can be slid in the right-left direction in FIG. 47 manually or a not-shown actuator.

Note that in each variation etc., the same reference numerals are used to represent the configurations common to those of each embodiment and detailed description thereof has been omitted. The nursing-care device according to each of the embodiments and the variations has been described above, but these embodiments describe the examples of the nursing-care device for embodying the technical idea of the present invention and do not intended to specify these examples as the present invention. These embodiments are equally applicable to other embodiments such as each embodiment, a combination of the embodiments, and modifications of each embodiment. For example, regarding the presence or absence of the caster, the type of actuator (e.g., an electric, hydraulic, pneumatic, water hydraulic, or manual type), the applications (e.g., a bed, a bathtub, a wheelchair, a chair, and a stretcher), etc., the present embodiments can be implemented as those modified as necessary, considering each embodiment and each variation.

The invention claimed is:

1. A method for moving, using a nursing-care device, a care receiver from the nursing-care device to other medical or nursing-care equipment, the nursing-care device including a bed body having a rectangular floor portion at an upper surface of the bed body, the bed body having a predetermined area and a predetermined thickness to receive the care receiver, a support base on which the bed body is supported, a support rod extending upward from the floor portion of the bed body, a lifting-lowering unit configured to lift and lower the bed body and the support rod, and a lifting member attached to the support rod to lift the care receiver, the support rod (1) being lowered in synchronization with lifting of the bed body with the lifting-lowering unit and (2) being lifted in synchronization with lowering of the bed body with the lifting-lowering unit, and a suspension member which is attached to the support rod and on which the lifting member is slidable in a direction away from the bed body, wherein the lifting member is lifted or lowered in response to the support rod being lifted or lowered after being moved to a predetermined position apart from the bed body by the suspension member, the method comprising: placing the floor portion of the bed body to have an upper surface at an intermediate lowering position between (a) a height of the care receiver lying on the bed body and (b) a lowermost height to which the bed body is movable in synchronization with the support rod, or placing the lifting member to have a portion fixed to the support rod at an intermediate lifting position between (i) an uppermost height to which the lifting member is movable in synchronization with the bed body and (ii) the height of the care receiver lying on the bed body; placing the suspension member to be slidable and reciprocable in the direction away from and toward the bed body; placing the lifting member between the care receiver and the bed body, and attaching the lifting member to the support rod with the floor portion of the bed body having the upper surface at the intermediate lowering position or with the lifting member having the portion fixed to the support rod at the intermediate lifting position; and after the placing and attaching the lifting member, lowering the bed body and lifting the lifting member attached to the support rod in association with and in response to the lowering of the bed body, and lifting the care receiver from the upper surface of the floor portion of the bed body wherein a distance between the lifting member and the floor portion of the bed body is longer than a distance by which the lifting member is lifted; sliding the lifting member to the predetermined position apart from the bed body using the suspension member, and lowering the support rod to move at least a lowermost portion of the lifting member attached to the support rod to below the lowermost height to which the upper surface of the floor portion of the bed body is movable in synchronization with the support rod, wherein the nursing-care device further includes an overturn prevention mechanism housed in a bed side surface when the nursing-care device is moved or the suspension member is not slidably moved, and the method further includes, after the placing and attaching the lifting member, extending the overturn prevention mechanism in the direction away from the bed body in response to the sliding of the lifting member in the direction away from the bed body using the suspension member.

2. The method according to claim 1, wherein the support rod includes a beam member, and the suspension member is attached to the beam member.

3. The method according to claim 1, wherein the support rod includes a rod-shaped body at an end opposite to the bed body, and the rod-shaped body extends along a longitudinal direction of the bed body.

4. The method according to claim 1, wherein the lifting member is attached to the support rod at least at four points.

5. The method according to claim 1, wherein the floor portion has an opening, and the bed body includes a water tank.

6. The method according to claim 1, wherein the support base is separable from the bed body, and the support base and the bed body are couplable to each other.

7. A method for moving, using a nursing-care device, a care receiver from the nursing-care device to other medical or nursing-care equipment, the nursing-care device including a bed body having a rectangular floor portion at an upper surface of the bed body, the bed body having a predetermined area and a predetermined thickness to receive the care receiver, a support base, on which the bed body is supported, a support rod extending upward from the floor portion of the bed body, a lifting-lowering unit configured to lift and lower the bed body and the support rod, and a lifting member attached to the support rod to lift the care receiver, the support rod (1) being lowered in synchronization with lifting of the bed body with the lifting-lowering unit and (2) being lifted in synchronization with lowering of the bed body with the lifting-lowering unit, and a suspension member which is attached to the support rod and on which the lifting member is slidable in a direction away from the bed body, wherein the lifting member is lifted or lowered in response to the support rod being lifted or lowered after being moved to a predetermined position apart from the bed body by the suspension member, the method comprising:

placing the floor portion of the bed body to have an upper surface at an intermediate lowering position between (a) a height of the care receiver lying on the bed body and (b) a lowermost height to which the bed body is movable in synchronization with the support rod, or placing the lifting member to have a portion fixed to the support rod at an intermediate lifting position between (i) an uppermost height to which the lifting member is movable in synchronization with the bed body and (ii) the height of the care receiver lying on the bed body;

placing the lifting member between the care receiver and the bed body, and attaching the lifting member to the support rod with the floor portion of the bed body having the upper surface at the intermediate lowering position or with the lifting member having the portion fixed to the support rod at the intermediate lifting position; and after the placing and attaching the lifting member, lifting the support rod to lift the care receiver from the upper surface of the floor portion of the bed body, and lowering the support rod to move at least a lowermost portion of the lifting member attached to the support rod to below the lowermost height to which the upper surface of the floor portion of the bed body is movable in synchronization with the support rod, wherein the support base is separable from the bed body, the support base and the bed body are couplable to each other, and the nursing-care device further includes a reinforcement member rotatably attached to the support base via a shaft portion, and the reinforcement member is configured to rotate to open a space for receiving the bed body when coupling the bed body to the support base and when decoupling the bed body from the support base.

8. The method according to claim 7, wherein the reinforcement member is detachable from the support base.

* * * * *